US006062678A

United States Patent [19]

Ishinaga et al.

[11] Patent Number: 6,062,678

[45] Date of Patent: May 16, 2000

[54] INK-JET RECORDING HEAD WITH A PARTICULAR ARRANGEMENT OF THERMOELECTRIC TRANSDUCERS AND DISCHARGE OPENINGS

[75] Inventors: Hiroyuki Ishinaga, Tokyo; Masami Ikeda, Yokohama; Hajime Kaneko, Kodaira; Hideo Saikawa, Machida; Noribumi Koitabashi; Masashi Miyagawa, both of Yokohama; Jun Kawai, Tokyo; Yoshiyuki Imanaka, Kawasaki; Ken Hosaka; Teruo Ozaki, both of Yokohama; Masaaki Okada, Sanjo; Masahiko Kubota, Tokyo; Ryoji Inoue, Kawasaki, all of Japan

[73] Assignee: Canon Kabushiki Kaisha, Japan

[21] Appl. No.: 08/882,034

[22] Filed: Jun. 25, 1997

[30] Foreign Application Priority Data

| | | | |
|---|---|---|---|
| Jun. 26, 1996 | [JP] | Japan | 8-166058 |
| Jun. 27, 1996 | [JP] | Japan | 8-167654 |
| Jun. 28, 1996 | [JP] | Japan | 8-170147 |

[51] Int. Cl.[7] ..... B41J 2/05

[52] U.S. Cl. ..... 347/62; 347/48

[58] Field of Search ..... 347/48, 15, 62, 347/49, 63

[56] References Cited

U.S. PATENT DOCUMENTS

| | | | |
|---|---|---|---|
| 4,450,455 | 5/1984 | Sugitani et al. . | |
| 4,558,333 | 12/1985 | Sugitani et al. . | |
| 4,568,953 | 2/1986 | Aoki et al. | 346/140 R |
| 4,611,219 | 9/1986 | Sugitani et al. . | |
| 4,646,110 | 2/1987 | Ikeda et al. . | |
| 4,778,291 | 10/1988 | Mitsuhashi . | |
| 4,881,318 | 11/1989 | Komuro et al. . | |
| 4,929,964 | 5/1990 | Sato et al. . | |
| 4,965,594 | 10/1990 | Komuro | 347/62 |
| 5,068,674 | 11/1991 | Sato et al. . | |
| 5,166,699 | 11/1992 | Yano et al. . | |
| 5,172,139 | 12/1992 | Sekiya et al. . | |
| 5,262,802 | 11/1993 | Karita et al. . | |
| 5,367,325 | 11/1994 | Yano et al. . | |
| 5,389,957 | 2/1995 | Kimura et al. . | |
| 5,478,606 | 12/1995 | Ohkuma et al. . | |
| 5,479,197 | 12/1995 | Fujikawa et al. . | |
| 5,485,184 | 1/1996 | Sugitani et al. . | |
| 5,565,899 | 10/1996 | Sugimoto et al. . | |
| 5,580,468 | 12/1996 | Fujikawa et al. . | |
| 5,602,576 | 2/1997 | Murooka et al. . | |
| 5,625,384 | 4/1997 | Numata et al. . | |
| 5,731,828 | 3/1998 | Ishinaga | 347/62 |
| 5,754,201 | 5/1998 | Ishinaga | 347/62 |

FOREIGN PATENT DOCUMENTS

| | | | |
|---|---|---|---|
| 0 495 648 | 7/1992 | European Pat. Off. | B41J 2/05 |
| 0 707 964 | 4/1996 | European Pat. Off. | B41J 2/05 |
| 0 747 221 | 12/1996 | European Pat. Off. | B41J 2/05 |
| 55-132259 | 10/1980 | Japan | B41J 3/04 |
| 61-118259 | 6/1986 | Japan | B41J 3/04 |
| 62-35852 | 2/1987 | Japan | B41J 3/04 |
| 62-261452 | 11/1987 | Japan | B41J 3/04 |
| 1-235652 | 9/1989 | Japan | B41J 3/04 |
| 1-257059 | 10/1989 | Japan | B41J 3/04 |

*Primary Examiner*—Joseph Hartary

*Attorney, Agent, or Firm*—Fitzpatrick, Cella, Harper & Scinto

[57] ABSTRACT

An ink-jet recording head comprises a plurality of liquid flow paths having discharge openings for discharging an ink, and a plurality of thermoelectric transducers provided for each liquid flow path in order to discharge the ink, wherein, a frontward thermoelectric transducer located on the discharge opening side is so provided that, when the ink is discharged by the frontward thermoelectric transducer alone, a value of (discharge velocity v/discharge quantity Vd) with respect to a distance OH extending from an end of its discharge opening side to the discharge opening is at a distance OH of the first region in a regional classification into a first region in which the value of v/Vd increases with a decrease in the distance OH and a second region in which it comes to be substantially constant with an increase in the distance OH.

36 Claims, 31 Drawing Sheets

| VdA | VdB | VdB/VdA | ShA | ShB | ShB/ShA |
|---|---|---|---|---|---|
| 15ng | 30ng | 2.0 | 950 $\mu m^2$ | 2210 $\mu m^2$ | 2.3 |

| SMALL HEATER | LARGE HEATER |
|---|---|
| OFF | OFF |
| DISCHARGE QUANTITY = 0ng | |

| SMALL HEATER | LARGE HEATER |
|---|---|
| ON | OFF |
| DISCHARGE QUANTITY = 30ng | |

| SMALL HEATER | LARGE HEATER |
|---|---|
| OFF | ON |
| DISCHARGE QUANTITY = 60ng | |

| SMALL HEATER | LARGE HEATER |
|---|---|
| ON | ON |
| DISCHARGE QUANTITY = 90ng | |

| VdA | VdB | VdB/VdA | ShA | ShB | ShB/ShA |
|---|---|---|---|---|---|
| 15ng | 30ng | 2.0 | 950 $\mu m^2$ | 2300 $\mu m^2$ | 2.4 |

| VdA | VdA+B | VdA+B/VdA | ShA | ShA+B | ShA+B/ShA |
|---|---|---|---|---|---|
| 15ng | 45ng | 3.0 | 950 $\mu m^2$ | 3150 $\mu m^2$ | 3.3 |

| VdA | VdA+B | VdA+B/VdA | ShA | ShA+B | ShA+B/ShA |
|---|---|---|---|---|---|
| 15ng | 48ng | 3.2 | 950 $\mu m^2$ | 3250 $\mu m^2$ | 3.4 |

INK-JET RECORDING HEAD WITH A PARTICULAR ARRANGEMENT OF THERMOELECTRIC TRANSDUCERS AND DISCHARGE OPENINGS

BACKGROUND OF THE INVENTION

1. Field of the invention

This invention relates to an ink-jet recording head having a plurality of thermoelectric transducers in one flow path (nozzle), and an ink-jet recording apparatus employing such a head.

2. Related Background Art

Ink-jet recording apparatus are mostly used as printing apparatus in printers, facsimile machines, word processors, copying machines and so forth. In particular, ink-jet recording apparatus of a system in which heat energy is used as an energy utilized for the discharge of ink and bubbles are generated by the heat energy to discharge the ink are recently coming into wide use.

As a different use of the ink-jet recording apparatus of this system, ink-jet textile printing apparatus that can print patterns, designs or composite images are also recently becoming available. Ink-jet recording heads used in the ink-jet recording apparatus described above make use of thermoelectric transducers (hereinafter also "heaters") as means for generating the heat energy, and, in many instances, employ the construction wherein one heater is provided for one discharge opening. In contrast thereto, heads having a plurality of heads for one discharge opening from the viewpoint of the following are also known in the art.

That is, what is known in the first place is a head comprising a plurality of heaters which are driven alternately or one by one so that the ink-jet recording head can have a long lifetime. Secondly, it is a head making use of a plurality of heaters so that the quantity of ink discharge (discharge quantity) can be changed over a broader range, where the discharge quantity is changed by selecting the heaters to be driven or the number thereof.

Of the heads described above, the latter has, as a more specific construction, a plurality of heaters arranged in the direction of ink discharge in an ink flow path communicating with the discharge opening of the ink-jet recording head, where the heater to be driven (heat-generated) or the number of the heater are selected to make different the distance between the discharge opening and the heater(s) to be driven to thereby change the discharge quantity. Such structure is known in the art.

As a different construction, a head is also known in which, as disclosed, e.g., in Japanese Patent Application Laid-open No. 55-132259, a plurality of heaters having surface areas different from one another are arranged in its ink flow path, and similarly the heater to be driven or the number thereof is changed to make the discharge quantity changeable.

There, however, are some problems in order to accomplish such ink-jet recording apparatus made changeable in the discharge quantity.

One problem is that, when ink droplets with a small discharge quantity are discharged, the ink is caused to bubble by a heater having a small discharge power, i.e., a small heater area, and hence the ink is discharged not only in a small discharge quantity but also at a low discharge velocity. This can be a great problem especially with regard to what is called preliminary discharge performed as a part of operation for discharge restoration.

The preliminary discharge is performed usually when the apparatus is in a certain specified state, and the ink not participating in the recording is discharged from the ink-jet recording head, whereby any ink having thickened in the ink-jet recording head is removed so that the ink discharge can be kept in a good state. Usually, such preliminary discharge is performed at given time intervals immediately after the power source of the apparatus is turned on or in the course of recording.

However, in the instance where the ink can be discharged in various discharge quantities by a plurality of heaters as stated above, the preliminary discharge must be performed at short intervals when the recording is performed in the discharge quantity set small. More specifically, since the ink droplets with a small discharge quantity have a small power, there is a possibility that the thick ink can not be stably discharged, depending on how the ink has thickened as a result of the evaporation of water at the discharge opening. Hence, it becomes necessary to frequently perform the preliminary discharge. In particular, the preliminary discharge performed at given time intervals in the course of recording must be done at shorter intervals, bringing about the problem of a decrease in through-put of the recording.

As another problem, discharge of ink droplets at a low velocity may cause more or less a change of the direction of discharge from the discharge opening to cause a lowering of the performance of ink-shot against a recording medium, tending to adversely affect the image quality.

As still another problem, it has been found that the discharge velocity is substantially proportional to the discharge quantity, thus a difference in discharge velocity is great when the discharge quantity is large or small. When images are formed using such an ink-jet recording head, the large dots and small dots formed by the ink droplets discharged in a large discharge quantity and a small discharge quantity are shot at different positions because of the difference in discharge velocity, resulting in an increase in the possibility of faulty images.

In addition to the above problems, the conventional ink-jet recording heads have the following problems.

When images are recorded in a small discharge quantity, their resolution increases and hence the amount of image data increases, resulting in an increase in recording dots. Accordingly, the ink must be discharged at a higher repetition frequency in order to maintain or increase recording speed. For some types of ink used, it is very difficult to do so.

It is also important that the large-quantity discharge is made at a high repetition frequency. This is because the recording apparatus results in spec-down if the recording in conventional discharge quantity is performed at a low speed, even though the recording in small discharge quantity can be performed at a high speed.

From a different point of view, it is also important for ink-jet recording heads to be of types common to former types. This is due to, e.g., the fact that ink-jet recording heads having a stated discharge quantity are used as exchange types. If, for the purpose of improving the function of recording apparatus, an ink-jet recording head is so set up that not only ink droplets in a large discharge quantity but also those in a small discharge quantity are discharged using the same head and the head is not of the type common to former types, a former type ink-jet recording head and a new type ink-jet recording head for discharging ink droplets of large discharge quantity and small discharge quantity must be produced in parallel, bringing about problems of an increase in production lines and an increase in production cost.

SUMMARY OF THE INVENTION

The present invention was made taking account of the problems involved in the conventional techniques. Accordingly, an object of the present invention is to provide an ink-jet recording head that is so set up that a plurality of heaters are provided for one discharge opening, having advantages that the head can have a long lifetime and can enjoy a broader range within which the ink discharge quantity is changeable, can perform high-speed recording of high-quality images and also can be used in former-type recording apparatus.

Other objects of the present invention will become apparent from the embodiments described later.

According to an embodiment, the ink-jet recording head of the present invention is an ink-jet recording head comprising a plurality of liquid flow paths having discharge openings for discharging an ink, and a plurality of thermoelectric transducers provided for each liquid flow path in order to discharge the ink, wherein;

a frontward thermoelectric transducer located on the discharge opening side is so provided that, when the ink is discharged by the frontward thermoelectric transducer alone, a value of (discharge velocity v/discharge quantity Vd) with respect to a distance OH extending from an end of its discharge opening side to the discharge opening is at a distance OH of the first region in a regional classification into a first region in which the value of v/Vd increases with a decrease in the distance OH and a second region in which it comes to be substantially constant with an increase in the distance OH.

In this embodiment, at least one additional thermoelectric transducer may be substantially the same thermoelectric transducer as the frontward thermoelectric transducer, and this at least one additional thermoelectric transducer may have a distance OH of the second region.

The thermoelectric transducers may also be so provided that the distance from an end of the discharge opening side of each thermoelectric transducer to the discharge opening is different from that of the additional thermoelectric transducer, and are so provided that a discharge velocity vF and a discharge quantity VdF at the time when only the frontward thermoelectric transducer is used and a discharge velocity vF+B and a discharge quantity VdF+B at the time when the frontward thermoelectric transducer and the additional thermoelectric transducer are used satisfy the relation of:

$$(vF/VdF)>(vF+B/VdF+B).$$

The additional thermoelectric transducer may also be so provided that, when the ink is discharged by the additional thermoelectric transducer alone, the value of (discharge velocity v/discharge quantity Vd) with respect to the distance OH is at a distance OH of the second region in a regional classification into a first region in which the value of v/Vd increases with a decrease in the distance OH and a second region in which it comes to be substantially constant with an increase in the distance OH.

The thermoelectric transducers may form bubbles by film boiling, the thermoelectric transducers may each have a length of from 80 $\mu$m to 140 $\mu$m and a width smaller than the diameter of the discharge opening, and both the frontward thermoelectric transducer and the additional thermoelectric transducer may have a portion where they are provided adjacently in parallel; the distance OH of the frontward thermoelectric transducer being 130 $\mu$m or less.

According to another embodiment, the ink-jet recording head of the present invention comprises a plurality of liquid flow paths having discharge openings for discharging an ink, and a plurality of thermoelectric transducers provided for each liquid flow path in order to discharge the ink, wherein;

the thermoelectric transducers are so provided that the distance from an end of the discharge opening side of one thermoelectric transducer to the discharge opening is different from that of an additional thermoelectric transducer, and are so provided that a discharge velocity vF and a discharge quantity VdF at the time when only a thermoelectric transducer located frontward on the discharge opening side is used and a discharge velocity vF+B and a discharge quantity VdF+B at the time when both the frontward thermoelectric transducer and the additional thermoelectric transducer are used satisfy the relation of:

$$(vF/VdF)\geqq(vF+B/VdF+B)\times C$$

wherein C is a constant proportional to ink characteristics.

In this embodiment, the discharge velocity vF and the discharge quantity VdF at the time when only a thermoelectric transducer located frontward on the discharge opening side is used and the discharge velocity vF+B and the discharge quantity VdF+B at the time when both the frontward thermoelectric transducer and the additional thermoelectric transducer are used may satisfy the relation of:

$vF\geqq 8$ (m/S)

$vF+B\leqq 16$ (m/S)

$VdF\leqq 25$ (pl)

$35\leqq VdF+B\leqq 45$(pl).

The above ink may be a color ink having a surface tension of from about 26.0 dyne/cm to about 37.0 dyne/cm and a viscosity of from 1.85 cP to 2.60 cP.

The discharge velocity vF and the discharge quantity VdF at the time when only a thermoelectric transducer located frontward on the discharge opening side is used and the discharge velocity vF+B and the discharge quantity VdF+B at the time when both the frontward thermoelectric transducer and the additional thermoelectric transducer are used may also satisfy the relation of:

$vF\leqq 7.5$ (m/S)

$vF+B\leqq 16$ (m/S)

$VdF\leqq 40$ (pl)

$65\leqq VdF+B\leqq 80$ (pl).

The above ink may be a black ink having a surface tension of from about 40.5 dyne/cm to about 46.5 dyne/cm and a viscosity of from 1.5 cP to 2.1 cP.

The above ink-jet recording head may be provided in plurality and have different liquid chambers respectively provided for a plurality of inks; and may have a head where the ink held therein has a surface tension of from about 26.0 dyne/cm to about 37.0 dyne/cm and a viscosity of from 1.85 cP to 2.60 cP and which satisfies constant C=1.15, and a head where the ink held therein has a surface tension of from about 40.5 dyne/cm to about 46.5 dyne/cm and a viscosity of from 1.5 cP to 2.1 cP and which satisfies constant C=1.0.

According to still another embodiment, the ink-jet recording head of the present invention comprises a plurality of liquid flow paths having discharge openings for discharging an ink, and a plurality of thermoelectric transducers provided for each liquid flow path in order to discharge the ink, wherein;

a discharge velocity vF and a discharge quantity VdF at the time when only a thermoelectric transducer located frontward on the discharge opening side is used and a discharge velocity vF+B and a discharge quantity VdF+B at the time when both the frontward thermoelectric transducer and the additional thermoelectric transducer are used may satisfy the relation of:

$v \leqq 8$ (m/S)

$vF+B \leqq 16$ (m/S)

$VdF \leqq 25$ (pl)

$35 \leqq VdF+B \leqq 45$ (pl)

when an ink having a surface tension of from about 26.0 dyne/cm to about 37.0 dyne/cm and a viscosity of from 1.85 cP to 2.60 cP is used; and satisfy the relation of:

$vF \geqq 7.5$ (m/S)

$vF+B \leqq 16$ (m/S)

$VdF \leqq 40$ (pl)

$65 \leqq VdF+B \leqq 80$ (pl)

when an ink having a surface tension of from about 40.5 dyne/cm to about 46.5 dyne/cm and a viscosity of from 1.5 cP to 2.1 cP is used;

the thermoelectric transducers being so provided that the distance from an end of the discharge opening side of one thermoelectric transducer to the discharge opening is different from that of an additional thermoelectric transducer, and the thermoelectric transducer located frontward on the discharge opening side being provided in a region where the distance OH is 130 $\mu$m or less.

The rearward thermoelectric transducer may be larger than the frontward thermoelectric transducer.

According to a further embodiment, the ink-jet recording head of the present invention may be an ink-jet recording head which is usable in a printer that performs discharge by the use of a first head comprising i) a plurality of liquid flow paths having discharge openings for discharging an ink and ii) a plurality of thermoelectric transducers provided for one liquid flow path;

the head being usable as an exchange for the first head, having two thermoelectric transducers provided in parallel for one liquid flow path and being used as a second head; and a distance OP from the center of gravity of each thermoelectric transducer of the second head to the discharge opening being substantially the same as a distance OC from the center of gravity of the thermoelectric transducer of the first head to the discharge opening of the first head.

In the above embodiments, the ink-jet recording head may be used in a printer that performs discharge by the use of a first head provided with one thermoelectric transducer in one liquid flow path;

the head being used as an exchange for the first head; and a distance OP from the center of gravity of the both thermoelectric transducers to the discharge opening being substantially the same as a distance from the center of gravity of the thermoelectric transducer of the first head to the discharge opening of the first head.

The distance OP from the center of gravity of each thermoelectric transducer to the discharge opening may be smaller than the distance from the center of gravity of the thermoelectric transducer of the first head to the discharge opening of the first head.

The thermoelectric transducers may each have a rectangular shape which is long and slender in the direction of discharge.

The present invention also provides an ink-jet recording head cartridge comprising the ink-jet recording head constructed as described above and a liquid container that holds a liquid to be fed to the ink-jet recording head.

The present invention still also provides an ink-jet recording apparatus comprising the ink-jet recording head constructed as described above and a drive signal feeding means that feeds drive signals for making a liquid discharged from the ink-jet recording head.

According to another embodiment of the ink-jet recording apparatus of the present invention, the ink-jet recording apparatus comprises the ink-jet recording head constructed as described above and a recording medium transport means for transporting a recording medium that receives a liquid discharged from the ink-jet recording head.

The discharge quantity Vd of ink droplets has characteristics such that it stands maximum at a value assigned when the distance OH extending from an end of the discharge opening side of a thermoelectric transducer to the discharge opening is a certain distance, and decreases as the distance comes apart from the certain distance OH. The discharge velocity v has characteristics such that it increases with a decrease in the distance OH, and on the other hand, refill frequency fr decreases with a decrease in the distance OH.

The present invention is based upon such characteristics, and the thermoelectric transducers are provided in the manner as described above so that the discharge quantity, discharge velocity and refill frequency can satisfy the required characteristics.

BRIEF DESCRIPTION OF THE DRAWINGS

FIGS. 13A, 13B, 13C and 13D show discharge characteristics in an instance where the distance OH of a rearward heater is set stationary and the position of a frontward heater is changed, in which FIG. 13A shows discharge velocity v, FIG. 13B discharge quantity Vd, and FIG. 13C values given by dividing discharge velocity v by discharge quantity Vd (v/Vd), and these show both an instance where only the frontward heater is used and an instance where the frontward heater and the rearward heater are simultaneously used. FIG. 13D shows the amount of positional deviation in each instance.

FIGS. 14A, 14B, 14C and 14D show discharge characteristics in an instance where the distance OH of a rearward heater is set stationary and the position of a frontward heater is changed, in which FIG. 14A shows discharge velocity v, FIG. 14B discharge quantity Vd, and FIG. 14C values given by dividing discharge velocity v by discharge quantity Vd (v/Vd), and these show both an instance where only the frontward heater is used and an instance where the frontward heater and the rearward heater are simultaneously used. FIG. 14D shows the amount of positional deviation in each instance.

DESCRIPTION OF THE PREFERRED EMBODIMENTS

Embodiments of the present invention will be described below with reference to the accompanying drawings.

A first embodiment of the present invention will be described below.

Head Structure

Figure 1A:
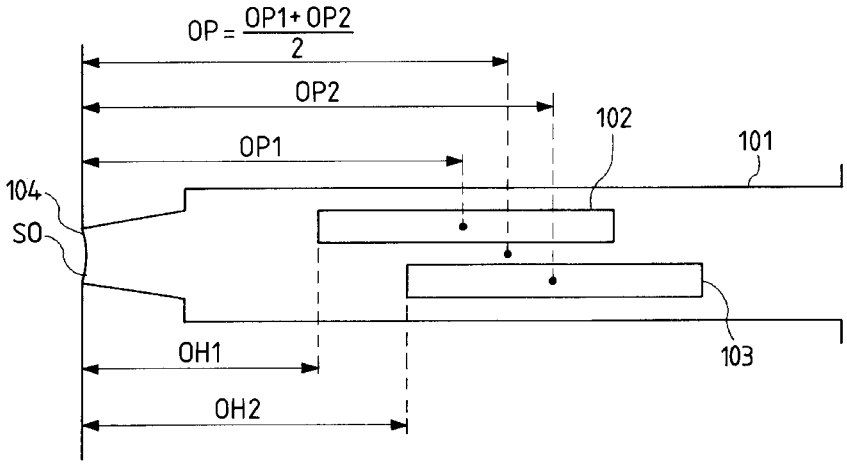
FIGS. 1A and 1B are diagrammatic plan views showing the construction of an ink-jet recording head according to an embodiment of the present invention and that of a conventional product as a comparative example, respectively, at their nozzle portions.
Figure 1B:
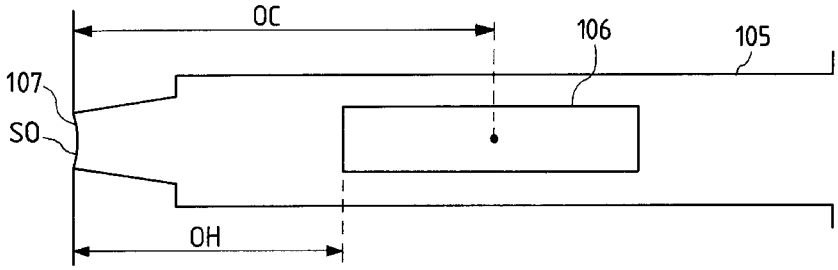

FIGS. 1A and 1B are diagrammatic plan views showing the construction of an ink-jet recording head according to an embodiment of the present invention and that of a conventional product as a comparative example, respectively, at their nozzle portions.

The embodiment shown in FIG. 1A shows the construction of an edge-shoot type head that discharges liquid in the direction substantially vertical to the surface on which a heating element is formed. Nozzles (101) are arranged in a density of 360 dpi. In each nozzle 101, two heaters 102, 103 having the same size and the same length are provided side by side in such a manner that the distance from a discharge opening 104 to each heater is different. In the comparative example shown in FIG. 1B, nozzles (105) are arranged in the same density as in the embodiment shown in FIG. 1A, but, in each nozzle 105, only one heater 106 is provided.

In the following description, the distances from the discharge opening 104 to the heaters 102 and 103 in the embodiment shown in FIG. 1A are represented by OH1 and OH2, respectively, and the distances from the discharge opening 104 to the centers of gravity (the middles) of the heaters 102 and 103 are represented by OP1 and OP2, respectively, where the center of gravity imagined when these two heaters 102 and 103 are assumed as one heater is represented by OP=(OP1+OP2)/2. In the comparative example shown in FIG. 1B, the distance from the discharge opening 107 to the heater 106 is represented by OH, and the distance from the discharge opening 107 to the center of gravity of the heater 106, OC.

As will be detailed later, the two heaters are so set up that they can be driven independently from each other, where the discharge quantity of small ink drops for each heater is set to about 20 pl. When such two heaters are simultaneously driven, large ink drops with a discharge quantity of about 40 pl are discharged which are about twice the discharge quantity in the discharge from either head.

Figure 2A:
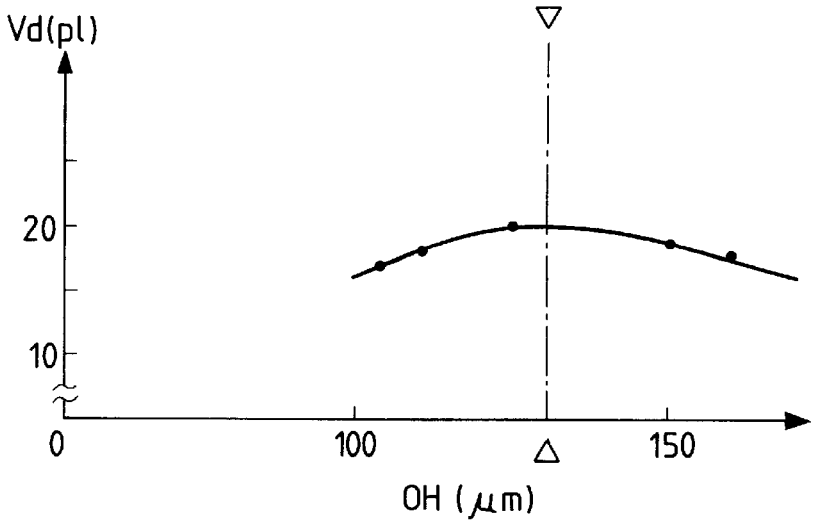
FIGS. 2A, 2B and 2C are graphs showing discharge quantity Vd, discharge velocity v and refill frequency fr, respectively, of ink droplets in the case when the distance OH from the discharge opening to the heater end is assumed as a variable.
Figure 2B:
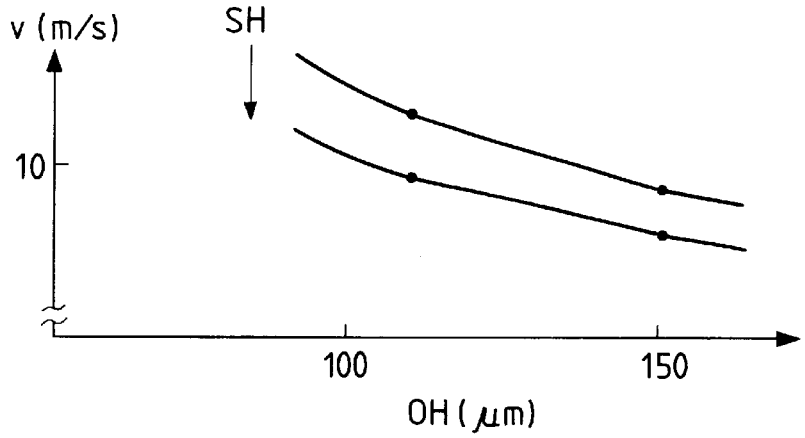
Figure 2C:
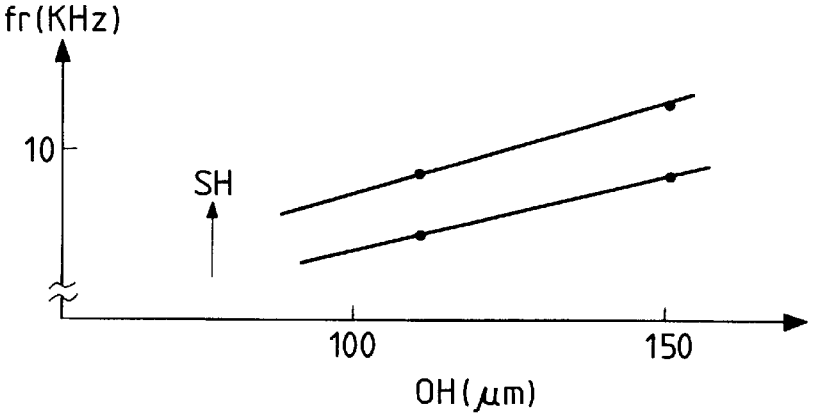

Discharge characteristics of the ink-jet recording head according to the present embodiment will be described below with reference to FIGS. 2A to 2C showing various characteristics. FIGS. 2A to 2C are graphs showing discharge quantity Vd, discharge velocity v and refill frequency fr, respectively, of ink droplets in the case when the distance OH from the discharge opening to the heater end is assumed as a variable.

The discharge quantity Vd of ink droplets stands maximum at a value assigned by a certain distance OH indicated in FIG. 2A by a one-dotted chain line, and decreases as the distance comes apart from the certain distance OH.

The discharge velocity v increases with a decrease in the distance OH as shown in FIG. 2A.

The refill frequency fr, contrary to the discharge velocity v, decreases with a decrease in the distance OH as shown in FIG. 2C.

In both FIGS. 2B and 2C, the discharge velocity v and the refill frequency fr are shown in respect of two heater areas, and both of these parameters shift in accordance with the dimensions of discharge area SH.

Figure 3:
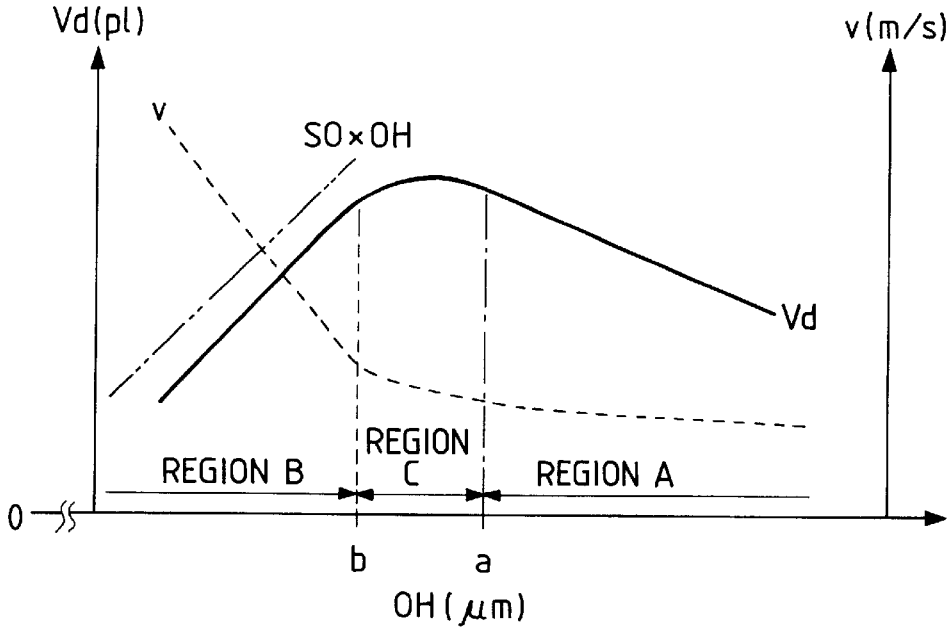
FIG. 3 is a graph showing the relationship between the discharge quantity Vd and discharge velocity v of ink droplets, the product of discharge opening area SO and distance OH from the discharge opening to the heater end (SO×OH), and the distance OH.
Figure 4:
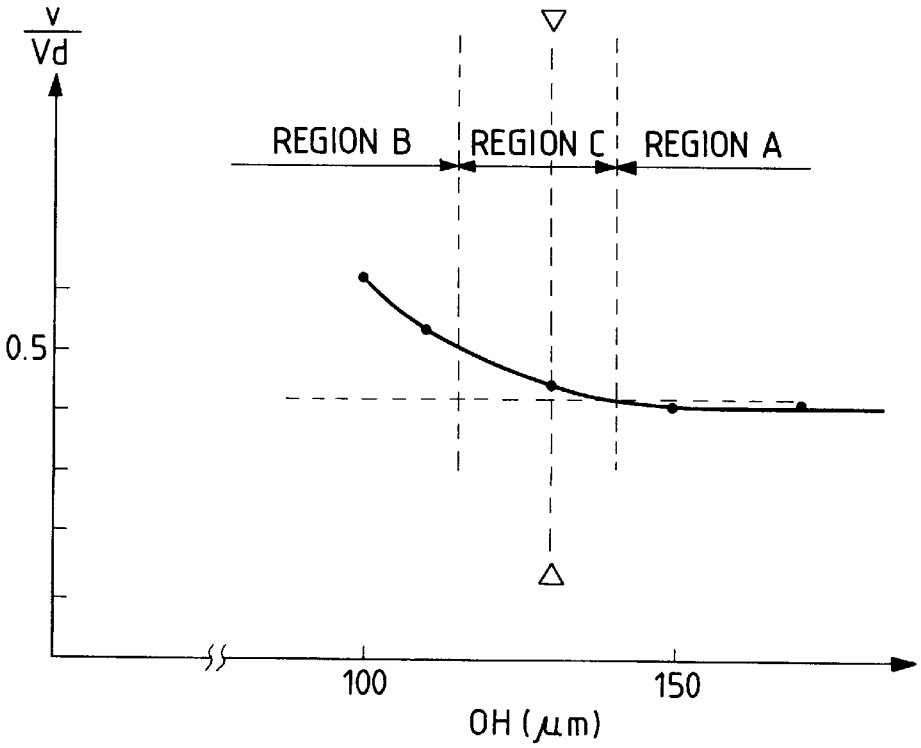
FIG. 4 is a graph showing the relationship between the results given by dividing discharge velocity v by discharge quantity Vd (v/Vd) and the distance OH.

FIG. 3 is a graph showing the relationship between the discharge quantity Vd and discharge velocity v of ink droplets, the product of discharge opening area SO and distance OH from the discharge opening to the heater end (SO×OH), and the distance OH. FIG. 4 is a graph showing the relationship between the results given by dividing discharge velocity v by discharge quantity Vd (v/Vd) and the distance OH. In FIGS. 3 and 4, singular points a and b are defined from a viewpoint different from the certain distance OH as described above, and the distance OH is classified into three regions, i.e., region A longer than a, region B not shorter than b, and region C extending between a and b.

As tendencies peculiar to these regions, the following can be seen: In the region A, the discharge velocity v and the discharge quantity Vd have a relation substantially proportional to an increase in the distance OH and hence the value of v/Vd is substantially constant. In the region B, the discharge quantity Vd is substantially proportional to the product of discharge area SO and distance OH, and, in the region C, the discharge quantity Vd is substantially constant.

When considered taking note of each of the discharge quantity Vd and discharge velocity v, the above regions A to C can also be defined in the following way.

When viewed from the discharge quantity Vd:

Region A: The section in which the discharge quantity Vd decreases with an increase in the distance OH.

Region B: The section in which the discharge quantity Vd increases substantially in proportion to the distance OH.

Region C: The section in which the discharge quantity Vd is substantially constant with respect to the distance OH.

When viewed from the discharge velocity v:

Over the all regions, the discharge velocity v decreases with an increase in the distance OH, but especially in the region C it changes gently.

Based upon the discharge characteristics and refill frequency characteristics as described above, the mechanism by which the regions as shown in FIGS. 2A to 2C, 3 and 4 will be explained below, some of which is presumption.

When the heater is assumed to be fixed, the discharge velocity v and discharge quantity Vd of ink droplets greatly depend on the (inertial) resistance of a nozzle at its part on the discharge opening side of the heater and the (inertial) resistance at the rear of the heater, and also are determined from the relation that the discharge quantity Vd does not greatly exceed the product of discharge opening area SO and distance OH from the discharge opening to the heater end.

The region A (second region) in FIG. 3 stands in the relation of SO'×OH<Vd (SO' is a proportionality factor). That is, it is a region where the discharge velocity v and the discharge quantity Vd are determined in accordance with, e.g., the balance of (inertial) resistance between the rear (liquid chamber side) and the front (discharge opening side). When the inertial resistance at the front of the heater and the inertial resistance at the rear thereof are represented by F and R, respectively, it is a region where the discharge velocity v and discharge quantity Vd are substantially proportional to R/(F+R). Hence the inertial resistance at the front of the heater increases with an increase in the distance OH. On the other hand, the inertial resistance at the rear of the heater decreases with it, and hence the force toward the discharge opening side becomes weak, resulting in a decrease in velocity and quantity of the ink moving toward the discharge opening side. This matter will be more detailed below.

Figure 5:
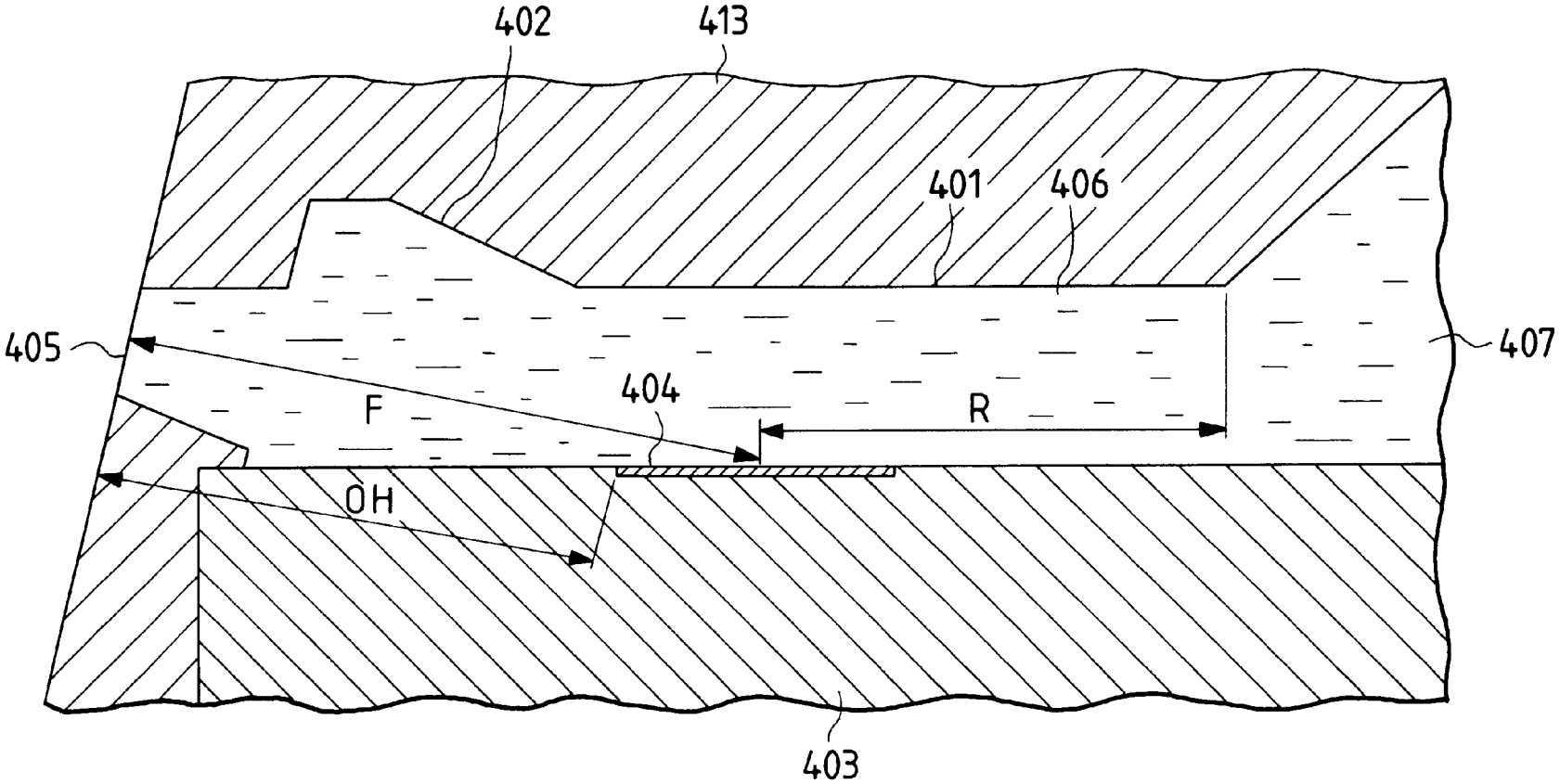
FIG. 5 is a vertical cross-sectional view chiefly showing the ink flow path of an ink-jet recording head according to an embodiment of the present invention.

FIG. 5 cross-sectionally illustrates an ink flow path of an ink-jet recording head commonly available.

A top plate 413 in which an ink-flow path groove has been formed and a heater board 403 are joined to make up an ink flow path 401. The ink flow path 401 communicates with a common liquid chamber 407 and is filled with an ink 406. In the heater board 403, a heater 404 that generates heat energy for discharging the ink is formed, by means of which the ink 406 in the ink flow path 401 is heated to produce bubbles by vaporization. At the time of standing, the ink 406 forms a meniscus at a given position in the vicinity of an orifice 405 because of the balancing of the negative pressure in an ink tank (not shown) and the capillary force (flow path resistance) in the ink flow path 401. Then, once bubbles are formed upon supply of driving electric power to the heater 404, the bubbles undergo volumetric changes to produce a pressure, so that the ink 406 present in the ink flow path 401 at its part frontward from the heater 404 are discharged in the form of droplets. Thereafter, the ink 406 remaining in the ink flow path 401 at its part frontward from the heater 404 acts to return to the heater side, thus the meniscus recedes.

In FIG. 5, when the ink flow resistance (inertial resistance) on the orifice side from the middle of the heater 404 is assumed as F, it can be expressed as F=(distance between the middle of heater and orifice)/(ink flow path cross-sectional area). Also, when the ink flow resistance on the common liquid chamber 7 side from the middle of the heater 404 is assumed as R, it can be expressed as R=(distance between the middle of heater and liquid chamber)/(ink flow path cross-sectional area).

Figure 6:
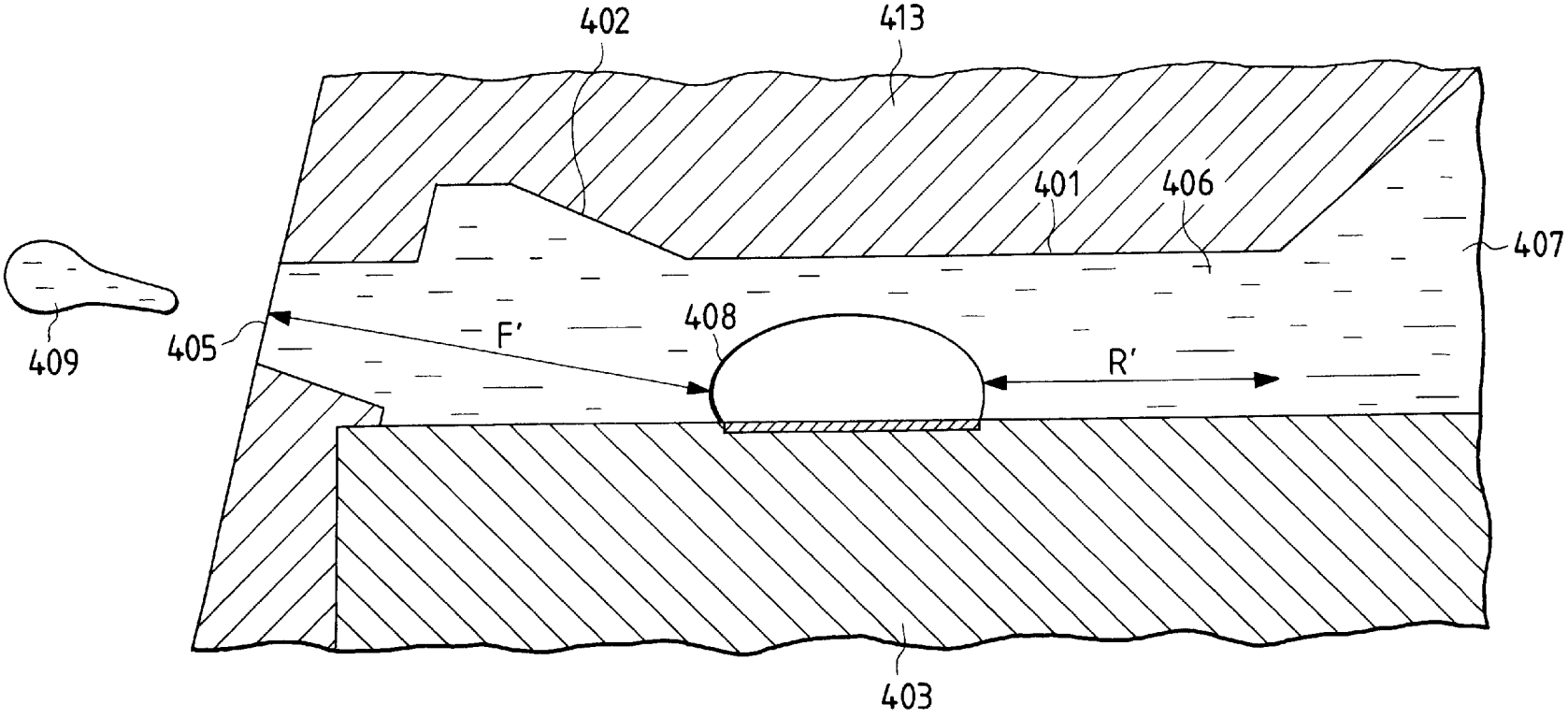
FIG. 6 is a view similar to FIG. 5, for illustrating an embodiment of the present invention.

Now, assume that the ink 406 is heated by the heater 404 to produce a bubble 408 as shown in FIG. 6 and an ink droplet 409 is discharged from the orifice 405. Here, when a maximum volume of the bubble 408 is regarded as Vb, the volume Vd (discharge quantity) of the ink droplet 409 can be substantially expressed by the following expression (1).

$$Vb=[R/(F+R)]\cdot Vb \quad (1)$$

wherein Vb is proportional to SH (heater size).

The following is evident from the expression (1).

With an increase in F, i.e., as the distance OH (see FIG. 5) from the front end of the heater 404 to the orifice 405 becomes longer, the discharge volume (discharge quantity) Vd decreases. This relation is shown by a curve a in FIG. 7.

Meanwhile, the region B (first region) is a region where Vd≅SO'×OH. As the distance OH becomes smaller, the inertial resistance at the part frontward from the heater becomes smaller, and hence the velocity v increases. However, it is presumed that the bubble produced and present on the heater is an obstacle to the flow of ink in the nozzle toward the discharge opening side to intercept the flow, and consequently the discharge quantity Vd decreases without being proportional to the discharge velocity v. In short, it is presumed that a state of no ink feeding takes place even though it is expected for the supplied power to provide a much larger discharge quantity Vd. More specifically, it is presumed that a limited discharge quantity Vdlim is given which is formed by the discharge opening area SO and the distance OH extending from the discharge opening to the heater end. This relation is expressed by the following expression (2).

$$Vdlim=SO\cdot OH \quad (2)$$

Figure 7:
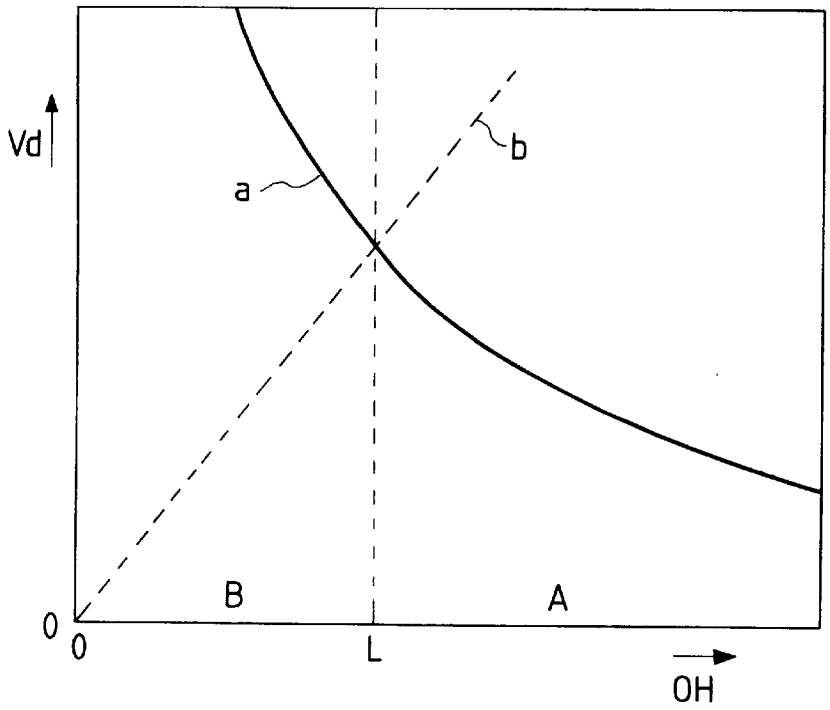
FIG. 7 is a graph showing the relationship between the distance of a discharge heater and the volume of discharged ink droplets, for illustrating the above embodiment.

The relation represented by the expression (2) is shown by a curve b in FIG. 7.

Figure 8:
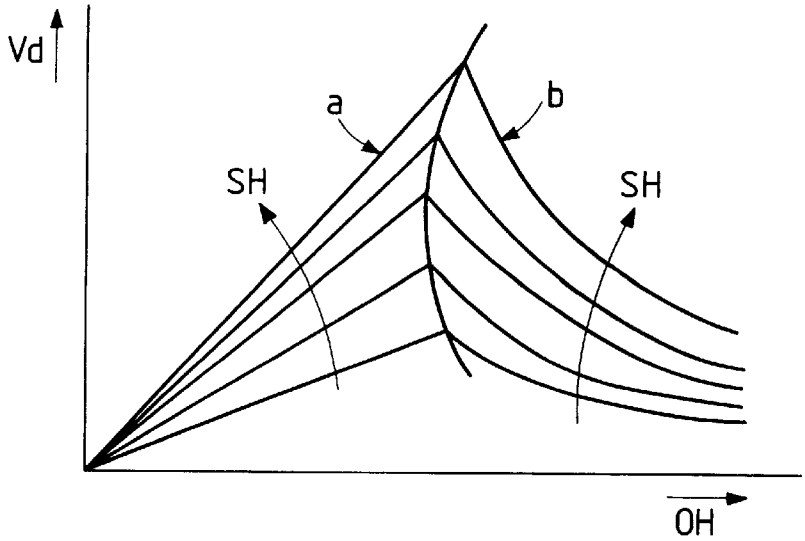
FIG. 8 is a graph showing how curves a and b change when heater area SH is made larger.

FIG. 8 shows a general relationship between the discharge quantity Vd and the distance OH, and is a graph showing how the curves a and b change with a change in the heater area SH. As is seen from FIG. 8, the curves a and b shift in accordance with the dimensions of the heater area SH.

Here, the distance of a point at which the two curves a and b shown in FIG. 7 intersect is represented by L, the region that gives Vd>Vdlim setting OH=L as a boarder, region B, and the region that satisfies Vd<Vdlim, region A. The course of action of the refill, i.e., bubbling→debubbling→meniscus formation will be described below with reference to FIGS. 9A to 9D.

Figure 9A:
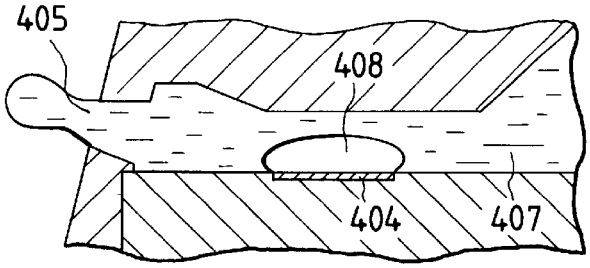
FIGS. 9A, 9B, 9C and 9D are cross-sectional views illustrating how the refill behaves at the time of discharge, in comparison with the above embodiment with the prior art.
Figure 9B:
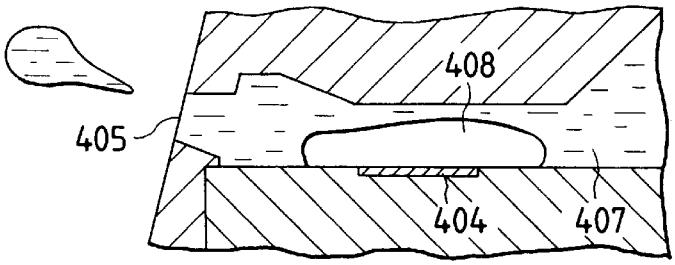

The bubble 408 is produced at a time t1 by heating by means of the heater 404 (FIG. 9A), whereupon at a time t2 it comes to stand as shown in FIG. 9B.

Figure 9C:
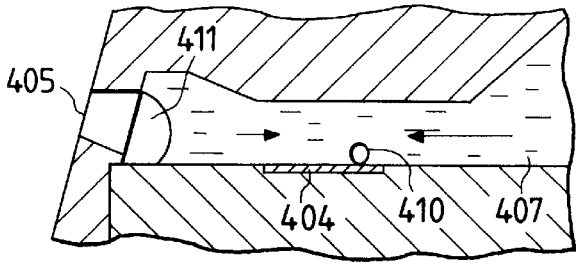
Figure 9D:
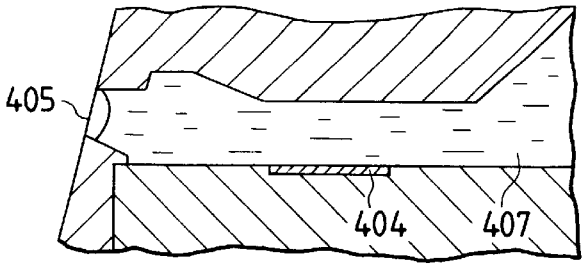

As shown in FIG. 9C, the bubble 408 disappears (debubbling) at a time t3.

The principle of this debbubling will be explained below with reference to FIG. 9C.

When the maximum volume of the bubble 408 is represented by Vb, the fluid resistance at the part on the orifice 405 side of the bubble, F', and the fluid resistance at the part on the liquid chamber, R', the regressive volume (blank-forming volume) VMe of a meniscus 411 is expressed by (see FIG. 6):

$$VMe=(R'/F'+R')\cdot Vb=(R'/F'+R')\cdot(F+R/R).Vd.$$

Namely, at the time of debubbling, when it is taken into account that, toward the bubble coming to disappear, the ink moves from both the orifice 405 side and the liquid chamber 407 side in order to fill the blank, the resistance on the orifice 405 side increases when F' is large as in the region A (since the distance OH is relatively large), so that the amount of movement of ink from the liquid chamber 407 relatively increases. As the result, a debubbling position 410 does not move rearward, and hence the amount of regression (regressive volume) VMe can be small. This is advantageous for the refill.

On the other hand, when F' is small as in the region B (since the distance OH is small), the amount of movement of ink from the meniscus 409 side relatively increases, so that the debubbling position 410 shifts rearward, and hence the amount of meniscus regression becomes large. Hence, the refill time increases.

As described above, in the region A, the amount of meniscus regression is small and the refill frequency fr is high. On the other hand, in the region B, the amount of meniscus regression is large and the refill frequency fr is low.

In this way, up to now the ink flow path is classified into the region A and the region B on the basis of the distance OH at which the discharge quantity Vd reaches a maximum value in the case when the distance OH is assumed as a variable. However, as a result of experiments made using the recording head of the present embodiment, it has been found that, when the vicinity of the maximum value is carefully observed, the discharge quantity Vd is in a very gentle curve which is substantially constant with respect to the distance OH.

To make a presumption, for one thing, it is considered that this is because the bubble produced and present on the heater does not perfectly comes to be an obstacle to the flow of ink in the nozzle toward the discharge opening side.

More specifically, since two heaters are arranged substantially in parallel in the ink-jet recording head of the present embodiment, the frontward heater does not intercept the whole flow path of the nozzle and does not perfectly intercept the flow of ink, thus the ink can be fed from the side (lateral position) of the frontward heater.

To make a presumption from a different point of view, it is considered that, since it takes a certain time before the droplet is completely formed, the inertial resistance at the part on the front side of the heater decreases when the ink partly projects from the end of the nozzle (the discharge opening) at the initial stage of discharge, so that the viscosity resistance becomes predominant to make slow the flow of ink in the nozzle, and the discharge quantity Vd gradually decreases especially when the distance OH is made shorter where such effect is not expected. At any event, in this region, not only the distance OH but also the discharge quantity Vd are stable, and hence they can be said to be stable also to any aberration in manufacture. Also, since the distance OH is relatively long, relatively good values are obtained also on the refill frequency fr.

In the conventional ink-jet recording head having a large discharge quantity, provided with one discharge heater in one nozzle, an experimental result shows that the discharge quantity Vd is approximately equal to the proportional relationship that the proportionality factor SO' comes to be approximately SO when the distance OH is assumed as a variable.

Figure 10:
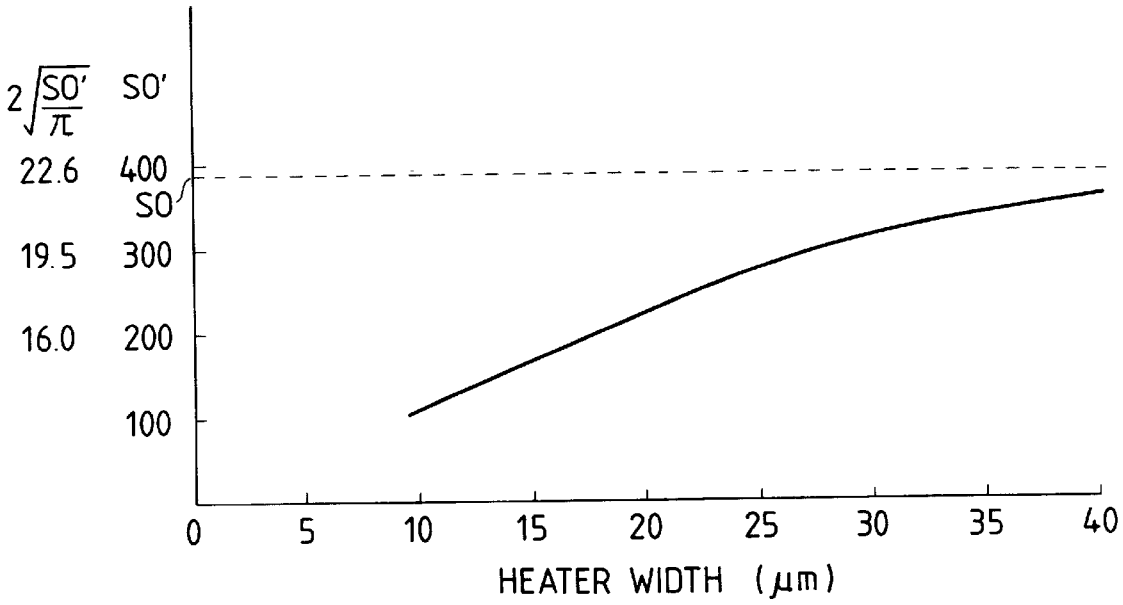
FIG. 10 is a graph showing changes of proportionality factor SO'.

However, as a result of an experiment made this time while changing the heater area so as to make the heater width smaller, it has been found that the proportionality factor SO' has such a relation that it increases with an increase in the heater width as shown in FIG. 10 and becomes approximate to SO.

More specifically, in the case when the heater has a small width, the proportionality factor SO' shows a smaller value than the discharge opening area SO. Here, assuming this proportionality factor SO' as an effective discharge opening area, it can be considered that the effective discharge opening area becomes smaller as the heater width becomes narrower. Here, assuming the SO' on the abscissa in FIG. 10 as the effective discharge opening area, the value of discharge opening diameter $2(SO'/\pi)^{1/2}$ in such an instance is made to correspond.

Based upon such a finding as stated above, in the ink-jet recording head according to the present embodiment, one heater (i.e., the frontward heater, calling the discharge opening side as "frontward") has a heater width so set that the effective discharge opening area is smaller (about half) than SO and also its heater position is so set that the distance OH corresponds to the region B (or the region C, the second region), and the other heater (the rearward heater) has substantially the same size as the frontward heater and its heater position is so set that the distance OH corresponds to the region A (or the region C), and the other heater (the rearward heater) has substantially the same size as the frontward heater and its heater position.

As the manner of driving, the heaters are so set that they have substantially the same discharge quantity when they are independently driven (small ink drops) by the respective heaters, and that they have a doubled discharge quantity when the both are simultaneously driven (large ink drops). When in this way the discharge quantity ratio of large and small ink drops is set to be 2:1, the distance OH of each heater may be set so as to be symmetrical to the distance coming to be a flex point. This makes it easy to drive the heaters, and it is preferable to provide them in this manner.

Here, the frontward heater may be driven to discharge small ink drops and the frontward and rearward heaters may be simultaneously driven to discharge large ink drops so that small ink drops can be discharged at a higher velocity and also the large and small ink drops can be discharged in a smaller difference (or ratio) in discharge velocity. With regard to the distance OH of the frontward heater, if it is too short, the discharge velocity v increases but the refill frequency fr decreases, and also the bubbles of the frontward heater may communicate with the atmosphere (what is called the bubble-through). In such a state, the desired condition of discharge can not be obtained when the frontward heater and rearward heater are simultaneously driven. Accordingly, the distance OH of the frontward heater may be set in such a range that the bubbles do not communicate with the atmosphere and the drive frequency can be satisfied. Stated specifically, the distance OH may preferably be at least 30 $\mu$m.

The position of heater that is preferable for discharging large ink drops will be described below.

Figure 11A:
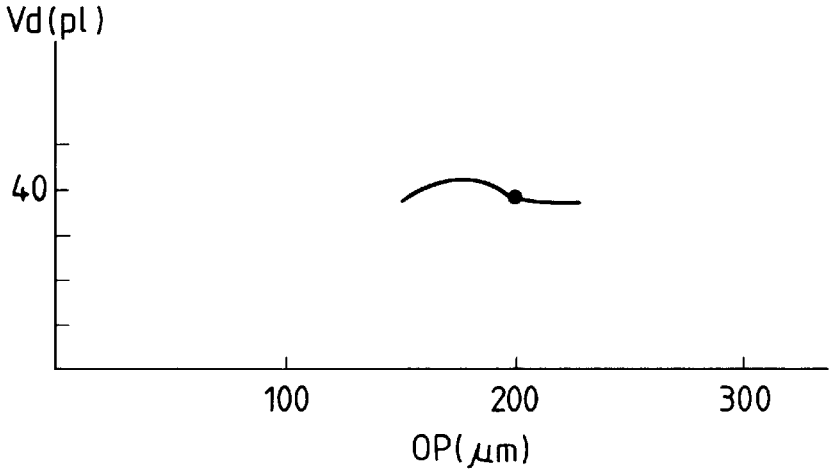
FIGS. 11A, 11B and 11C are graphs showing discharge characteristics such as discharge quantity Vd, discharge velocity v and refill frequency fr, respectively, assuming as a variable the distance OP between centers of gravity and discharge openings of two heaters.
Figure 11B:
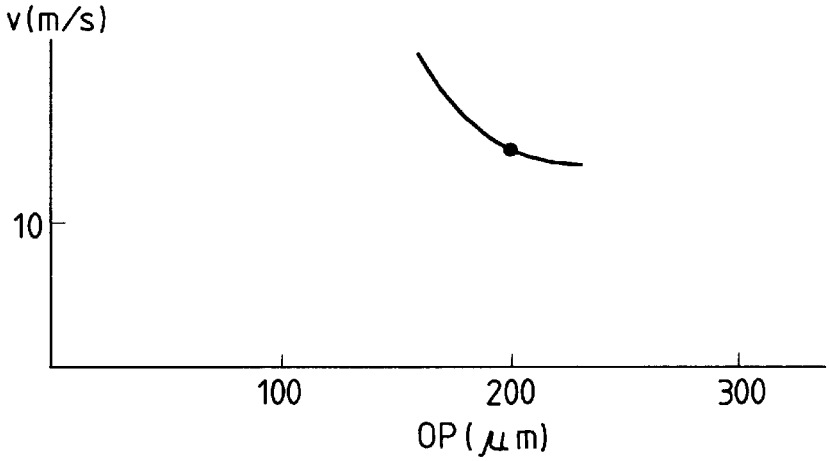
Figure 11C:
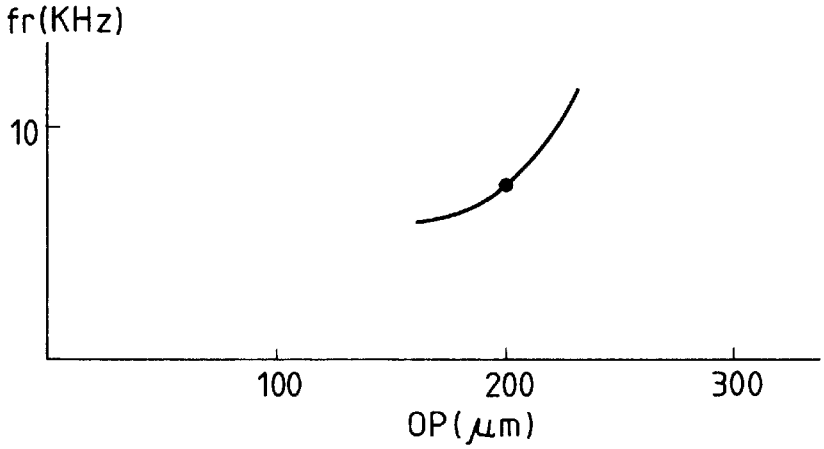

As described previously, the large ink drops are discharged when the frontward and rearward two heaters are simultaneously driven. Assuming as a variable the distance OP between the position of the center of gravity of each of the two heaters and the discharge opening thereof, the discharge characteristics such as discharge quantity Vd, discharge velocity v and refill frequency fr are as shown in FIGS. 11A to 11C, respectively. In the example shown in FIGS. 11A to 11C, the distance OH1 of the frontward heater is set stationary, and the distance OP obtained by changing the distance OH2 of the rearward heater is set as a variable.

The discharge quantity Vd in the above instance is known to be approximately equal to the sum of discharge quantities obtained when the frontward heater and the rearward heater are each driven alone, and the discharge quantity Vd reaches a maximum when the distance OP is a certain distance. In the present embodiment, the distance OP is set at a larger value than this certain distance.

As can be seen from FIGS. 11B and 11C, if the distance OP is too short, the discharge velocity v becomes too high, resulting in a great difference in the velocity of large and small ink drops and a low refill frequency fr.

Now, an instance be taken into account in which only one heater is provided in a nozzle as shown in FIG. 1B. To make an experiment, the heater provided as only one heater was made to have the shape as if the two heaters of the present embodiment are put together and was so provided that the distance OC between its center of gravity and the discharge opening comes to be OP. As a result, substantially the same discharge quantity Vd, discharge velocity v and refill frequency fr as those in the present embodiment were achieved.

As can be seen from the above experimental result, taking account of commonness to former-type conventional ink-jet recording heads, the discharge quantity Vd, discharge velocity v and refill frequency fr of ink droplets can be made approximately equal by making the OP approximately equal to the OC of a former-type product. If the distance OH1 of the frontward heater is made too small in order to improve the discharge velocity v, it becomes necessary to make the distance OH2 of the rearward heater longer. If, however, the distance OH2 is made excessively longer in order to ensure OC≅OP, there is a possibility that the bubbles produced go through the rear at which a feed system for feeding ink to the nozzle is provided. Hence, to prevent this, the OP may preferably be made smaller than OC (OP<OC).

In the case of large ink drops, the ink may be discharged in a poor stability if the distance OH is in the region B. Hence, even when the commonness to former-type products are not taken into account, the distance OC may preferably be so set that the distance OH is in the region A.

An ink-jet recording head provided with the heater based upon the setting conditions as described above was produced and its characteristics were measured. Results obtained are reported below.

Measurement 1

Figure 12:
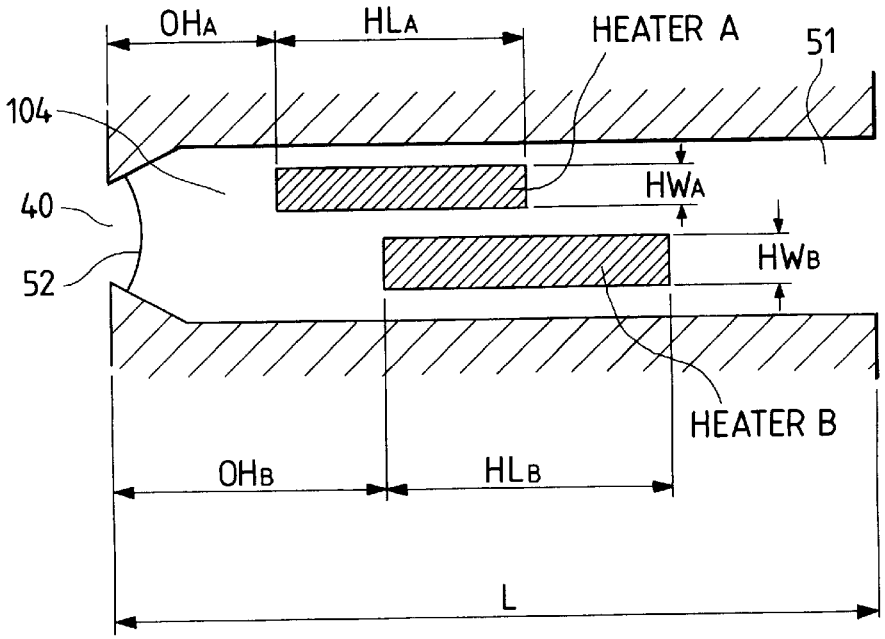
FIG. 12 illustrates the shapes of a nozzle and heaters used when the characteristics of the ink-jet recording head according to the present invention are measured.

FIG. 12 illustrates the shapes of a nozzle and heaters used to make the measurement. A nozzle 104 communicate with a liquid chamber 51. In the nozzle 104, a meniscus 52 is formed in the vicinity of an orifice by a capillary force. At least two heaters are provided in the nozzle. In the present drawing, an instance of two heaters A and B is illustrated. The nozzle has a whole length L of 400 $\mu$m. The heaters A and B are respectively connected with electrodes, and a common electrode is connected to the opposite side terminals. To the top of the respective electrodes, switching means are connected so that the heaters A and B can be selectively driven to discharge the ink held in the nozzle. The two heaters are set up to have $HW_A$=22 $\mu$m, $HL_A$=135 $\mu$m and $OH_A$=100 $\mu$m, and $HW_B$=24 $\mu$m, $HL_B$=135 $\mu$m and $OH_B$=160 $\mu$m, respectively. Small ink drops are discharged by driving the heater A only to produce bubbles and large ink drops are discharged by driving the heaters A and B simultaneously to produce bubbles, thus evaluation is made. Ink used is an ink having a surface tension of about 40.5 to 46.5 dyne/cm and a viscosity of 1.5 to 2.1 cP. The discharge opening has an opening area SO of 680 $\mu m^2$.

Table 1, which shows the results of first measurement, is a table showing the relationship between heater construction, discharge quantity and discharge velocity, and occurrence of ink mist when discharged at 6.5 kHz. As can be seen from the results shown in the table, the discharge velocity and discharge quantity Vd for small ink drops and large ink drops are sufficient for performing high-quality printing and, since the ink mist very little occurs.

TABLE 1

| | Discharge quantity Vd (ng) | Discharge velocity v (m/s) | Ink mist |
|---|---|---|---|
| Large ink drops: | 67 | 16 | little |
| Small ink drops: | 36 | 9 | little |

Measurement 2

Results of second measurement are shown in Table 2.

The heaters are set up to have $HW_A$=21 μm, $HL_A$=136 μm and $OH_A$=100 μm, and $HW_B$=19 μm, $HL_B$=137 μm and $OH_B$=140 μm. In this instance too, like the first measurement, the results sufficient for performing high-quality printing were obtained.

Namely, even if the shape or size of heaters are changed, good results are obtained so long as the difference in distance OH is kept at appropriate values.

TABLE 2

| | Discharge quantity Vd (ng) | Discharge velocity v (m/s) | Ink mist |
|---|---|---|---|
| Large ink drops: | 62 | 14 | little |
| Small ink drops: | 35 | 8.5 | little |

Measurement 3

The relationship between discharge velocity and ink mist with respect to difference in distance OH is shown in Tables 3(a) and 3(b) below. The relationship between the distance OH of heater A, the discharge velocity of small ink drops and the ink mist is shown in Table 3(a). The relationship between the difference in distance OH of two heaters, the discharge velocity of large ink drops and the ink mist is shown in Table 3(b). In this measurement, like Measurement 1, the heaters have size of $HW_A$=22 μm and $HL_A$=135 μm, and $HW_B$=24 μm and $HL_B$=135 μm.

As shown in Table 3(a), the discharge velocity of small ink drops gradually becomes slow when the distance OH of the heater A exceeds 120 μm, and no high-grade printing can be expected. Also, the ink mist greatly occurs when it is 70 μm or lower. This is presumably because the refill frequency fr becomes poor and the discharge becomes unstable.

Table 3(b) shows the discharge velocity of large ink drops with respect to the distance OH of heater B, setting the distance OH of heater A to 100 μm. At distance OH of 110 μm or smaller, ink mist occurs when large ink drops are discharged, and the direction of discharge curves to cause a lowering of ink droplets shot precision. At distance OH of 200 μm or larger, the ink is not discharged occasionally.

Accordingly, in order to increase the discharge velocity of small ink drops, prevent ink mist from occurring when large ink drops are discharged and achieve stable discharge, the distance OH of the heater for discharging small ink drops may be set at 80 to 130 μm and the difference in distance OH between the two heaters may be set at 10 to 80 μm. In order to achieve a recording grade with much higher image quality, the difference in distance OH between them may be set at 20 to 60 μm.

TABLE 3(a)

| $OH_A$ | | | | | | |
|---|---|---|---|---|---|---|
| (μm) | 70 | 80 | 100 | 120 | 130 | 140 |
| Small ink drops, discharge velocity: (m/s) | 16 | 13 | 11 | 9 | 8 | 7 |
| Small ink drops, ink mist | | | | little | | |

TABLE 3(b)

| $OH_B$ | | | | | | | | |
|---|---|---|---|---|---|---|---|---|
| (μm) | 100 | 105 | 110 | 120 | 140 | 160 | 180 | 200 |
| $OH_B$—$OH_A$ | | | | | | | | |
| (μm) | 0 | 5 | 10 | 20 | 40 | 60 | 80 | 100 |
| Large ink drops discharge velocity: (m/s) | 19 | 18 | 17 | 16 | 15 | 14 | 14 | 13 |
| Large ink drops ink mist | much | medium | | | | little | | |

Measurement 4

Next, discharge characteristics were measured when the distance OH of the rearward heater was set stationary at 170 μm and the position of the frontward heater was changed. Measurement was made on samples having different discharge opening areas SO and frontward heater and rearward heater areas SH.

Figure 13A:
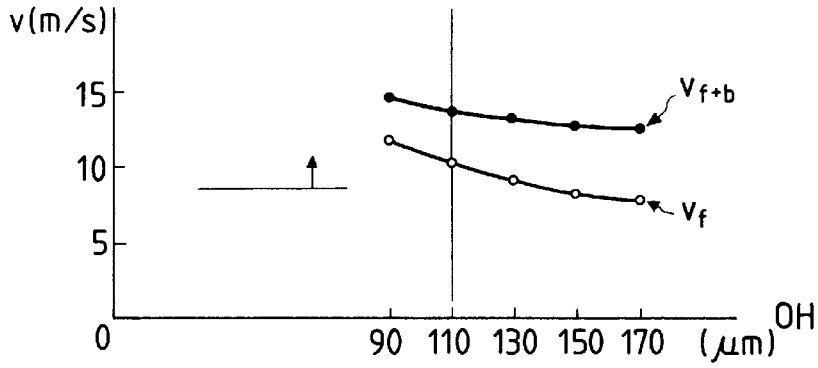
Figure 13B:
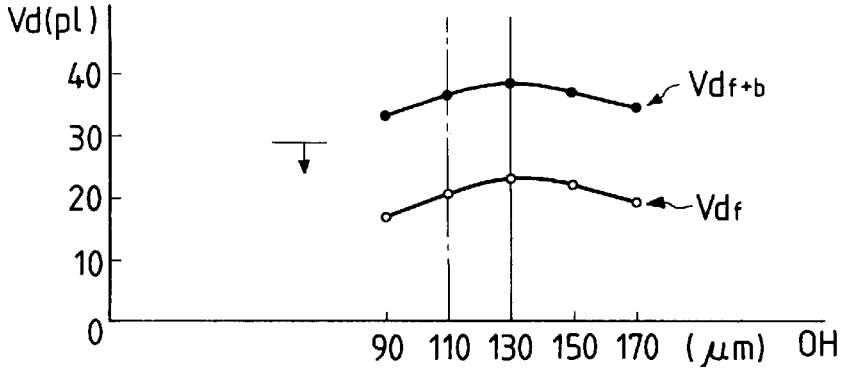
Figure 13C:
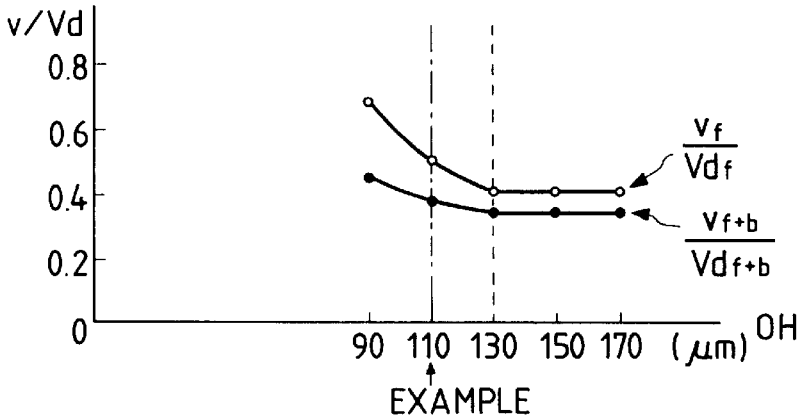
Figure 13D:
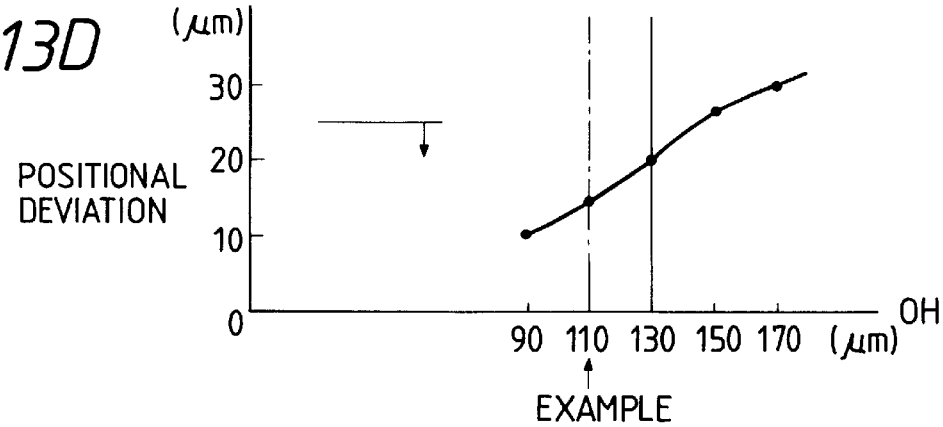
Figure 14A:
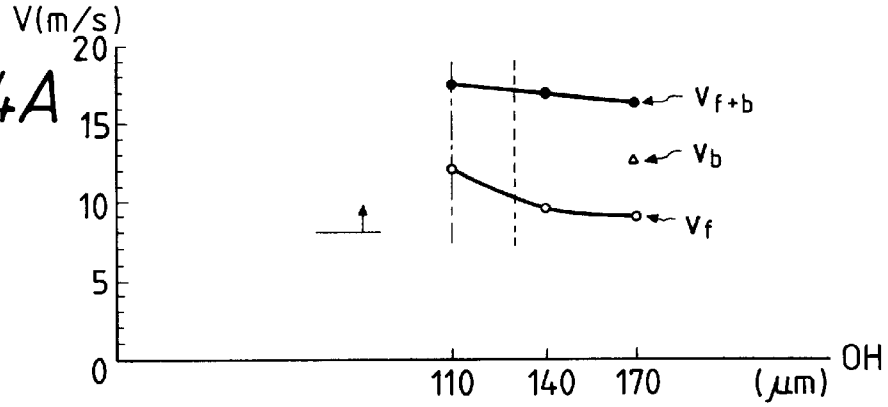
Figure 14B:
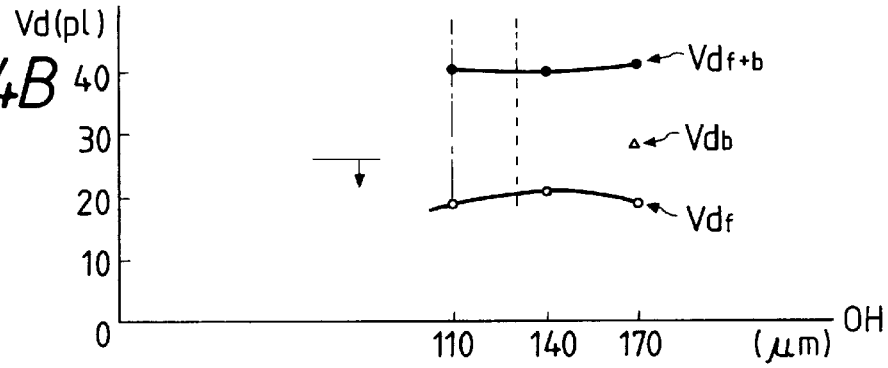
Figure 14C:
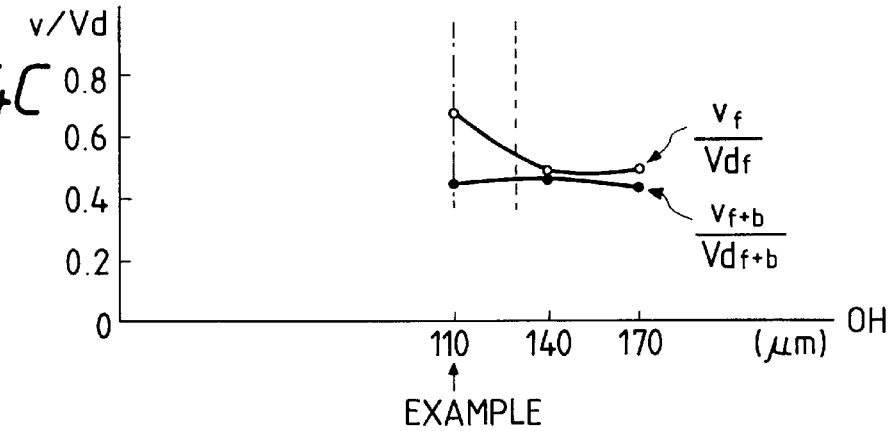
Figure 14D:
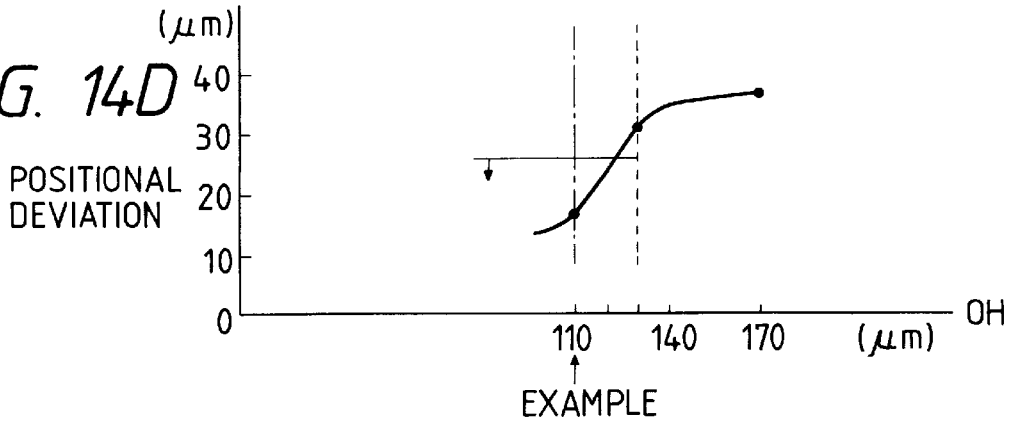

Results obtained are shown in Tables 4 and 5, and their graphic representations are shown in FIGS. 13A to 13D and FIGS. 14A to 14D, respectively. In FIGS. 13A to 13D and FIGS. 14A to 14D, FIGS. 13A and 14A concern the discharge velocity v, FIGS. 13B and 14B the discharge quantity Vd, and FIGS. 13C and 14C the value given by dividing discharge velocity v by discharge quantity Vd. These show both an instance where only the frontward heater is used and an instance where the frontward heater and the rearward heater are simultaneously used. FIGS. 13D and 14D shows the amount of positional deviation in each instance.

In the measurement whose results are shown in Table 4, samples used have discharge opening area SO of 380 $\mu m^2$, the frontward heater and rearward heater used both have area SH of 17 μm×135 μm. In the measurement whose results are shown in Table 5, samples used have discharge opening area SO of 400 $\mu m^2$, frontward heater area SH of 17 μm×115 μm and rearward heater area SH of 23 μm×115 μm. In both the measurement, ink used has a surface tension of about 26.0 to 37.0 dyne/cm and a viscosity of 1.85 to 2.60 cP to make measurement on discharge velocities vF and vF+B and discharge quantities VdF and VdF+B when small ink drops and large ink drops are discharged. The ink-jet recording head constructed as described above is mounted on a cartridge having a scanning speed of 0.7 m/s, and then mounted on a recording apparatus having a distance to recording medium, of 1 mm, where flying time and ink shot positional deviation are examined. Also, a first value given by dividing discharge velocity by discharge quantity in the discharge of small ink drops and a second value given by dividing discharge velocity by discharge quantity in the discharge of large ink drops are found, and still also a value given by dividing the first value by the second value is found.

TABLE 4

| SO: 380 $\mu m^2$ (OH of rearward heater = 170 μm, stationary) OH of frontward heater (f) (μm) | 90 | 110 | 130 | 140 | 150 | 170 |
|---|---|---|---|---|---|---|
| Discharge velocity v (m/s) | | | | | | |
| $V_f$ | 11.5 | 10.0 | 9.0 | 8.5 | 8.2 | 7.5 |
| $V_{f+b}$ | 14.5 | 13.5 | 13.0 | 12.7 | 12.5 | 12.0 |
| Discharge quantity Vd (pl) | | | | | | |
| $Vd_f$ | 17.0 | 20.0 | 22.5 | 21.5 | 20.5 | 19.0 |
| $Vd_{f+b}$ | 33.0 | 36.0 | 38.0 | 37.0 | 36.0 | 34.0 |

TABLE 4-continued

| | | | | | | |
|---|---|---|---|---|---|---|
| v/Vd | | | | | | |
| $v_f/Vd_f$ | 0.68 | 0.50 | 0.40 | 0.40 | 0.40 | 0.39 |
| $v_{f+b}/Vd_{f+b}$ | 0.44 | 0.38 | 0.34 | 0.34 | 0.35 | 0.35 |
| Flying time 1 (mm)/v (m/s) (μs) | | | | | | |
| $1/v_f$ | 87 | 100 | 111 | 118 | 122 | 133 |
| $1/v_{f+b}$ | 69 | 74 | 77 | 79 | 80 | 83 |
| Ink shot positional deviation (μm) | | | | | | |
| $0.7(1/v_f - v_{f+b})$ | 12.6 | 18.2 | 23.8 | 27.3 | 29.4 | 35.0 |
| $(v_f/Vd_f)/(v_{f+b}/Vd_{f+b})$ | 1.55 | 1.32 | 1.18 | 1.15 | 1.14 | 1.11 |

TABLE 5

| | | | | |
|---|---|---|---|---|
| SO: 400 $\mu m^2$ | | | | |
| (OH of rearward heater = 170 μm, stationary) | | | | |
| OH of frontward heater (f) (μm) | 110 | 130 | 140 | 170 |
| Discharge velocity v (m/s) | | | | |
| $V_f$ | 12.2 | 10.2 | 9.2 | 8.7 |
| $V_{f+b}$ | 17.3 | 17.0 | 17.0 | 16.0 |
| Discharge quantity Vd (pl) | | | | |
| $Vd_f$ | 18.1 | 19.8 | 20.0 | 18.1 |
| $Vd_{f+b}$ | 40.0 | 39.0 | 38.7 | 40.0 |
| v/Vd | | | | |
| $v_f/Vd_f$ | 0.67 | 0.52 | 0.46 | 0.48 |
| $v_{f+b}/Vd_{f+b}$ | 0.43 | 0.44 | 0.44 | 0.40 |
| Flying time (μs) | | | | |
| $1/v_f$ | 82 | 98 | 109 | 115 |
| $1/v_{f+b}$ | 58 | 59 | 59 | 63 |
| Ink shot positional deviation (μm) | | | | |
| $0.7(1/v_f - 1/v_{f+b})$ | 16.8 | 27.3 | 35.0 | 36.4 |
| $(v_f/Vd_f)/(v_{f+b}/Vd_{f+b})$ | 1.56 | 1.17 | 1.05 | 1.14 |

As can be seen from the above results of measurement, preferable discharge velocity, discharge quantity ratio, ink shot positional deviation and refill frequency can be attained when the first value is greater than the value given by multiplying the second value by a proportionality factor 1.15, i.e., when discharge velocity vF and vF+B and discharge quantity VdF and VdF+B satisfy the relation of:

$$(vF/VdF) \geqq (vF+B/VdF+B) \times C$$

wherein C is a constant. The constant C varies depending on physical properties of ink, and experiments made by the present inventors have revealed that C is 1.15 when an ink having a surface tension of about 26.0 to 37.0 dyne/cm and a viscosity of 1.85 to 2.60 cP is used and C is 1.0 when an ink having a surface tension of about 40.5 to 46.5 dyne/cm and a viscosity of 1.5 to 2.1 cP is used. This is presumably because the ink having a greater surface tension is brought back at a greater force when ink droplets are separated and hence more greatly affects the discharge velocity with respect to small ink drops to make the value C smaller.

A second embodiment of the present invention will be described below. This embodiment is concerned with the shape and center of gravity of heaters.

Heaters each having a stated area are necessary for obtaining a stated ink droplet volume in ink-jet recording apparatus in which heaters are driven to cause the ink present thereon to bubble to discharge ink droplets.

In order to provide nozzles in a higher density, the heater width must be made smaller. In such an instance, the heater area must be made equal in order to attain the same ink droplet volume as a heater with a large width, so that the heater length is necessarily made larger. The width must be made much smaller when a plurality of heaters are arranged in one nozzle in parallel to the direction of the line of nozzles, so that the heater length is made much larger.

Figure 15A:
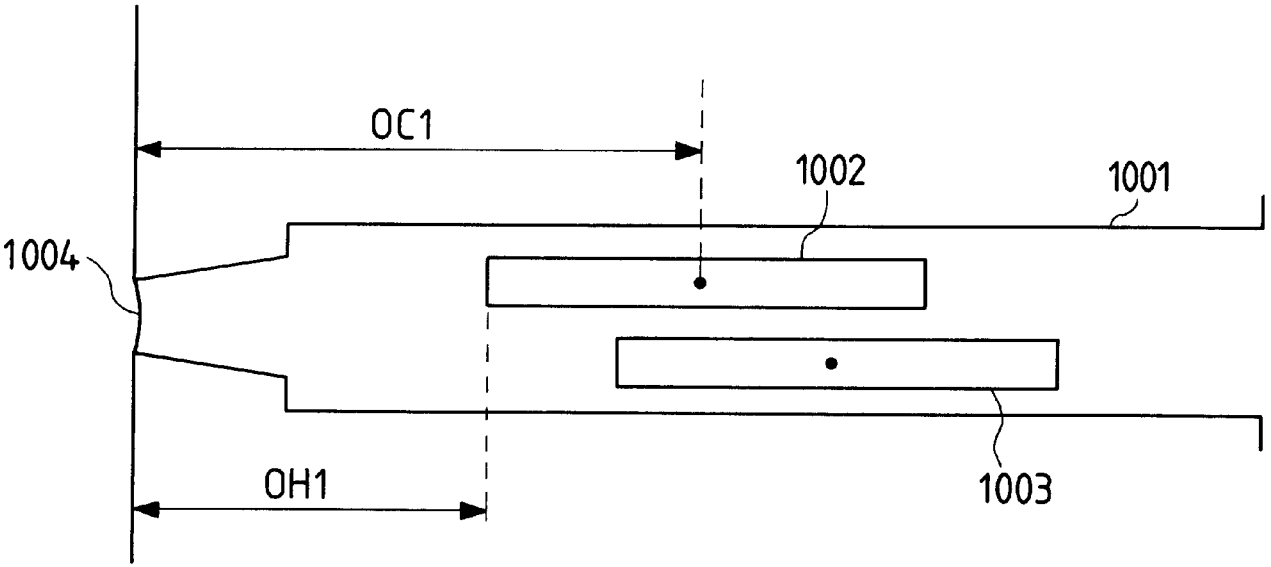
FIGS. 15A and 15B each illustrate a second embodiment of the present invention, which are plan views for showing the construction of nozzles 1001 and 1005 that discharge substantially the same ink droplets.
Figure 15B:
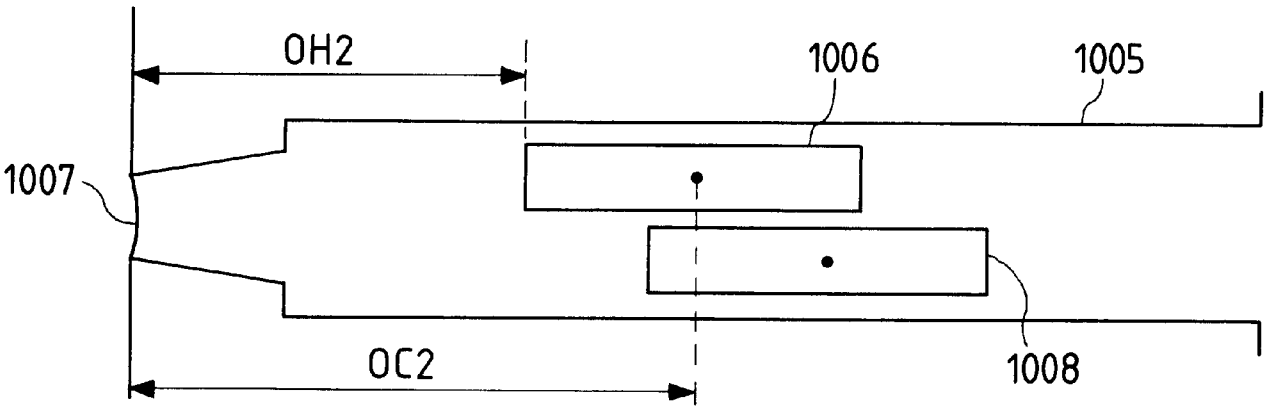

FIGS. 15A and 15B each illustrate the second embodiment of the present invention which takes account of the above characteristics, and are plan views for showing the construction of nozzles 1001 and 1005 that discharge substantially the same ink droplets. These are views used to explain that characteristics differ depending on heater shapes.

In a nozzle 1001, two heaters a frontward heater 1002 and a rearward heater 1003 are provided. In a nozzle 1005 having the same shape as the nozzle 1001, a frontward heater 1006 and a rearward heater 1008 are provided. The heater 1002 (or 1003) has a smaller width and a larger length than the heater 1006 (or 1008), but is made to have substantially an equal area, and the respective heaters are so provided that their positions of center of gravity with respect to the nozzles 1001 and 1005 are equal. Since the heaters are provided under such conditions, the distance OH1 from a discharge opening 1004 to the frontward heater 1002 in the nozzle 1001 shown in FIG. 15A is shorter than the distance OH2 from a discharge opening 1007 to the frontward heater 1006 in the nozzle 1005 shown in FIG. 15B. As the result, the end of the heater 1002 is provided in the region B, and the discharge quantity Vd is small. Also, the distance OC1 from the discharge opening 1004 serving as bubbling center to the center of gravity is the same as the distance OC2 shown in FIG. 15B concerning the heaters having larger width, and the centers of gravity of the respective heaters are positioned in the region A. Thus, these all come to be substantially equal in respect of the refill frequency fr, so that both the formation of small ink drops and the refilling of ink in a good efficiency can be achieved at the same time.

Third Embodiment

The foregoing embodiments show examples in which a plurality of thermoelectric transducers in each ink flow path are provided in the direction parallel to the ink flow path. The present embodiment show an example in which a plurality of thermoelectric transducers are provided in the direction of ink flow in the ink flow path. What is important in this embodiment is that the rearward heater has a width sufficiently larger than the frontward heater. More specifically, when constructed in this way, the frontward heater does not intercept the whole flow path of the nozzle, and the ink can be fed from the both sides (lateral positions).

Figure 37:
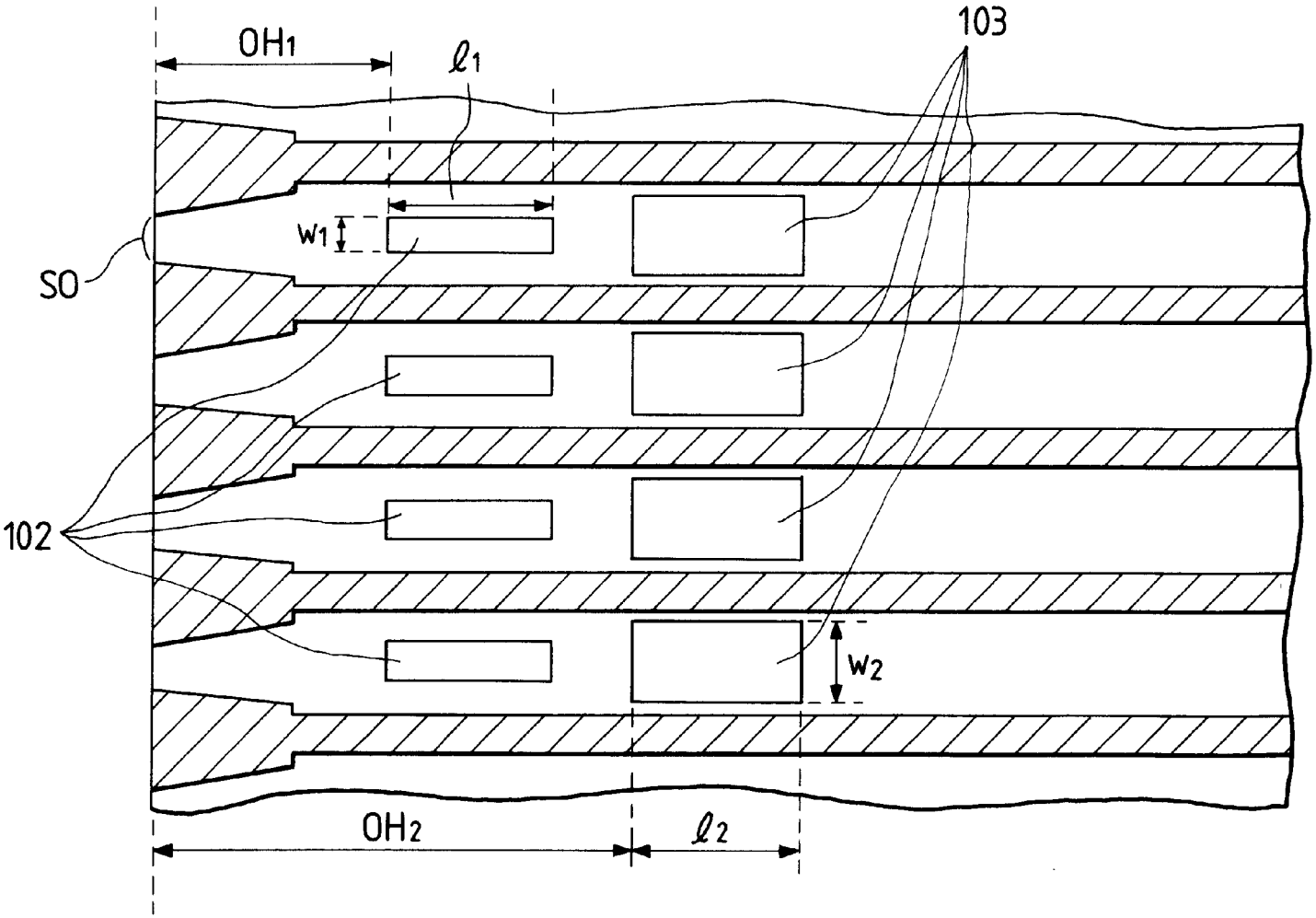
FIG. 37 illustrates a third embodiment of the present invention.

FIG. 37 illustrates the present embodiment, and shows the shape and disposition of heaters.

In the present embodiment, frontward heaters 102 and rearward heaters 103 each have the following shape and disposition.

Shape of frontward heater (W1×L1): 23×67 ($\mu m^2$)

Distance of frontward heater OH1: 92 (μm)

Shape of rearward heater (W2×L2): 50×65 ($\mu m^2$)

Distance of rearward heater OH2: 185 (μm)

In the present embodiment, the discharge velocity v and discharge quantity Vd in the case when only the frontward heater was driven and the discharge velocity v' and discharge quantity Vd' in the case when the frontward heater and rearward heater are simultaneously driven are v=10.8 (m/S), Vd=18.93 (ng), v'=20.2 (m/S) and Vd'=37.17 (ng), respectively. Thus, as can be seen therefrom, the present embodiment also satisfy v/Vd (0.571)>v'/Vd' (0.543).

In the constitution of the present embodiment, the discharge opening area SO is 310 $\mu m^2$.

Fourth Embodiment

The present embodiment shows an example in which a protective layer is provided to protect the thermoelectric transducer, which is preferable when a plurality of thermoelectric transducers are provided in the direction of ink flow in the ink flow path as in the case of the third embodiment. In the third embodiment, the frontward heater and the rearward heater are constructed to have substantially equal lengths. However, some flow path construction may make it impossible for both the heaters to have equal lengths. In such a case, the bubbling voltage of each heater may deviate. Accordingly, in the present embodiment, the layer thickness of a protective layer of the rearward heater with a larger size is made smaller than the layer thickness of a protective layer of the frontward heater with a smaller size or the layer thickness of a heat accumulation layer of the rearward heater with a larger size is made smaller than the layer thickness of a heat accumulation layer of the frontward heater with a smaller size so that any deviation of bubbling voltage can be corrected.

The present fourth embodiment will be described below in detail with reference to drawings.

Figure 23:
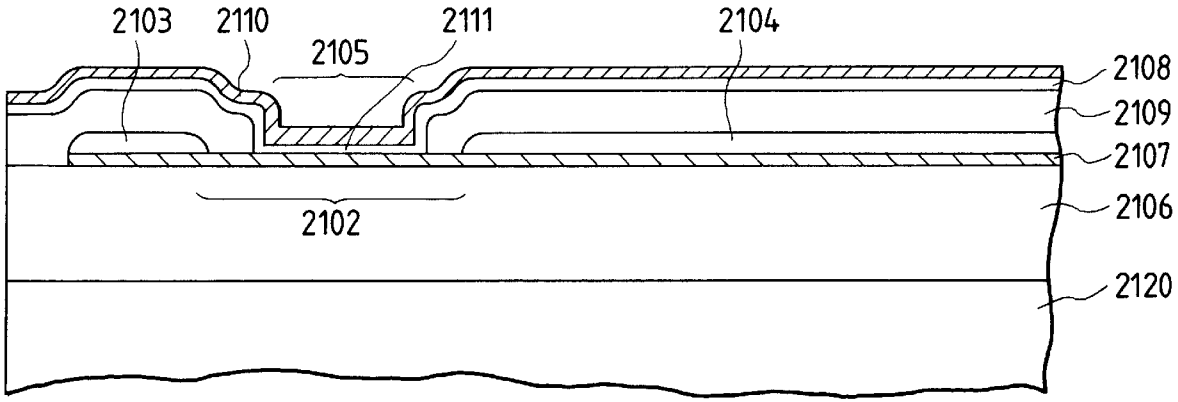
FIG. 23 is a substrate cross-sectional view of an ink-jet recording head according to a fourth embodiment of the present invention, at its portion of a frontward heater.
Figure 24:
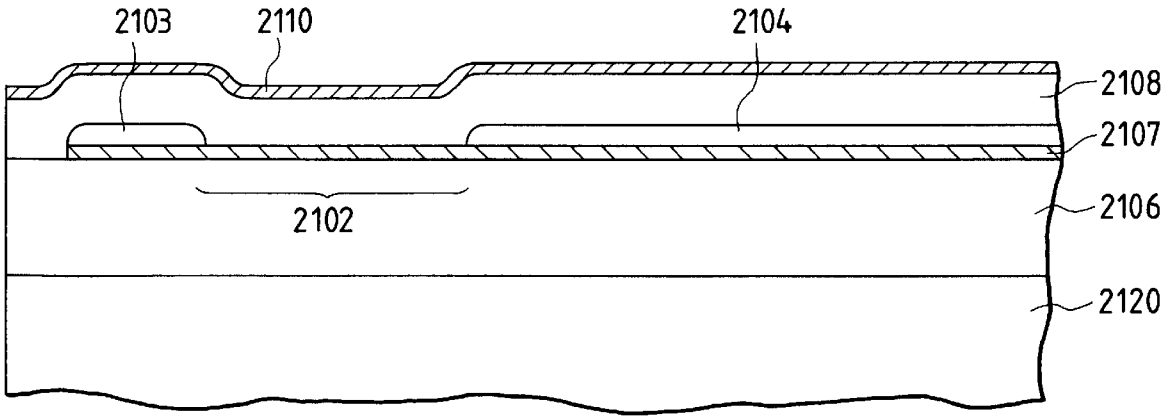
FIG. 24 is a substrate cross-sectional view of the ink-jet recording head according to the fourth embodiment of the present invention, at its portion of a rearward heater.

FIGS. 23 and 24 are cross-sectional views of ink-jet recording heads according to the present embodiment, at their substrate portions of heaters for bubbling ink. FIG. 23 is a partial cross-sectional view of a frontward heater portion cut in the direction vertical to the substrate surface. FIG. 24 is a partial cross-sectional view of a rearward heater portion cut in the direction vertical to the substrate surface.

In the production of the substrate for the heater according to the present embodiment, an Si substrate 2120 is used. In the Si substrate 2120, a driving IC may have been already built in. In the case of the Si substrate, an $SiO_2$ heat accumulation layer is previously formed beneath a resistance heater element by thermal oxidation, sputtering, CVD or the like. In the case of the IC built-in substrate too, the $SiO_2$ heat accumulation layer is formed during the process of its production. In FIGS. 23 and 24, reference numeral 2106 denotes that portion.

Next, a TaN layer 2107 is formed as the resistance heater element by reactive sputtering in a thickness of of about 1,000 Å, and Al layers 2103 and 2104 as electrode wiring are formed by sputtering in a thickness of 6,000 Å.

Next, a wiring pattern is formed by photolithography, and Al is removed by wet etching. Thereafter, a pattern is again formed and TaN is removed by reactive ion etching to form Al electrodes and a resistance heater element portion 2102. The terminal of Al wiring extending from the Al electrode serves as a pad for wire bonding in the case of the Si substrate, and, in the case of the IC built-in substrate, it is connected to the underlying electrode via a through-hole.

A PSG layer (a phosphorus glass layer, hereinafter "PSG layer") as a film that covers the Al electrode is formed by CVD in a thickness of about 7,000 Å, and photolithography is carried out to remove only the PSG layer of the resistance heater element portion with a smaller size by wet etching. Next, an SiN layer 2108 is formed by CVD in a thickness of about 3,000 Å. As the result, a protective film formed of 7,000 Å PSG and 3,000 Å SiN is formed on the Al wiring, and a protective film formed of 3,000 Å SiN is formed on the resistance heater element portion. Thus, a protective film of 10,000 Å thick in total is formed on the large-size resistance heater element portion shown in FIG. 24, and a protective film of 3,000 Å thick is formed on the small-size resistance heater element portion shown in FIG. 23.

Next, a Ta layer as a cavitation-resistant and ink-resistant film is formed by sputtering in a thickness of about 2,500 Å as denoted by reference numeral 2110 in FIGS. 23 and 24.

As a final stage, the Ta layer is patterned by photolithography to finally make pad windows for wire bonding where the PSG and SiN layers are superposed, thus the substrate for the heater of the ink-jet recording head, where the ink is bubbled, is produced.

In the substrate thus produced, the protective film at the upper part of the large resistance heater element of the large and small two resistance heater elements is thinner than the protective film at the upper part of the small resistance heater element, thus values of bubbling voltage Vth for bubbling ink at the two resistance heater elements can be put in order.

Figure 25:
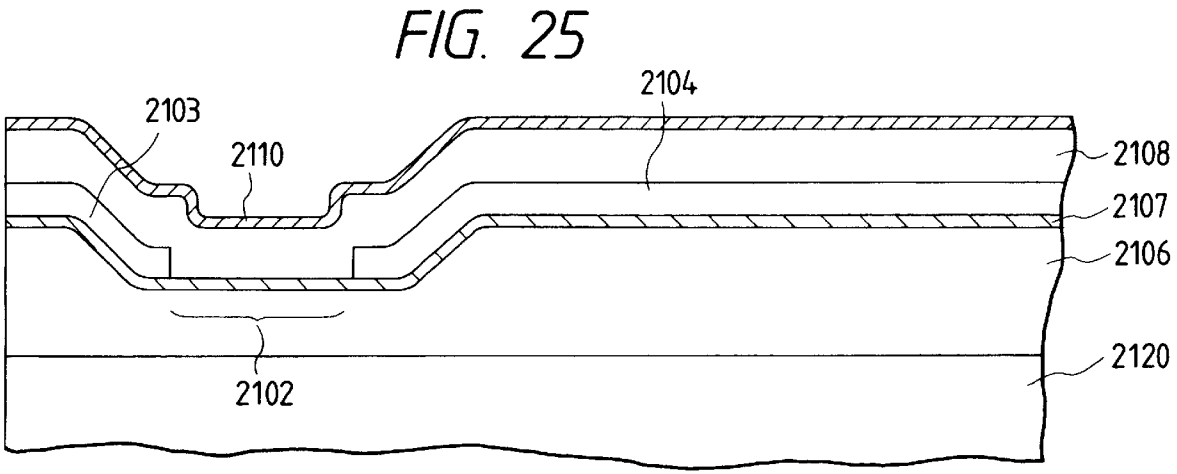
FIG. 25 is a substrate cross-sectional view of a modification of the ink-jet recording head according to the fourth embodiment of the present invention, at its portion of a frontward heater.
Figure 26:
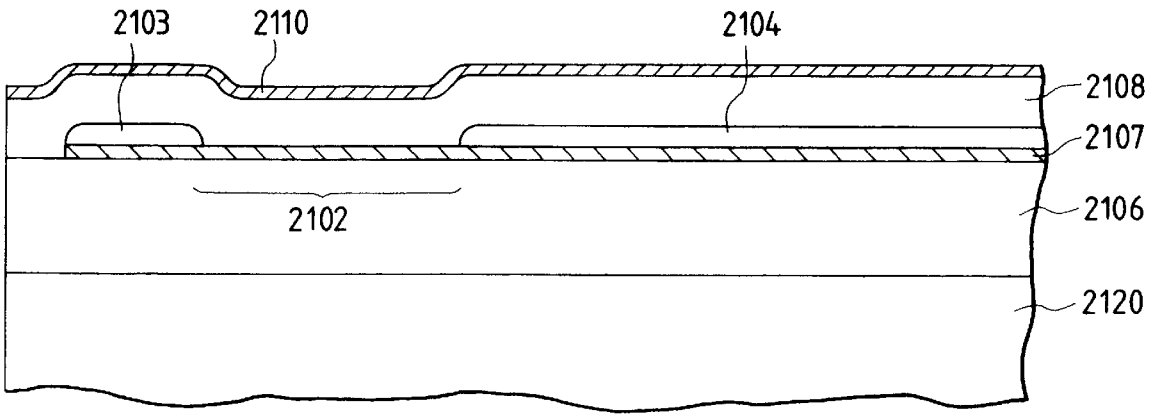
FIG. 26 is a substrate cross-sectional view of a modification of the ink-jet recording head according to the fourth embodiment of the present invention, at its portion of a rearward heater.

FIGS. 25 and 26 are cross-sectional views of ink-jet recording heads according to a modification of the present embodiment, at their substrate portions of heaters for bubbling ink. FIG. 25 is a partial cross-sectional view of a frontward heater portion cut in the direction vertical to the substrate surface. FIG. 26 is a partial cross-sectional view of a rearward heater portion cut in the direction vertical to the substrate surface.

In the production of the substrate for the heater according to a modification of the present embodiment also, an Si substrate 2120 is used. In the Si substrate 2120, a driving IC may have been already built in.

In the case of the Si substrate, an $SiO_2$ heat accumulation layer is previously formed beneath a resistance heater element by thermal oxidation, sputtering, CVD or the like. In FIGS. 25 and 26, reference numeral 2106 denotes that portion.

Next, photolithography is used to locally bore the heat accumulation layer at the part of the large-side resistance heater element by wet etching. The heat accumulation layer having been bored has, as shown in FIG. 25, a smaller thickness at the lower part of the resistance heater element portion.

Next, a TaN layer 2107 is formed as the resistance heater element by reactive sputtering in a thickness of of about 1,000 Å, and Al layers 2103 and 2104 as electrode wiring are formed by sputtering in a thickness of 6,000 Å.

Next, a wiring pattern is formed by photolithography, and Al is removed by wet etching. Thereafter, a pattern is again formed and TaN is removed by reactive ion etching to form Al electrodes and a resistance heater element portion 2102. The terminal of Al wiring extending from the Al electrode serves as a pad for wire bonding in the case of the Si substrate, and, in the case of the IC built-in substrate, it is connected to the underlying electrode via a through-hole.

Next, an SiN layer 2108 as a protective film is formed by CVD in a thickness of about 10,000 Å. Subsequently, a Ta layer 2110 as a cavitation-resistant film is formed by sputtering in a thickness of about 2,500 Å.

Then, photolithography is used to pattern the Ta layer by dry etching, and subsequently the SiN on the pad for the wire bonding is removed, thus the substrate for the heater of the ink-jet recording head, where the ink is bubbled, is produced.

In the substrate thus produced, the heat accumulation layer at the lower part of the small resistance heater element of the large and small two resistance heater elements is locally thinner than the heat accumulation layer at the lower part of the large resistance heater element, thus values of bubbling voltage Vth for bubbling ink at the two resistance heater elements can be put in order.

Recording was tested using the ink-jet recording head incorporated with the substrates processed in the present embodiment. As a result, it was possible to perform good recording in a superior gradation.

Fifth Embodiment

The present embodiment is concerned with an ink-jet recording head in which not only the frontward heater but also the rearward heater are driven alone so that it can take small and medium two values, or three values with a large value added thereto, especially taking note of the sizes and shapes of frontward and rearward heaters.

More specifically, in the construction having two or more thermoelectric transducers, a specific manner for modulating discharge quantity is commonly a method in which, in the instance where two thermoelectric transducers (hereinafter also "discharge heaters") are provided in one ink flow path and it is intended to discharge ink in respectively different quantities, the head is so designed that the ratio of sizes of the respective discharge heaters is identical to the ratio of the respective discharge quantities.

When recording heads are designed in this way and put into practical use, the precision of discharge quantity and so forth is on the level that can be satisfactory to a certain extent. However, recent demands for higher precision have not been satisfied in some cases. In order to satisfy such demands, the present inventors made experiments in which design parameters such as distance between discharge heater and discharge opening (hereinafter also "orifice") and size of orifice are changed in variety. As a result, they have recognized additional problems such that the balance is lost on parameters of discharge quantity ratios between two discharge heaters and it becomes necessary to reconsider the head design from the beginning in order to achieve the desired discharge quantity. More specifically, in some cases, since two discharge heaters are provided in one ink flow path, the designing of the ink flow path in order to attain the desired discharge quantity in a high precision for each discharge heater or in order to maintain the discharge stability of each head at a high level has failed even to satisfy practical levels, because of the presence of two discharge heaters that has entangled complex factors.

In addition to the above problems in the prior art on the designing relating to head discharge quantities and so forth, the present inventors further made studies on the following. Parameters that should be considered in the designing relating to ink flow paths for attaining the desired discharge quantity are orifice opening area, ink flow path length, the size and position of discharge heaters, and so forth. Of these, in the designing of ink flow paths in the instance where a plurality of discharge heaters are provided in one ink flow path, they took note of the orifice area and the ink flow path length, and made studies thereon. As a result, it has been found difficult to stably attain the desired discharge quantity for each drive of discharge heaters only by changing these parameters. This is presumably because other parameters also predominantly affect each discharge quantity and the changes of the above parameters cause changes of discharge characteristics at the same time.

Now, of the parameters relating to the designing of ink flow paths, the size of each discharge heater is fixed at the time when photomasks for patterning substrates are designed in the semiconductor fabrication process, and hence, to change the size for attaining the desired discharge quantity, the head must be remade from the beginning. Accordingly, the post changing of the balance of discharge quantities assigned to the respective discharge heaters results in a reasonable loss not only from the viewpoint of time but also from the viewpoint of work load. On the other hand, if only the balance of discharge quantities, i.e., the ratio of discharge quantities can be fixed, other discharge characteristics could be controlled relatively with ease. For example, the position of discharge heaters with respect to an ink flow path can be set when the substrate is cut out of a wafer, and the orifice area can be changed by controlling the energy of lasers for making orifice openings. These also make it free to change their values minutely, and can be handled in relatively later steps to less cause the loss of time and work.

The present inventors examined discharge stabilizing conditions required for a plurality of discharge heaters when specific discharge quantities are made different. As a result, with regard to the ratio of discharge quantities that is very important for designing heads, they have taken note of how the area ratio of discharge heaters (preferably the size and shape of each individual discharge heater) affects ink discharge, and have confirmed that the stated discharge quantities assigned to the respective discharge heaters can be attained in a high precision and a stable state by appropriately controlling this area ratio.

In each discharge heater, there are a heat release region utilized for actual discharge energy and a heat release region not utilized for discharge energy. This is due to temperature distribution at the time the discharge heater is driven and heat is released. More specifically, the discharge heater has a lower heat release temperature at its periphery than at its center, and hence this peripheral region stands as a non-bubbling region that does not reach the temperature high enough to heat and bubble the ink, thus the heat at that region is not utilized as discharge energy. In contrast, in the discharge heater, a bubbling region that reaches the temperature at which the ink is bubbled is herein called an effective bubbling region. Accordingly, based upon this standpoint, the desired discharge quantity can be stably attained by designing a plurality of discharge heaters according to the following methods.

In the first place, when the ratio of discharge quantities assigned to the respective discharge heaters is set at a certain value, the area of each discharge heater be designed at a ratio smaller than that ratio.

Secondly, and more preferably, with respect to the ratio of discharge quantities assigned to the respective discharge heaters to be designed, the ratio of width of the respective discharge heaters be designed so as to be equal to the ratio of widths given by respectively subtracting a length of 1 $\mu$m to 10 $\mu$m.

Thirdly, and still more preferably, the ratio of discharge quantities assigned to the respective discharge heaters be substantially in agreement with the ratio of effective bubbling region areas of the respective discharge heaters.

Fourth, the effective bubbling region areas stated in the third be in a ratio given by subtracting an area of 1 $\mu$m to 10 $\mu$m from the periphery of the area of each discharge heater.

The standpoints stated above apply to instances where the positions of area centers of the respective discharge heaters with respect to the ink flow path are substantially equal and the materials, film thickness and drive conditions of discharge heaters are substantially in agreement.

When, however, these conditions are brought into agreement, problems may arise such that the discharge performance concerning a discharge heater having a smaller discharge quantity may lower to cause faulty discharge, especially when an ink having a high viscosity is used or when the viscosity of an ink increases in an environment of low temperature. This is a problem caused by a small discharge power ascribable to the discharge heater having a smaller discharge quantity, and has been a great question in ink-jet recording heads having a plurality of discharge heaters in one ink flow path.

The present embodiment aims at providing an ink-jet recording head that can stably attain the desired discharge quantity for each discharge heater as stated above and also has solved the basic problem involved in the heads having a plurality of discharge heaters in one ink flow path, and an ink-jet recording apparatus employing such an ink-jet recording head.

The ink-jet recording head according to the present embodiment comprises an ink flow path having a discharge opening for discharging an ink and a plurality of thermoelectric transducers provided for one ink flow path, which satisfies the relation of Vd1/Vd2≦Sh1/Sh2 when the areas of two thermoelectric transducers among the plurality of thermoelectric transducers are represented by Sh1 and Sh2 (Sh1>Sh2) and the ink discharge quantities assigned to the respective two thermoelectric transducers are represented by Vd1 and Vd2, respectively; and satisfies the relation of OC1>OC2 when the distances between the respective area centers and discharge openings of the two thermoelectric transducers are represented by OC1 and OC2.

The ink-jet recording apparatus according to the present embodiment comprises an ink-jet recording head comprising an ink flow path having a discharge opening for discharging an ink and a plurality of thermoelectric transducers provided for one ink flow path; the ink being discharged onto a recording medium to make a record, wherein;

the ink-jet recording head satisfies the relation of Vd1/Vd2≦Sh1/Sh2 when the areas of two thermoelectric transducers among the plurality of thermoelectric transducers are represented by Sh1 and Sh2 (Sh1>Sh2) and the ink discharge quantities assigned to the respective two thermoelectric transducers are represented by Vd1 and Vd2, respectively; and satisfies the relation of OC1>OC2 when the distances between the respective area centers and discharge openings of the two thermoelectric transducers are represented by OC1 and OC2.

According to the above construction, when the ratios of discharge quantities and area ratios concerning the two thermoelectric transducers satisfy the relation of Vd1/Vd2≦Sh1/Sh2, the discharge quantity assigned to each thermoelectric transducer can be attained in a good efficiency in the stated ratio. Also, the distance between a thermoelectric transducer having a smaller area and the discharge opening is made relatively short, and hence the discharge power relative to ink thickening or the like can be prevented from lowering.

Figure 27:
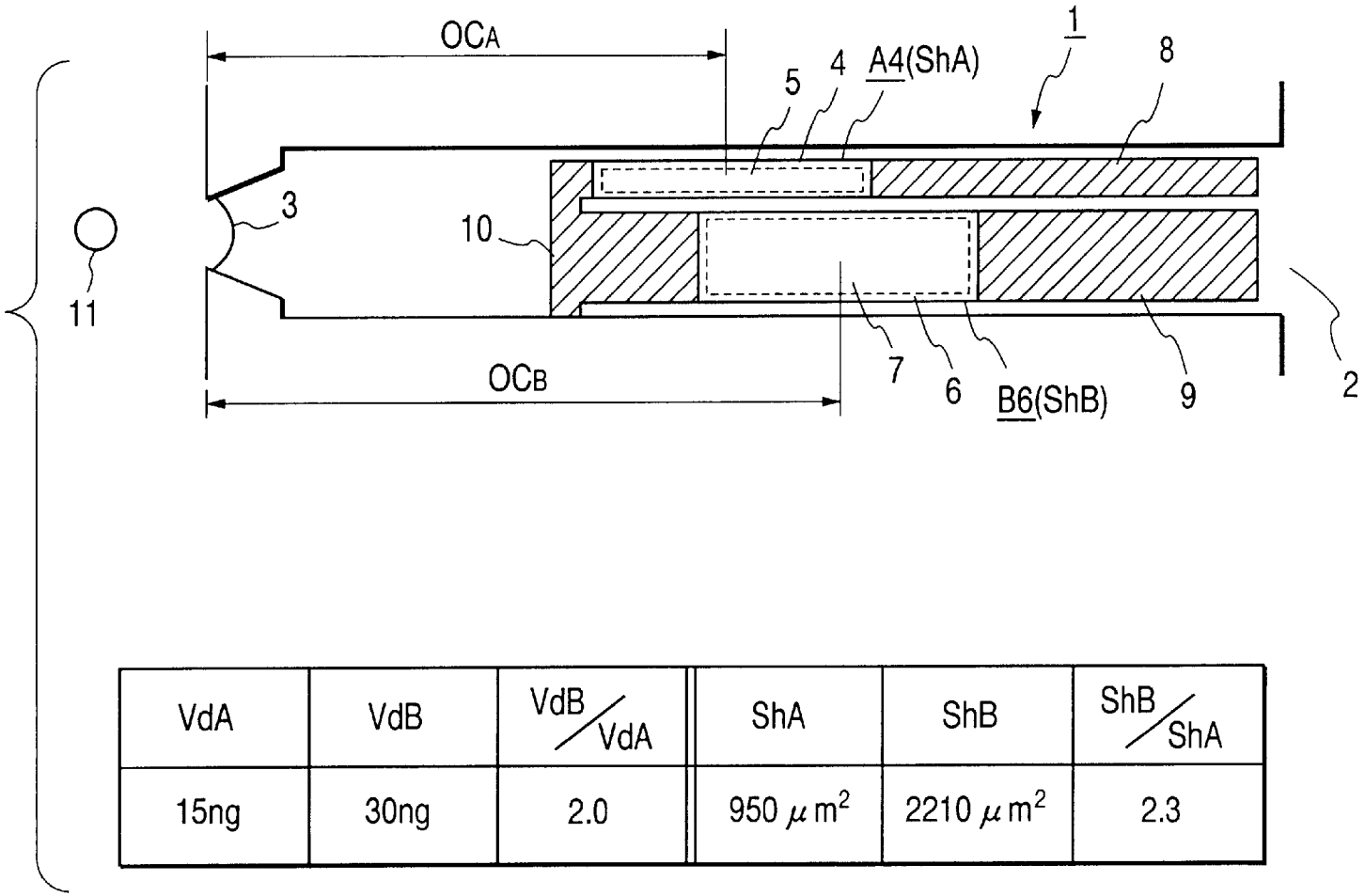
FIG. 27 illustrates the area, disposition and so forth of discharge heaters of an ink-jet recording head according to a fifth embodiment of the present invention.

FIG. 27 is a diagrammatic cross-sectional view for chiefly showing an ink flow path and thermoelectric transducers (herein also "discharge heaters") provided in the ink flow path, according to the present embodiment.

The ink-jet recording head is provided with a plurality of orifices 1A and a plurality of ink flow paths 1 (in the drawing, one orifice and one flow path of these are illustrated). Ink flow path 1 communicates with a liquid chamber 2, and ink fed from this liquid chamber 2 forms a meniscus in the vicinity of each orifice 1A by the action of capillary force.

The present invention is applied to the construction having two or more discharge heaters provided in one ink flow path. In the present embodiment, an ink flow path construction provided with two discharge heaters will be described. More specifically, two discharge heaters A4 and B6 are provided in each ink flow path 1, and their area and disposition are made different from each other. The area of the discharge heater A4 having a smaller area is represented by ShA, and the area of the discharge heater B6 having a larger area is represented by ShB. To one ends of the discharge heaters A and B, selective electrodes 8 and 9 are respectively connected, and to the other ends thereof a common electrode 10 is connected in common. To the electrodes 8 and 9, switching devices such as transistors (not shown) are respectively connected, whereby the discharge heaters A and B can be selectively driven.

Here, when the discharge quantities given by individually driving the discharge heaters A and B are represented by VdA and VdB, respectively, the VdA is 15 ng and the VdB is 30 ng. The areas ShA and ShB of the discharge heaters A and B are 950 $\mu m^2$ and 2,210 $\mu m^2$, respectively. Then, the discharge quantity ratio and area ratio concerning the two discharge heaters are VdB/VdA=2.0 and ShB/ShA=2.3, respectively, which satisfy the relation of VdB/VdA≦ShB/ShA. This relation is set up by making the small-area discharge heater A4 close to the orifice 1A side, when the areas of the discharge heaters A and B are assumed as being stationary. More specifically, since the discharge heater A4 may have a relatively small discharge power against the ink having thickened, faulty discharge may occur. In order to prevent this, the distance OCA from the area center of the discharge heater A to the orifice 1A is made smaller.

Figure 28:
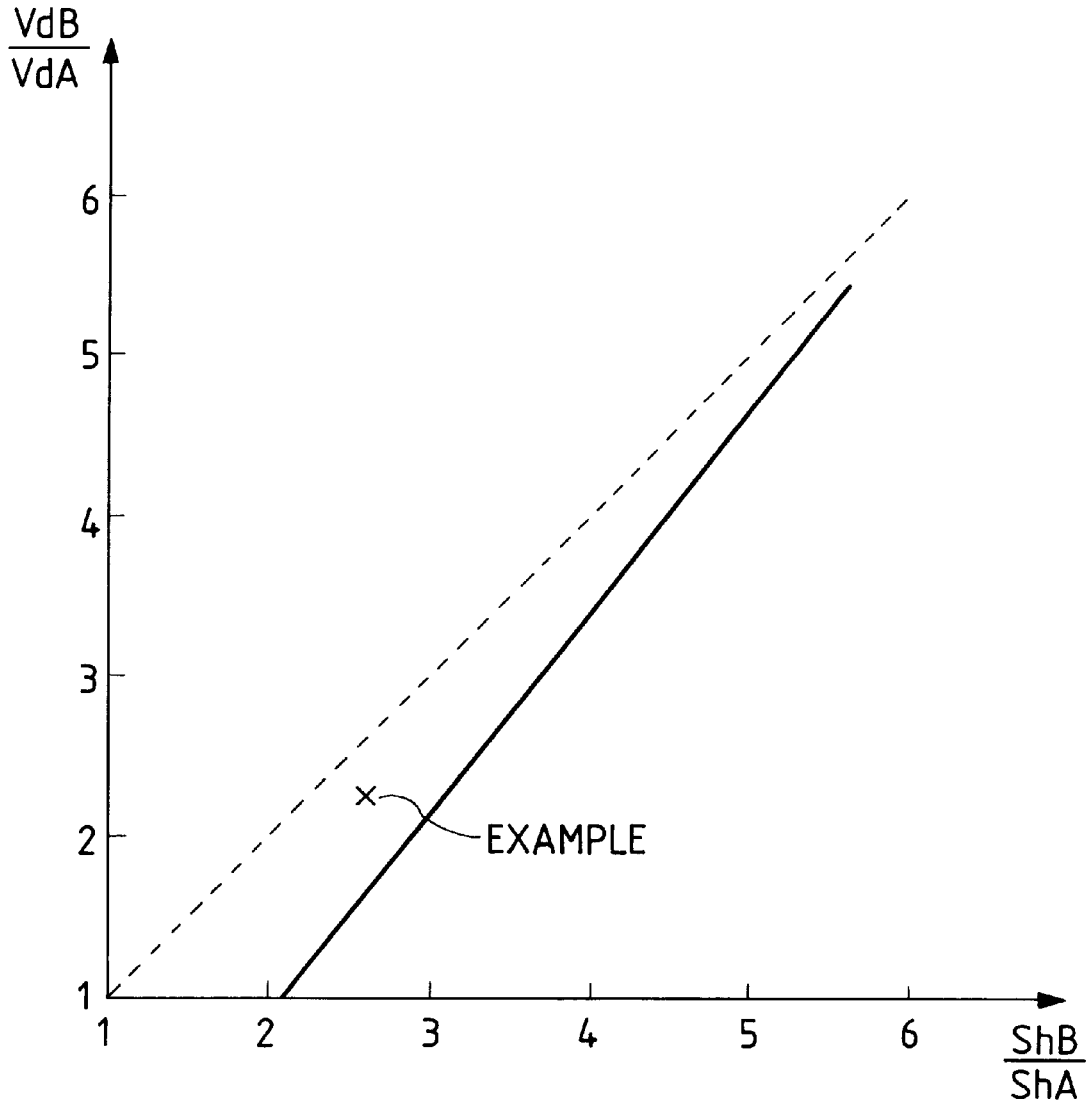
FIG. 28 is a graph showing the relationship between discharge quantity ratio and area ratio for each heater in an instance where a plurality of heaters are provided in one ink flow path.

This relation is shown in FIG. 28.

In FIG. 28, what is indicated by a dotted line satisfies the relation of VdB/VdA=ShB/ShA, and the ink flow path of the present invention is indicated as the region that embraces this dotted line and its lower side, i.e., the region that satisfies the relation of VdB/VdA≦ShB/ShA. For example, a solid line shown in FIG. 28 indicates a discharge quantity ratio given when the ratio of ShB to ShA relative to certain OCA and OCB is changed. In the case of such an ink flow path, it is within the range that fulfills the conditions of the present invention, and hence the effect of the present invention can be attained.

The surfaces of the respective discharge heaters are, as previously described, classified into effective bubbling regions (5 and 7 in FIG. 27) that can bubble the ink and non-bubbling regions (4 and 6 in FIG. 27) that do not reach the temperature high enough to bubble the ink in heat gradient. In this instance, if the area centers of the discharge heaters are at the same positions with respect to the orifice, they are under conditions where VdB/VdA>ShB/ShA is set up, whereby discharge quantities can be controlled in a high precision. More specifically, discharge quantities can be controlled in a high precision when in FIG. 28 the heaters fulfill the conditions for the region upper than the dotted line showing the relation of discharge quantity ratio=area ratio. However, in the head having the structure as shown in FIG. 27, as previously described the distance OCA from the area center of the discharge heater A to the orifice 1A is made smaller, and hence the discharge heater A have a large discharge quantity though having a small area. Thus, as conditions for controlling discharge quantity in a high precision, VdB/VdA≦ShB/ShA is set up.

In instances where the distance OCA is smaller than a certain value, the discharge quantity may inversely decrease.

In the ink flow path to which the present invention is applied, the distance OCA is outside such a region, i.e., larger than the above certain value.

In the case of the present embodiment, the ratio of discharge quantities is VdB/VdA=2.0. Since as previously stated the discharge reliability to the ink having thickened is inversely proportional to the distance between the orifice and the discharge heaters, with regard to the discharge heater A4 having a small area, the distance of the small-area heater A4 may be made shorter in the relation of OCB/OCA=2.0, thus the discharge reliability of the respective discharge heaters can be ensured alike.

As will be clear from the above, the discharge reliability is improved by giving OCB>OCA under the design conditions of VdB/VdA≦ShB/ShA.

Incidentally, as previously stated, VdB/VdA>ShB/ShA (provided that VdB>VdA) is given in the case of OCB=OCA. Hence, OCB>OCA can be set up even under the conditions of VdB/VdA>ShB/ShA (provided that VdB>VdA) if the ratio of OCB to OCA is small.

Figure 29A:
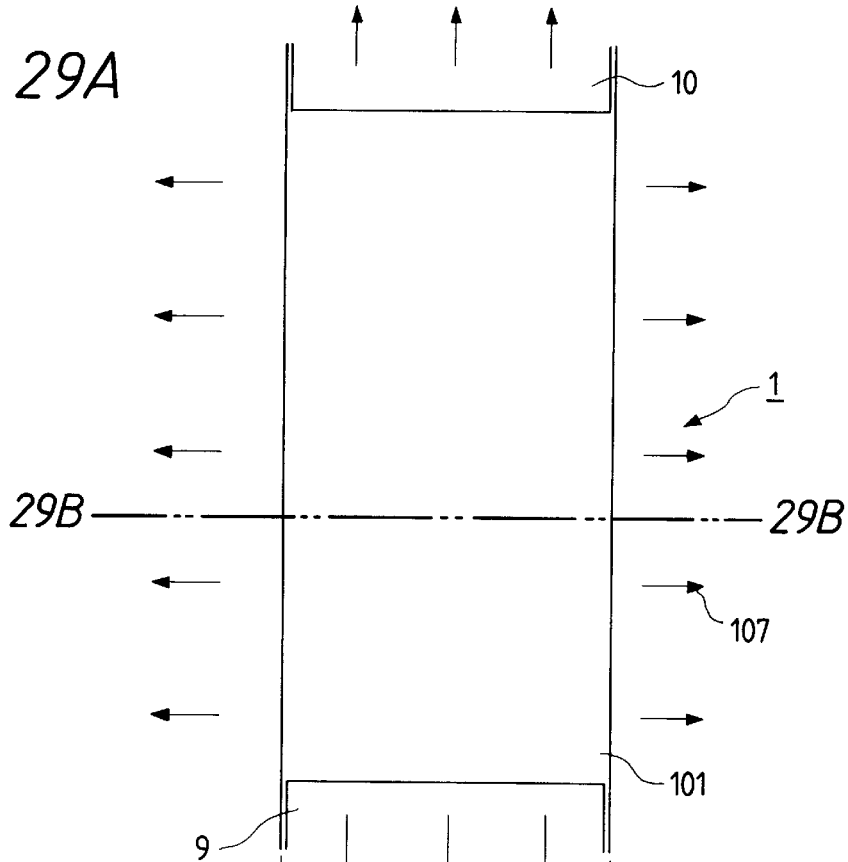
FIGS. 29A and 29B illustrate the structure of a discharge heater.
Figure 29B:
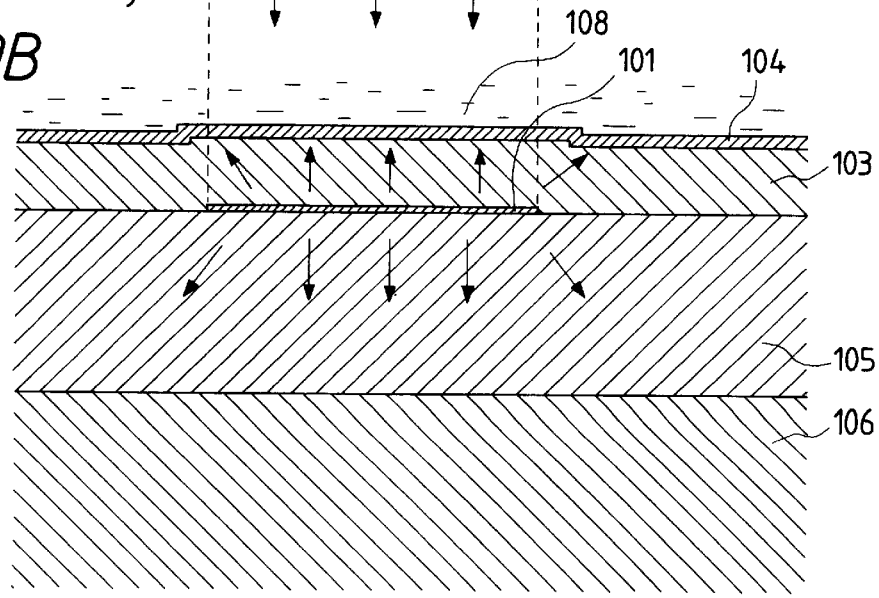

The effective bubbling region in each discharge heater will be briefly described below with reference to FIGS. 29A and 29B.

The discharge heater used in the present embodiment is constructed as described below. On a silicon substrate 106 of about 500 μm to 600 μm thick, a heat accumulation layer 105 comprised of an insulating material such as $SiO_2$ is formed, and a resistance layer 101 is formed thereon followed by patterning. On that layer, a protective layer 103 making use of an insulating material such as $SiO_2$ or SiN and a cavitation-resistant layer 104 for absorbing shock waves due to bubbling-debubbling are formed. To the resistance layer 101, a voltage is applied through electrodes 9 and 10 to produce electric currents, so that the resistance layer 101 generate heat. With such construction, the thermoelectric transducer (discharge heater) is formed. The discharge heater area referred to in the above is the area of the resistance layer 101 at its part not covered with the electrodes 9 and 10.

The heat generated in the resistance layer escapes in the direction of film overlap at the middle portion of the discharge heater 1, and also escape in the direction of film spread at the edge portion. Hence, at the surface of the discharge heater on its side coming in contact with ink, its temperature is lower at the edge portion of the discharge heater than at the middle portion thereof. The surface temperature distribution of the discharge heater in this state can be viewed on the line 29B—29B in FIG. 29A, where it stands as shown by temperature distribution in FIG. 30.

Figure 30:
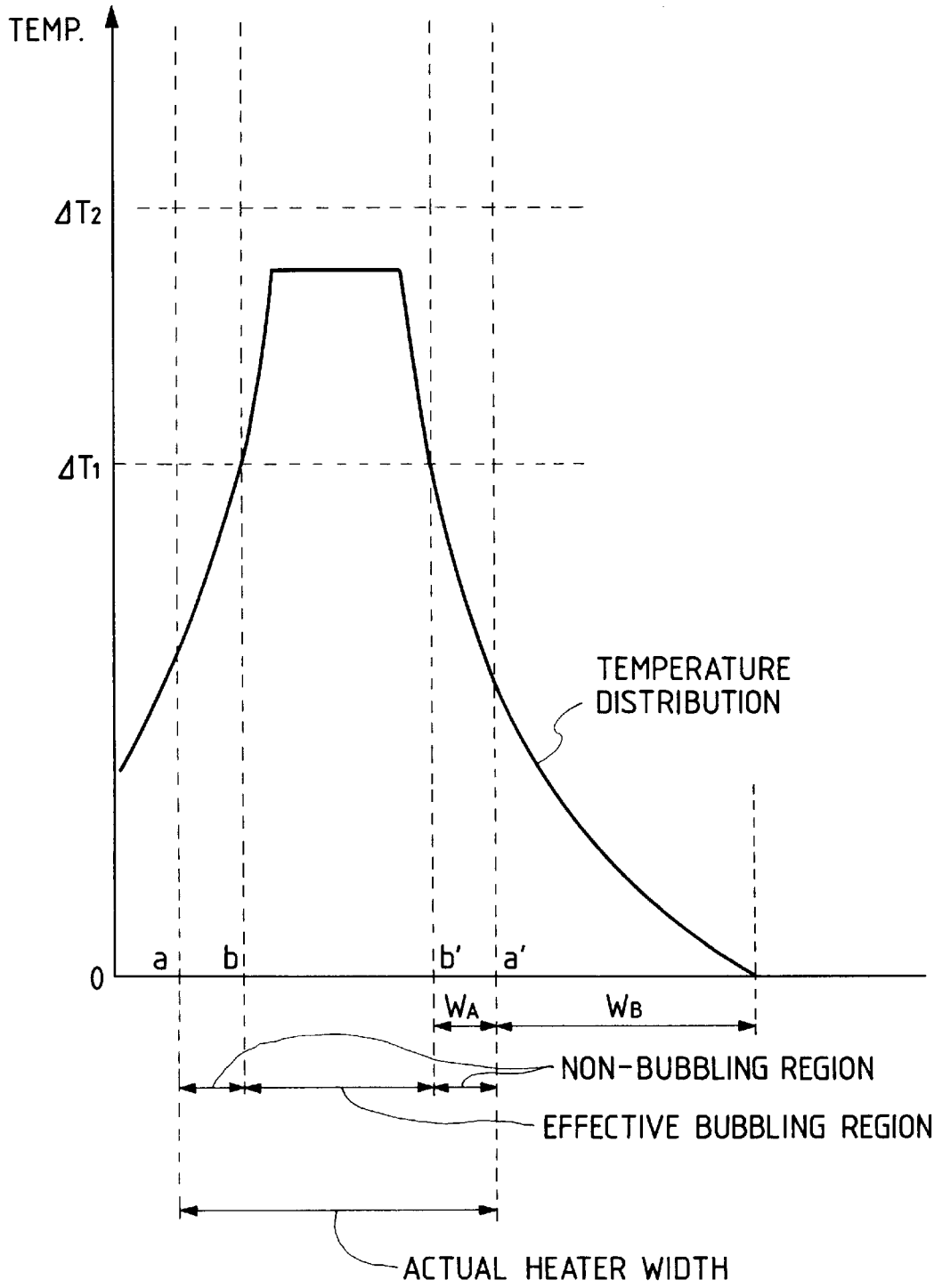
FIG. 30 illustrates an effective bubbling region and a non-bubbling region on the discharge heater.

As can be seen from these drawings, the temperature distribution is uniform at the middle portion of the discharge heater since the heat escapes in the direction of film overlap, and the temperature becomes lower as it approaches the edges since the heat escapes in the direction of film spread. In FIG. 30, ΔT1 is a minimum temperature at which the ink on the discharge heater bubbles, and ΔT2 is a temperature at which the discharge heater comes to have a too high temperature and may undergo damage such as heat stress to have an extremely short lifetime. Accordingly, when it is intended to stably control the temperature of the discharge heater to ink bubbling temperature without damaging its lifetime, it necessarily follows that the non-bubbling region that does not reach the bubbling temperature is present at the edge portion of the discharge heater as shown in FIG. 30. In the construction of the present embodiment, the non-bubbling region has a width of about 3 μm to about 5 μm, which may differ depending on the constitution and material of the film and driving conditions and must take account of a range of from about 1 μm to about 10 μm according to conditions.

In the present embodiment, the two discharge heaters partly have portions that are side by side adjacent to each other in the direction falling at right angles with the longitudinal direction of the ink flow path, i.e., the direction of ink flow. According to such construction, when the discharge heaters are simultaneously driven, the escape of heat in the direction of film overlap at the portions adjacent to each other acts on the adjacent discharge heater and is utilized as the heat of that discharge heater, so that the temperature distribution at the edge portion of the discharge heater can be prevented from lowering and consequently the effective bubbling region at that portion expands to bring about an advantage of the improvement in discharge efficiency.

Gradation control using the ink-jet recording head of the present embodiment will be described below.

Figure 31A:
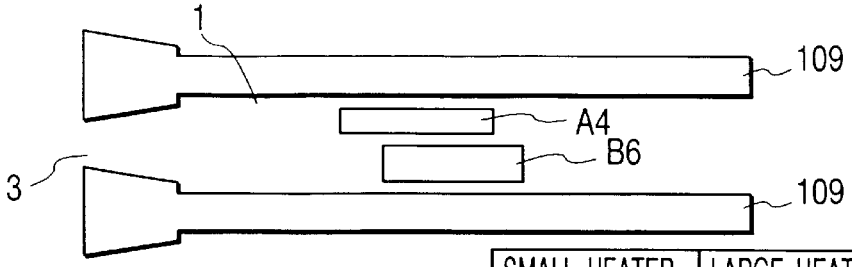
FIGS. 31A, 31B, 31C and 31D illustrate how the ink-jet recording head according to the fifth embodiment is driven.
Figure 31B:
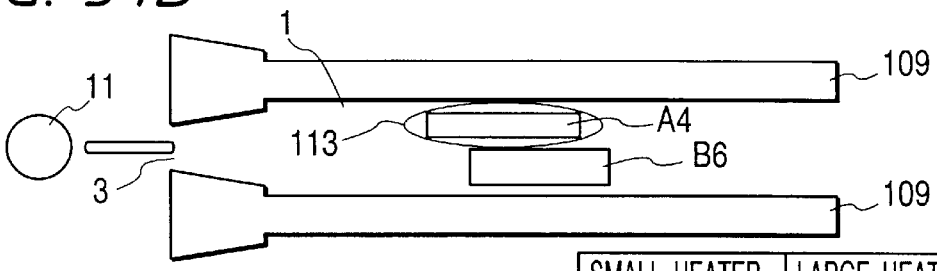
Figure 31C:
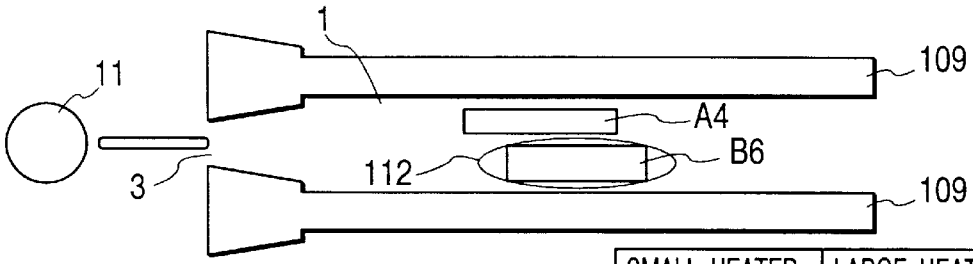
Figure 31D:
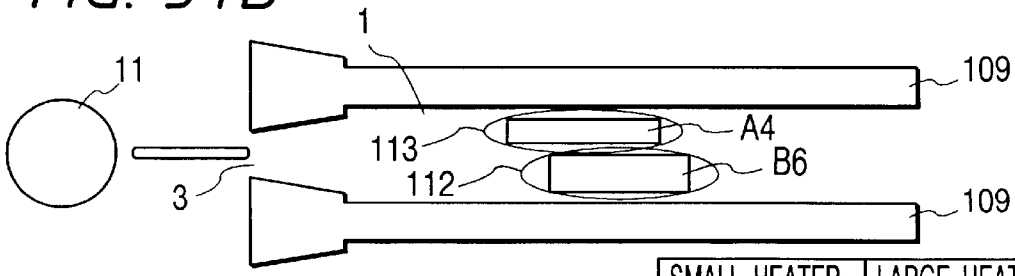

As shown in FIG. 31A, an ink flow path 1 held between ink flow path walls 109 is filled with ink. Upon driving discharge heaters A4 and B6 to heat and bubble the ink, the ink is discharged from an orifice 3 by the action of bubbling pressure. FIG. 31B shows a state in which the small-size discharge heater A4 generates heat and a small drop 11 is discharged by small bubbling 113. The discharge quantity in this case is assumed to be about 30 ng. Next, FIG. 31C shows a state in which the large-size discharge heater B6 generates heat and a large drop 11 is discharged by large bubbling 112. When the large-size discharge heater B6 is designed to have an effective bubbling area twice as large as the small-size discharge heater A4 as previously stated, it gives a discharge quantity of about 60 ng since the discharge quantity is proportional to the effective bubbling area. FIG. 31D shows a state in which both the discharge heaters are driven to heat and bubble the ink. In this case, the discharge quantity is 90 ng, which is the total of discharge quantities assigned to the respective discharge heaters.

An instance where images are formed in such discharge quantities can be represented as reflection density. Since the density is proportional to the discharge quantity of ink, three different densities can be attained according to the present embodiment. More specifically, the gradation can be expressed in quaternary using the large and small two discharge heaters. The importance of the ratio of discharge quantities previously described is also evident from this fact. Any loss of balance results in lose of the linearity of gradation control.

Figure 32:
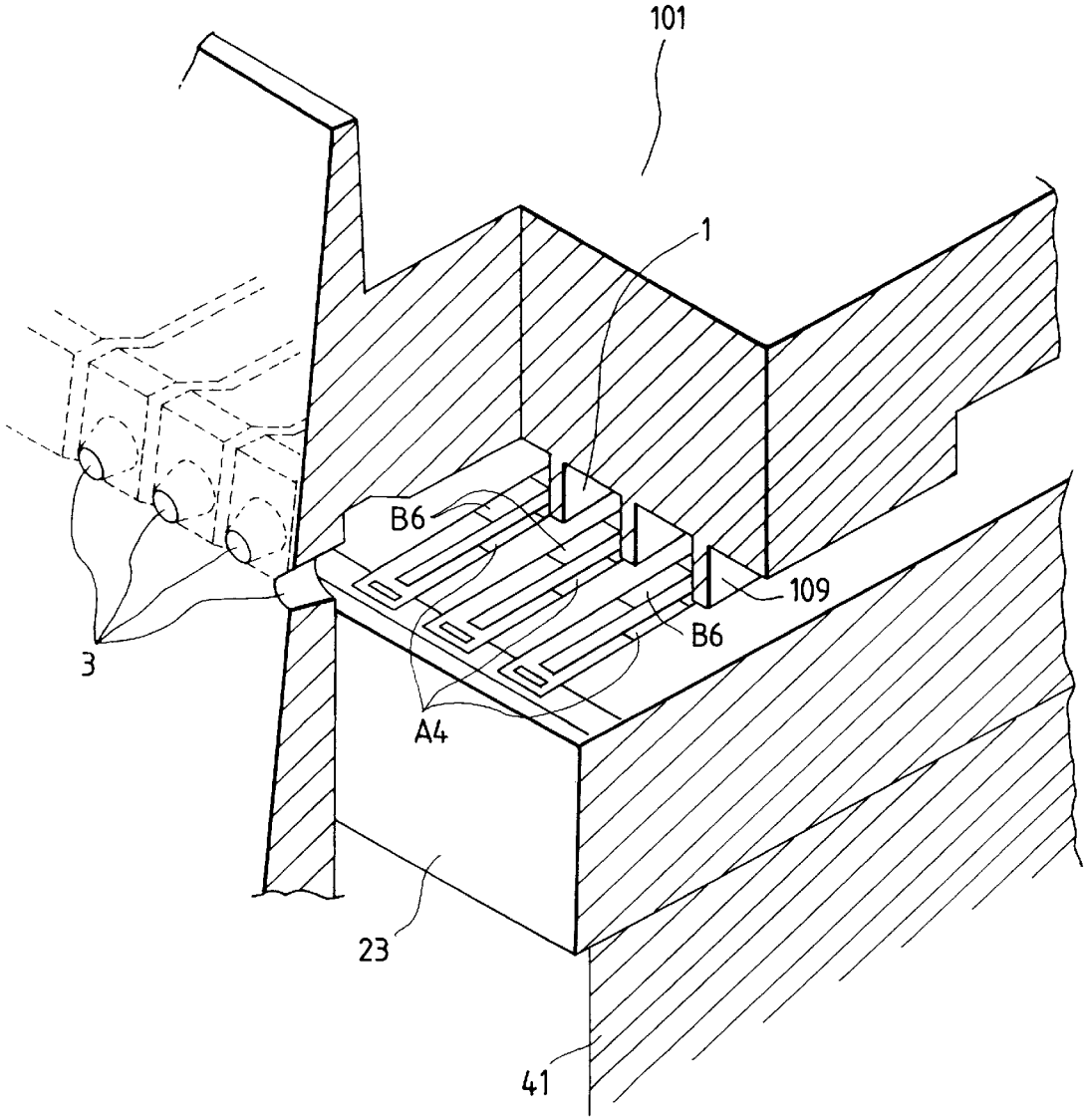
FIG. 32 is a partially broken perspective view of the ink-jet recording head having an ink flow path structure according to the fifth embodiment shown in FIG. 27.
Figure 33:
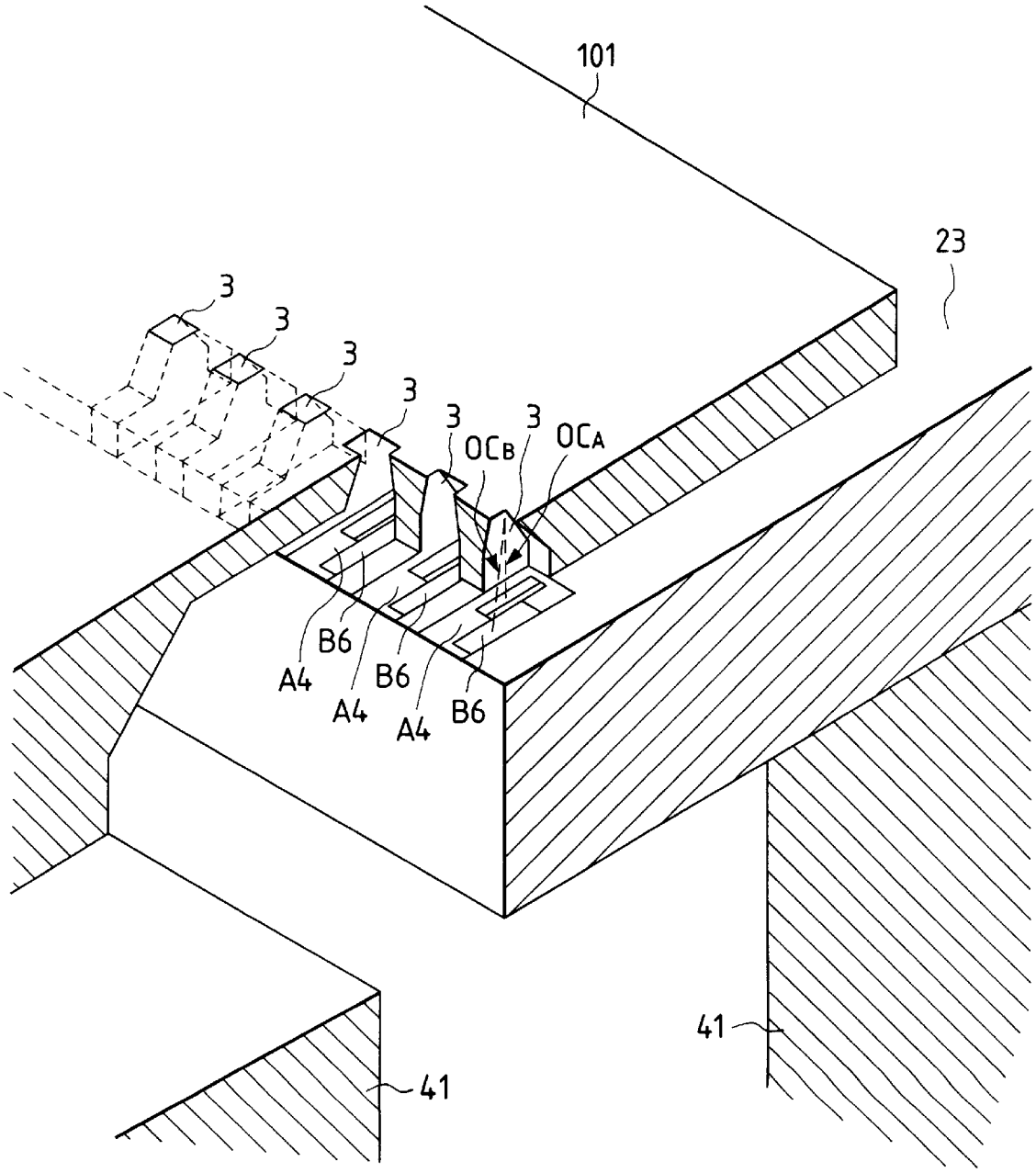
FIG. 33 is a perspective view showing another structural example of an ink-jet recording head to which the present invention is applied.

The construction of the head described above will be described below in greater detail. How ink flow paths and their surroundings are set up is shown in FIGS. 32 and 33. The both are constitutions called an edge shooter type and a side shooter type, respectively, where the ink in each ink flow path 1 is heated and bubbled by the discharge heaters A4 and B6 and the ink is discharged from orifices 3 made open sideward or upward. A substrate 23 is bonded to a base plate 41, and ink walls 109 are formed integrally with a top plate 101.

The edge shooter type head as shown in FIG. 32 is a head employing, as it is, the head having the ink flow path structure shown in FIG. 27. As for the head construction of the side shooter type as shown in FIG. 33, the positional relation of discharge heaters may affect the distance from the discharge heaters to the discharge opening in a smaller proportion from a structural point of view, but the relation of the present invention as previously described can be set up when the distance from discharge opening center to heater center is represented by the OCA or OCB (similar to FIG. 27).

(First Modification)

Figure 34:
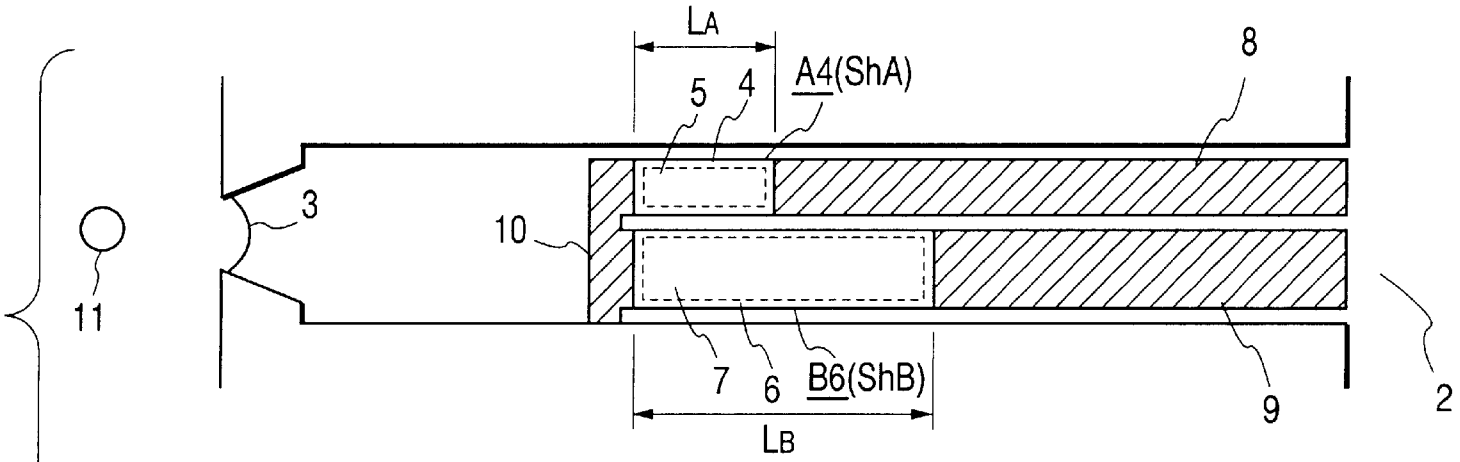
FIG. 34 illustrates the area, disposition and so forth of discharge heaters of an ink-jet recording head according to a first modification in the fifth embodiment of the present invention.

FIG. 34 is a diagrammatic cross-sectional view showing the construction inside an ink flow path according to a first modification of the present embodiment.

In this construction, VdA is 15 ng and VdB is 30 ng, where the areas ShA and ShB of thermoelectric transducers are 950 $\mu m^2$ and 2,210 $\mu m^2$, respectively. Hence, the present modified embodiment also satisfies the relation of VdB/VdA≦ShB/ShA. More specifically, since the small-size discharge heater A4 may have a relatively small discharge power as previously stated, the lengths LA and LB of discharge heaters are made to satisfy the relation of LA<LB in order to prevent faulty discharge due to ink thickening. Also, although the distances from orifice-side ends of both the discharge heaters to the orifice are made equal, the distance OCA from the area center of the small-size discharge heater A4 to the orifice is made shorter than the corresponding distance OCB of the large-size discharge heater B6, i.e., OCA<OCB (similar to FIG. 27).

(Second Modification)

Figure 35:
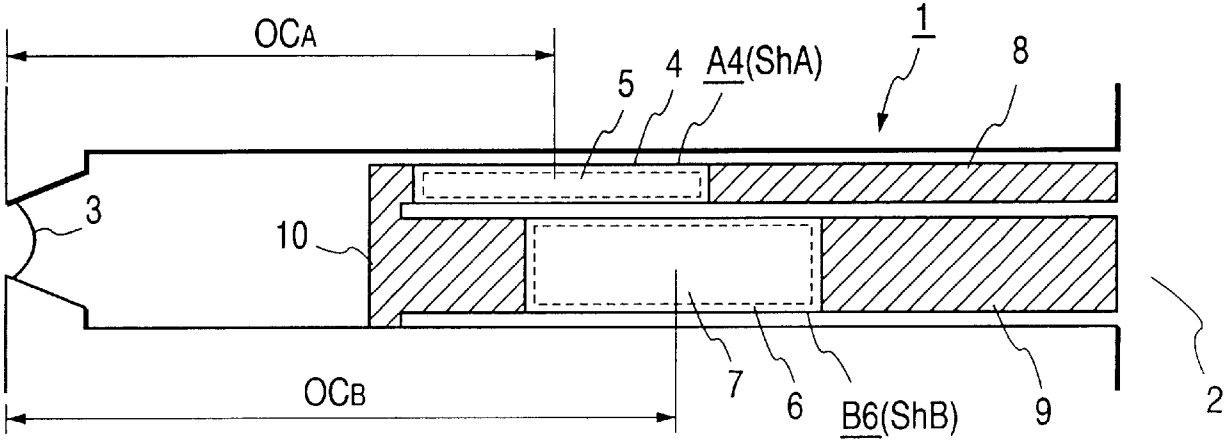
FIG. 35 illustrates the area, disposition and so forth of discharge heaters of an ink-jet recording head according to a second modification in the fifth embodiment of the present invention.

FIG. 35 illustrates a second modification of the present embodiment. In this modified embodiment, an example is shown in which the area and disposition of the respective discharge heaters are fixed on the basis of the ratio of discharge quantity VdAB given when both the discharge heaters are driven, to discharge quantity VdA assigned to the small-size discharge heater A4.

The relative disposition itself of the large and small two discharge heaters in the present modified embodiment is the same as that shown in FIG. 27. As shown in the table in FIG. 35, while the discharge quantity VdA of the small-size discharge heater A4 is 15 ng, the discharge quantity VdA+B given when the large and small both discharge heaters B6 and A4 are driven is 45 ng, and, when VdA+B/VdA is fixed at 3.0, the total area SHA+B of the large and small heaters is 3,150 $\mu m^2$. As the result, area ratio ShA+B/ShA gives 3.3. According to this relation, the respective discharge quantities can be attained in a good precision and a linear gradation can be maintained, in both the cases when the large and small heaters are individually driven and when both the heaters are simultaneously driven. Also, high-density recording can be well performed especially in a large discharge quantity mode in the driving of the both heaters.

(Third Modification)

Figure 36:
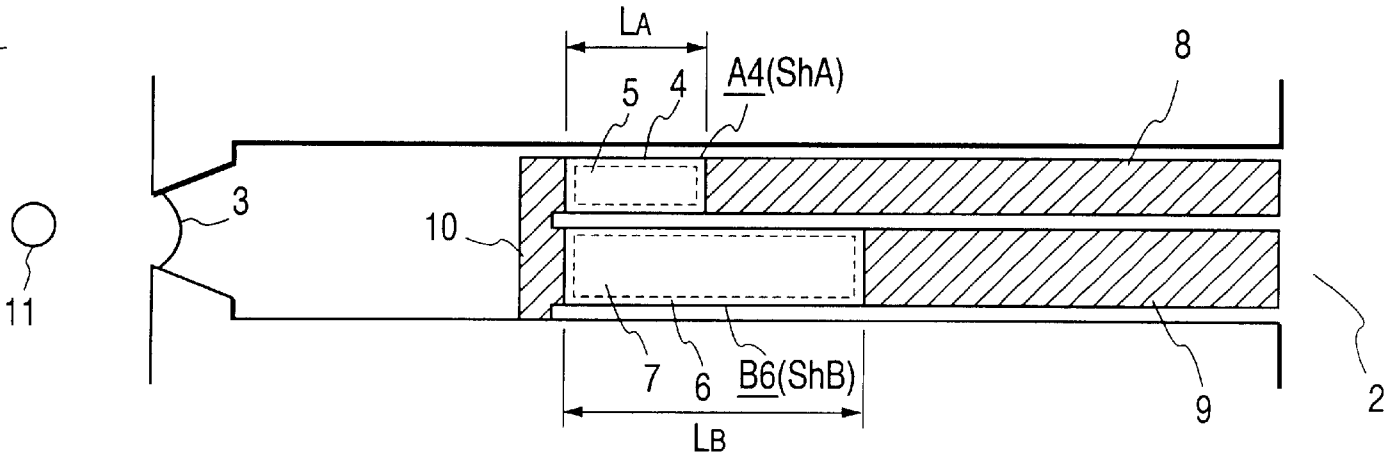
FIG. 36 illustrates the area, disposition and so forth of discharge heaters of an ink-jet recording head according to a third modification in the fifth embodiment of the present invention.

FIG. 36 illustrates an ink flow path structure according to a third modification of the present embodiment, and shows an example in which like the second modified embodiment the area and so forth of the respective discharge heaters are fixed on the basis of discharge quantities at the time the both discharge heaters are driven. The ink flow path shown in FIG. 36 has the same structure as that according to the third modified embodiment shown in FIG. 34.

In the present modified embodiment, while the discharge quantity VdA of the small-size discharge heater A4 is 15 ng, the discharge quantity VdA+B given when the large and small both discharge heaters B6 and A4 are driven is 48 ng, and, when VdA+B/VdA is fixed at 3.2, the total area ShA+B of the large and small heaters is 3,250 $\mu m^2$. As the result, area ratio ShA+B/ShA gives 3.4.

As described above, according to the present fifth embodiment, the discharge quantity ratio and area ratio concerning the two thermoelectric transducers satisfy the relation of Vd1/Vd2≦Sh1/Sh2, and hence the discharge quantities assigned to the respective thermoelectric transducers can be attained at the stated ratio and in a good precision. Also, the distance between the thermoelectric transducer having a smaller area and the discharge opening is made relatively short, and hence the relative discharge power can be prevented from lowering against ink thickening or the like.

Consequently, the desired discharge quantity can be obtained in each discharge quantity mode and, images with gradation having a good linearity can be obtained.

A sixth embodiment of the present invention will be described below.

In the present embodiment, a turning point between the region A and the regions B and C, the regions other than the region A, is specified to be 130 $\mu m$ according to what is shown in FIG. 4, and also, from the measurement results, the discharge velocities vF and vF+B and discharge quantities VdF and VdF+B are specified in accordance with the type of ink.

These parameters can be described and specified according to the following.

When an ink having a surface tension of about 26.0 to 37.0 dyne/cm and a viscosity of 1.85 to 2.60 cP is used, the following relations be satisfied.

vF≧8 (m/S)

vF+B≦16 (m/S)

VdF≦25 (pl)

35≦VdF+B≦45 (pl)

When an ink having a surface tension of about 40.5 to 46.5 dyne/cm and a viscosity of 1.5 to 2.1 cP is used, the following relations be satisfied.

vF≧7.5 (m/S)

vF+B≦16 (m/S)

VdF≦40 (pl)

65≦VdF+B≦80 (pl)

Under conditions as described above, the large ink drops and small ink drops can be well discharged.

Figure 16:
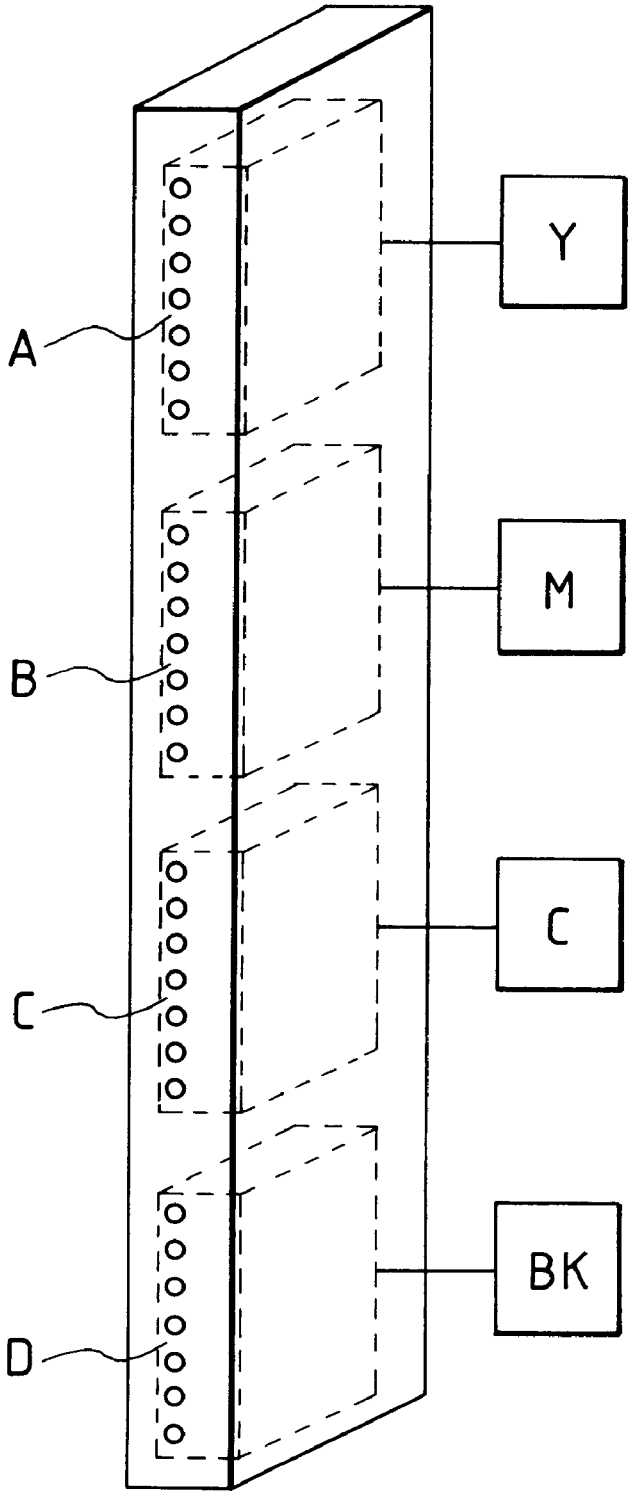
FIG. 16 is a view for showing an example of the ink-jet recording head cartridge according to the present invention.

FIG. 16 illustrates a combination of ink-jet recording head cartridges A to D making use of ink-jet recording heads having the characteristics as described above. To the ink-jet recording head cartridges A to D, Y (yellow), M (magenta), C (cyan) and Bk (black) inks are respectively fed in order to perform color recording. Here, as the ink-jet recording heads constituting the ink-jet recording head cartridges A to C, those in which the constant C in the relation of (vF/VdF)≧(vF+B/VdF+B)×C is 1.15 are used. In the ink-jet recording head cartridge D, a head in which the constant C is 1.00 is used.

Figure 17A:
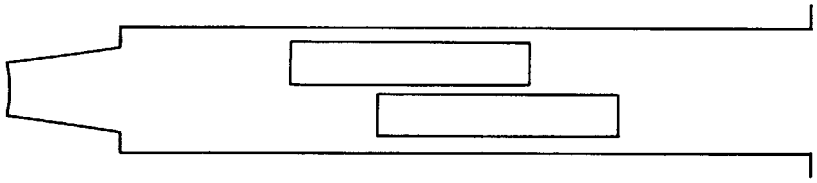
FIGS. 17A, 17B, 17C and 17D illustrate an embodiment of the present invention.
Figure 17B:
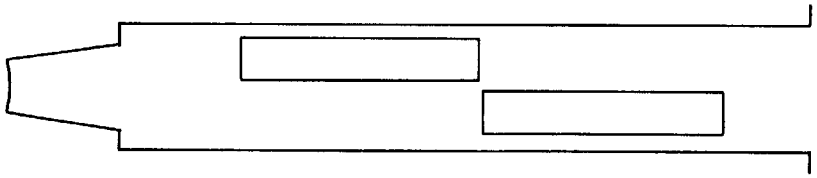
Figure 17C:
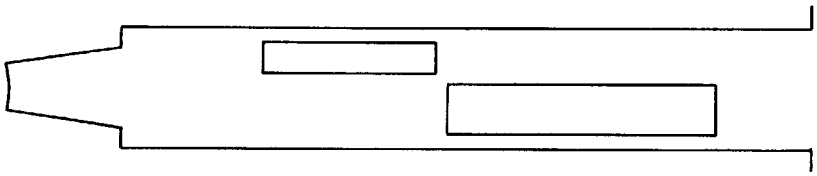
Figure 17D:
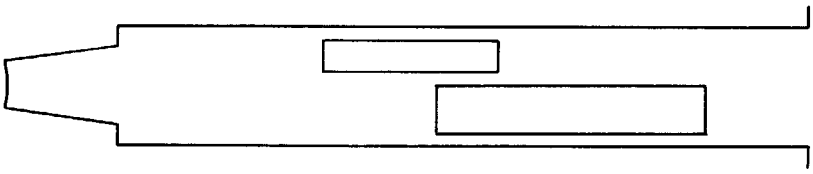

The working mode of the embodiments described above embraces all embodiments in which both heaters having the same shape are so provided that they are partly adjacent side by side as shown in FIG. 17A, heaters having the same shape are so provided that they are not adjacent side by side as shown in FIG. 17B, heaters having different shapes are so provided that they are not adjacent side by side as shown in FIG. 17C, and heaters having different shapes are so provided that they are adjacent side by side as shown in FIG. 17D.

In the embodiments described above, the ink-jet recording heads are described taking examples of those provided with two heaters in one ink flow path. The concept of the present invention can also be applied to instances where still more heaters are provided in one ink flow path. For example, in an instance where a plurality of heaters are provided side by side at one place, these may be regarded as one heater and the present invention may be applied to its center of gravity. In an instance where heaters are provided so as to have different distances OH, heaters having a front and rear relation may be regarded as one heater and the present invention may be applied to its center of gravity.

The embodiments described above may be combined so that the advantages in the respective embodiments cooperate, and the ink-jet recording head may be constructed in such a way.

Figure 18:
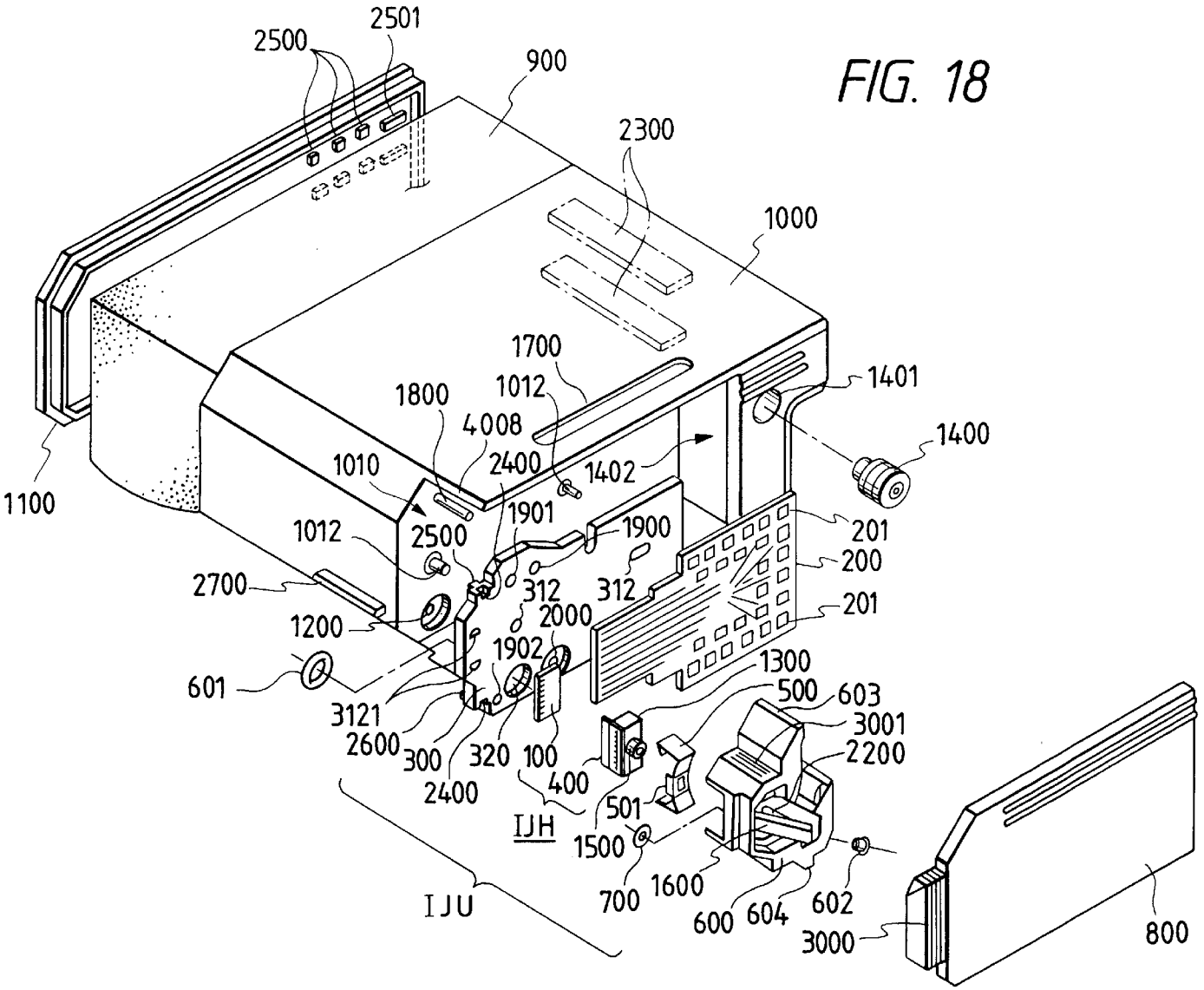
FIG. 18 is a partially exploded perspective view showing an example of the ink-jet recording head cartridge making use of an ink-jet recording head.

FIG. 18 is a partially exploded perspective view showing an example of the ink-jet recording head cartridge making use of the ink-jet recording head constructed as described above.

In FIG. 18, a recording head unit IJU is a unit of the type that a heat energy is produced in accordance with electrical signals to cause ink to undergo film boiling. A heater board 100 comprises an Si substrate and formed thereon a plurality of thermoelectric transducers (discharge heaters) for producing the heat energy, provided in lines, and electric wiring of Al or the like for feeding electric power thereto, which are formed by film-forming techniques. A wiring substrate 200 has wiring (connected, e.g., by wire bonding) corresponding to the wiring of the heater board 100, and pads 201 that are positioned at the edge of this wiring and receive electrical signals from the main body device. A top plate 1300 has partition walls for constructing ink flow paths respectively corresponding to a plurality of ink discharge openings, a common liquid chamber and so forth, and also integrally has an ink receiving opening 1500 through which the ink fed from an ink tank is received and introduced into the common liquid chamber, and an orifice plate 400 having a plurality of discharge openings. The partition plates and so forth which the top plate 1300 has are integrally molded together with the top plate 1300. As materials for such integral molding, polysulfone is preferred. Other molding resin materials may also be used.

A support 300 supports the back of the wiring substrate 200 in plane, and is formed of, e.g., a metal to serve as a structural member of the recording head unit. A presser bar spring 500 is M-shaped, and presses at the middle of the M shape the top plate 1300 at its part corresponding to the common liquid chamber and also similarly presses at its front leaf 501 the part corresponding to the ink flow paths in linear contact. The foot of the presser bar spring 500 passes through a hole 3121 of the support 300 and engages with the back side of the support 300, to thereby bring the heater board 100 and the top plate 1300 into the state that they are held between the support, thus the heater board 100 and the top plate 1300 can be fixed in pressure contact with the support by the pressing force of the presser bar spring 500 and its front leaf 501. The support 300 has two positioning holes 312 and 1900 which are respectively engageable with two positioning and heat-fusion holding protrusions 1800, and also has on the back thereof protrusions 2500 and 2600 for positioning the head cartridge to the cartridge of the main body side of the apparatus. In addition, the support 300 also has a hole 320 through which an ink feed tube 2200 (detailed later) that enables feed of ink from the ink tank can be passed. The wiring substrate is attached to the support 300 by bonding with an adhesive or the like.

Recesses 2400 and 2400 of the support 300 are provided in the vicinities of the positioning protrusions 2500 and 2600, respectively, and these recesses are, in an assembled head cartridge (shown in FIG. 19), located at extension points of a plurality of parallel grooves 3000 and 3001 respectively formed on the surrounding three sides of the recording head unit IJU in the head cartridge, and are provided so that unwanted matter such as dust and ink do not come to the protrusions 2500 and 2600. A cover member 800 in which the parallel grooves 3000 are formed forms an outer wall of the head cartridge and at the same time forms the part for holding the recording head unit IJU. An ink feed path member 600 in which the parallel grooves 3001 are formed is connected with the ink feed tube 2200 described above, thereby having an ink guide tube 1600 communicating with it, in the form of a cantilever beam the side of which being connected with the feed tube 2200 is fixed, and also having a seal pin 602 for ensuring capillarity to the ink feed tube 2200 at the portion where the ink guide tube 1600 is fixed. Reference numeral 601 denotes a packing for sealing the joint between the ink tank and the feed tube 2200; and 700, a filter provided at the tank-side end of the feed tube 2200. The ink feed path member 600 is formed by molding, and hence not only it can be formed at a low cost and in a high precision, but also, by the aid of the guide tube 1600 of a cantilever beam type, can make stable the state of pressure contact of the guide tube 1600 with the ink receiving opening 1500 of the top plate 1300 even during mass production. In the present example, a sealing adhesive is flowed in from the ink feed path member side in the state of this pressure contact.

The ink feed path member 600 can be simply fixed to the support 300 by causing back side pins (not shown) of the ink feed path member 600, which are put to the holes 1901 and 1902 of the support 300, to run through and protrude out of the holes 1901 and 1902 of the support 300, and heat-fusing the portions protruded to the back of the support 300. The heat-fused, slightly protruded regions on the back are held inside the side wall of the ink tank on its side to which the recording head unit IJU is attached, and hence the positioning face of the recording head unit IJU can be ensured.

The ink tank is constituted of a cartridge main body 1000, an ink absorber 900, and a cover 1100 for sealing the ink absorber 900 after the ink absorber 900 is inserted from the side of the cartridge main body 1000 that is opposite to the side to which the recording head unit IJU is attached. The ink absorber 900 is provided inside the cartridge main body 1000.

A feed opening 1200 is a feed opening through which ink is fed to the unit IJU comprised of the above members 100 to 600, and is also an injection opening through which ink is injected from the feed opening 1200 to impregnate the ink absorber 900 with the ink in the step prior to the step of providing the unit to the part 1010 of the cartridge main body 1000.

In the head cartridge of the present example, the portions through which the ink is injected into the ink tank are an atmosphere communicating opening 1401 and the feed opening 1200. However, in-tank air space regions respectively formed by ribs 2300 provided on the inner surface of the main body 1000 and ribs 2500 and 2501 provided on the inner surface of the cover 1100 are provided at the part continuous from the atmosphere communicating opening 1401, and also provided over the corner zone farthest from the ink feed opening 1200. With such construction, the performance of ink feed from the ink absorber can be kept in a good state. Hence, it is important for the ink to be injected through the feed opening 1200 into the ink absorber in a relatively good and uniform state. This method is very effective in practical use.

The ribs 2300 are comprised of four ribs (only upper two ribs are shown in FIG. 18) which are parallel in the direction of carriage movement, provided at the rearward of the cartridge main body 1000, and prevent the ink absorber from coming into close contact with the surface of the main body 1000. Different from the ribs 2300, the ribs 2500 and 2501, which are provided on the inner surface of the cover 1100, are in a separate state. This makes the air space greater than the former. The ribs 2500 and 2501 are in such a form that they are dispersed over an area half or less of the whole area of the cover 1100. These ribs make it possible to surely guide the ink to the feed opening 1200 side by capillary force while making more stable the ink in the ink absorber 900, present in the corner zone farthest from the ink feed opening 1200. Reference numeral 1401 denotes the atmosphere communicating opening, which is provided in a cover member so that the inside of the ink tank can communicate with the atmosphere. Reference numeral 1400 denotes a liquid-repellent member provided inward the atmosphere communicating opening 1401, by which the ink can be prevented from leaking through the atmosphere communicating opening 1401.

Ink-holding space of the ink tank has a rectangular shape and has its longer sides as the lateral surfaces, where the manner of disposition of the ribs as described above is especially effective. In an instance where it has longer sides in the direction of carriage movement or has a cubic form, the ribs may be provided on the whole of the cover 1100, whereby the ink can be stably fed from the ink absorber 900.

The recording head unit IJU is, after it has been assembled, surrounded by the ink tank and the cover 800 that covers the unit IJU having been attached to the ink tank, except its downward opening. The head cartridge is mounted on the carriage on the side of the apparatus main body, where the downward opening stands close to the carriage and hence a substantially all-side surrounded space is formed there. Hence, the heat generated from the recording head unit, IJH, present in this surrounded space uniformly disperse in this space to keep the space at a uniform temperature, and thus can be effective. However, the recording head IJH may slightly cause a temperature rise when, e.g., it is continuously driven for a long time. Accordingly, in the present example, in order to promote natural heat dissipation from the support 300, a slit 1700 having a width smaller than this space is provided at the top surface of the cartridge so that the temperature distribution in the whole unit IJU can be uniformed without dependence on environment while preventing temperature rise.

Figure 19:
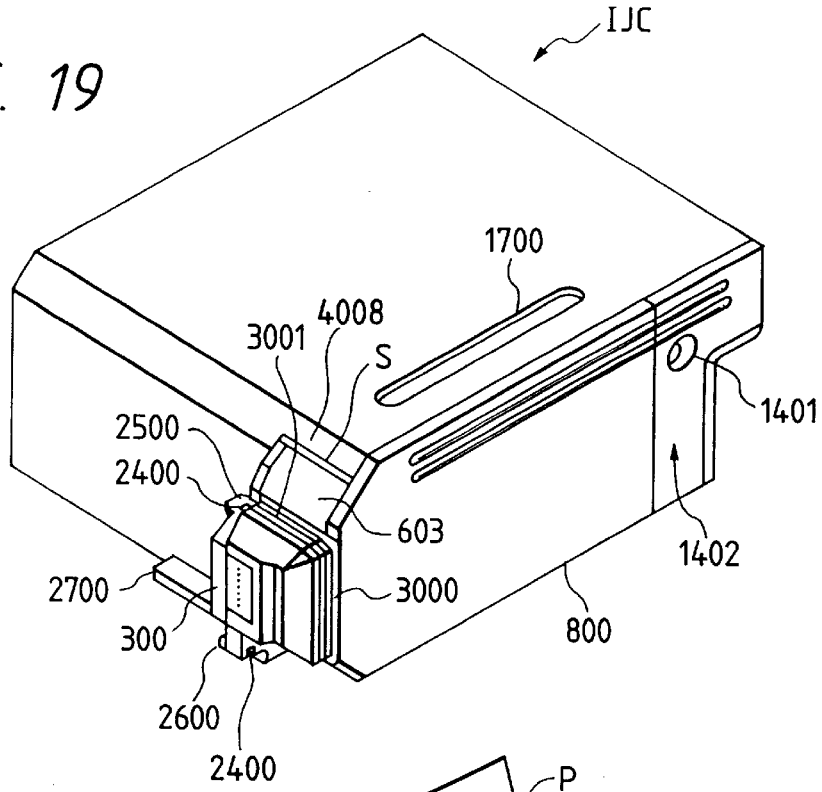
FIG. 19 is a schematic perspective view of the ink-jet recording head cartridge.

The cartridge is assembled as a head cartridge IJC as shown in FIG. 19, where the ink is led from the feed opening of the ink tank to the guide tube 1600 through the feed tube 2200 provided in such a way that it runs through an inlet provided on the inner back side of the ink feed path member 600, and, after it is passed through the inside, flowed into the common liquid chamber through an ink inlet 1500 made in the top plate 1300. At a joint for the above feed tube and guide tube, a packing made of, e.g., silicone rubber or butyl rubber is provided to thereby effect sealing, thus an ink feed path is ensured.

In the present embodiment, the top plate 1300 is integrally simultaneously shaped in a mold together with the orifice plate 400, using a resin such as polysulfone, polyether sulfone, polyphenylene oxide or polypropylene, having superior ink-resistant properties.

Figure 20:
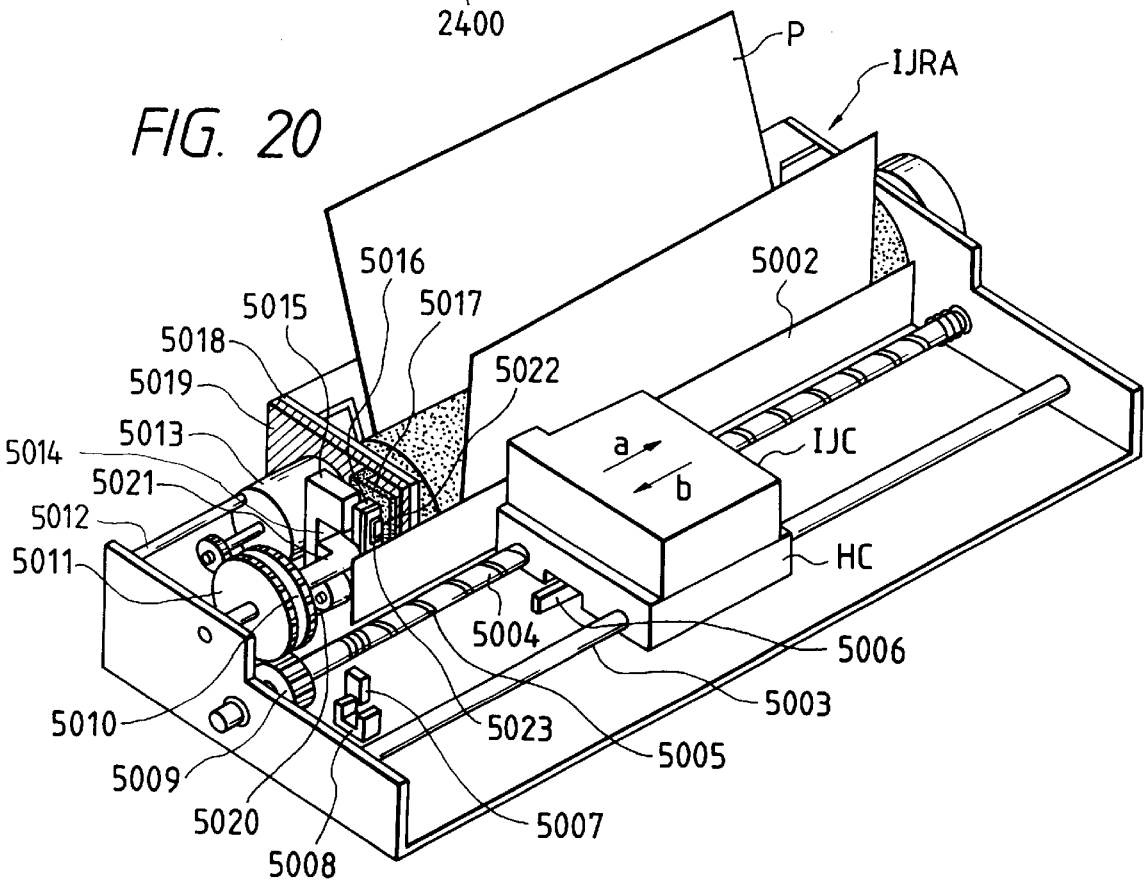
FIG. 20 is a schematic view of an ink-jet recording apparatus IJRA.

FIG. 20 is a schematic view of an ink-jet recording apparatus IJRA employing the ink-jet recording head of the present invention. The ink-jet recording head cartridge IJC integrally comprised of the recording head and the ink tank is mounted on a carriadge HC. The carriadge HC is engaged with a spiral screw 5005 of a lead screw 5004 which is rotatable interlockingly with the regular rotation and reverse rotation of a drive motor 5013 through drive power transmission gears 5011 and 5009. The carriadge HC has a pin (not shown) and is reciprocally movable in the directions of arrows a and b. On this carriadge HC, the ink-jet recording head cartridge IJC integrally comprised of the recording head and the ink tank is mounted. Reference numeral 5002 denotes a paper press plate, which presses a sheet of paper against a platen 5000 over the length in the direction of carriadge movement. Reference numerals 5007 and 5008 denote photocouplers, which are home position detecting means for making sure the presence of a lever 5006 of the carriadge in this zone to switch the rotational direction of the motor 5013. Reference numeral 5016 denotes a member that supports a cap member 5022 for capping the front face of the ink-jet recording head; and 5016, a suction means that sucks the inside of the cap and performs suction restoration of the recording head through an in-cap opening 5023. Reference numeral 5017 denotes a cleaning blade; and 5019, a member for making this blade movable frontward and rearward. These are supported on a main-body support plate 5018. Needless to say, the blade is by no means limited to this form, and any known cleaning blade can be applied to the present example. Reference numeral 5012 denotes a lever for starting the suction of suction restoration, which is movable with the movement of a cam 5020 engaged with the carriadge HC and its movement is controlled by known transmission means such as clutch switching of drive power transmitted from the drive motor.

These capping, cleaning and suction restoration are so designed that they are performed as desired at their corresponding positions by the action of the lead screw 5005 when the carriadge HC is restored to the zone on the home position side. So long as the desired motion can be made at known timing, any of them can be applied in the present example.

In the foregoing, the ink-jet recording apparatus employing the cartridge type recording head of an ink tank integral type has been described. An ink-jet recording apparatus of such a type that ink is fed from an ink tank to the recording head through a very slender tube is also embraced in the present invention.

Figure 21:
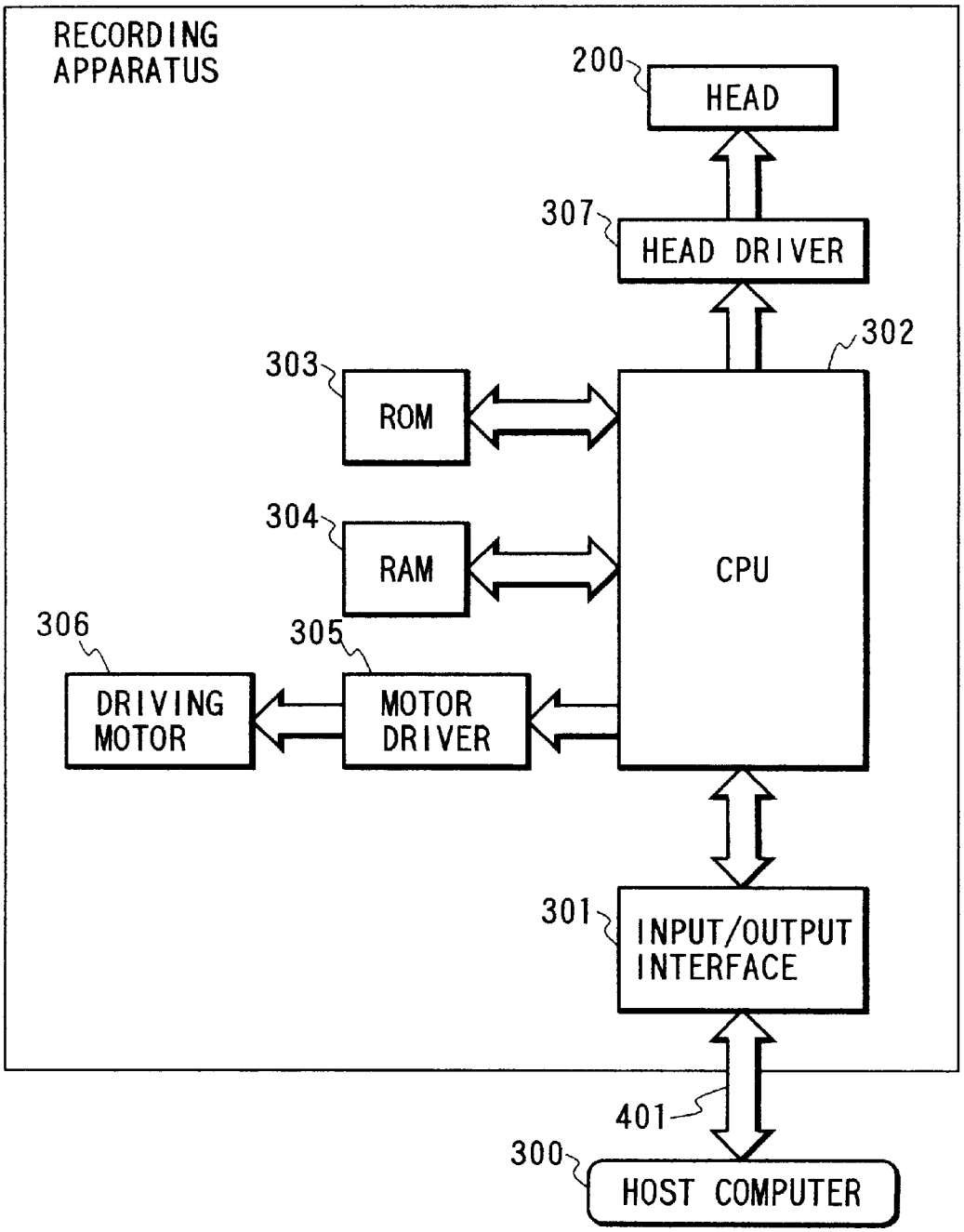
FIG. 21 is a block diagram of the whole apparatus.

FIG. 21 is a block diagram of the whole apparatus for performing ink-jet recording in which the ink-jet recording head of the present invention is applied.

The recording apparatus receives print information from a host computer 300 as control signals. The print information is temporarily stored in an input interface 301 inside the recording apparatus and at the same time converted into data that can be processed in the recording apparatus, and inputted to CPU 302 serving also as a head drive signal feed means. The CPU 302 processes the data inputted to the CPU 302, using peripheral units such as RAM 304 in accordance with control programs stored in a ROM 303, to convert the data to printing data (image data).

In order to record the image data on appropriate positions on recording paper, the CPU 302 also makes driving data for driving a driving motor by means of which the recording paper and the recording head are moved in synchronization with the image data. The image data and motor driving data are transmitted to a head 200 and a driving motor through a head driver 307 and a motor driver, respectively, and the head and motor are driven at respectively controlled timing to form images.

Recording mediums usable in the recording apparatus as described above and to which a liquid such as ink is imparted may include paper of various types, OHP sheets, plastic materials used in compact disks, decoration plates and so forth, cloths, metallic materials such as aluminum or copper sheets, leather materials such as bovine leather, pig skin or artificial leather sheets, wood materials such as wood or plywood panels, bamboo materials, ceramic materials such as tiles, and three-dimensional structures such as sponges.

The above recording apparatus includes printing apparatus that make records on paper of various types, OH sheets and so forth, recording apparatus for plastics that make records on plastic materials such as compact disks, recording apparatus for metals that make records on metal plates, recording apparatus for leather that make records on leather sheets, recording apparatus for woods that make records on wood materials, recording apparatus for ceramics that make records on ceramic materials, recording apparatus for making records on three-dimensional structures such as sponges, and textile printing apparatus that make records on cloths.

As discharge liquids used in these liquid discharge apparatus, liquids adapted for the respective recording mediums and recording conditions may be used.

Recording System

An example of ink-jet recording systems for making a record on a recording medium using as a recording head the ink-jet recording head of the present invention will be described below.

Figure 22:
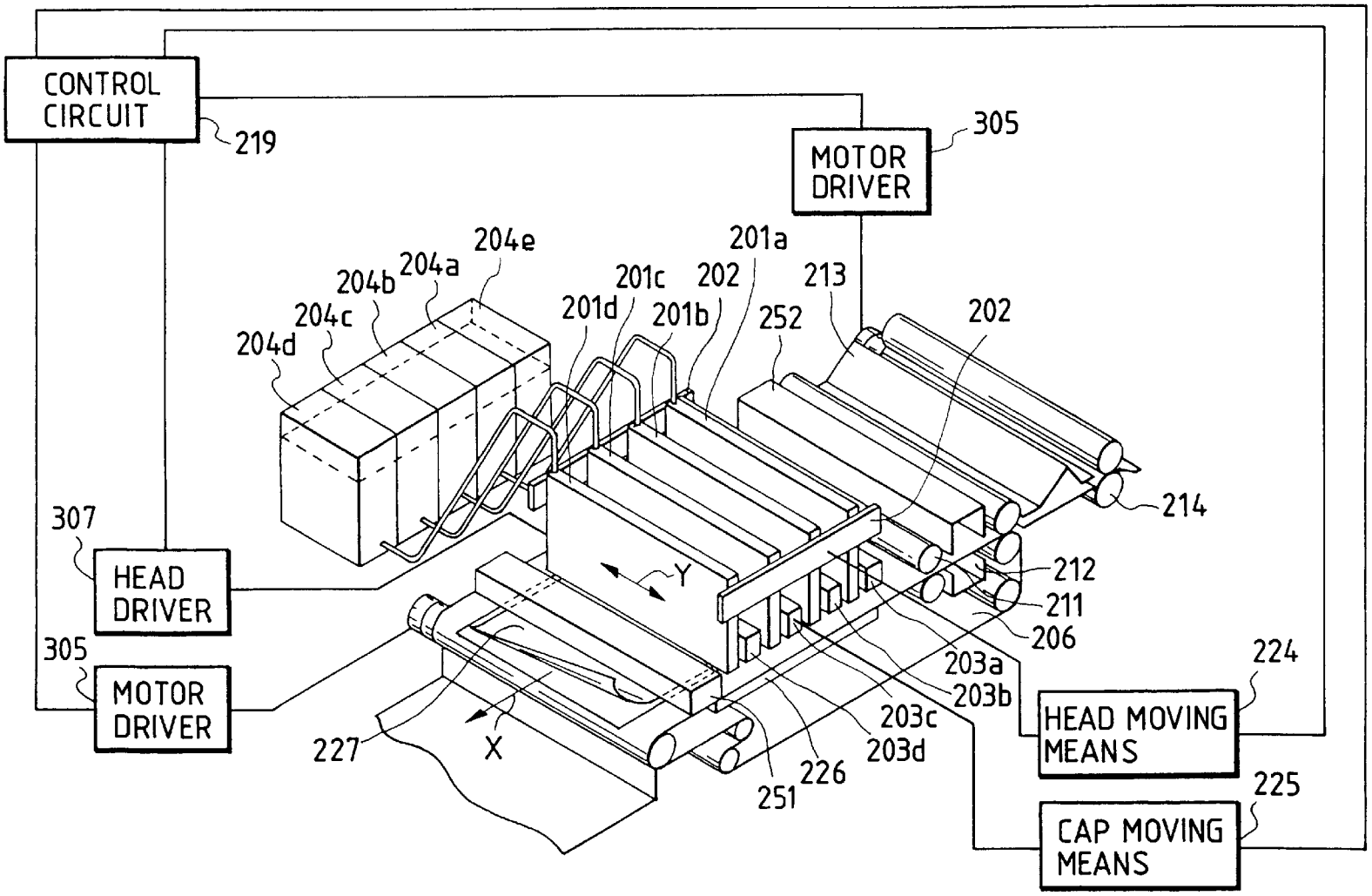
FIG. 22 is a diagrammatic illustration of the construction of an ink-jet recording system.

FIG. 22 is a diagrammatic illustration of the construction of an ink-jet recording system in which the above ink-jet recording head of the present invention is used as a recording head 201. The ink-jet recording head used in this example is a full-line type head provided with a plurality of discharge openings at intervals of 360 dpi over the length corresponding to the recordable width of a recording medium 227, and four heads corresponding to four colors, yellow (Y), magenta (M), cyan (C) and black (Bk), are fixedly supported by a holder 202 in parallel to each other at given intervals in the direction of X.

To these heads, signals are fed from a head driver 307 constituting a means for feeding respective drive signals, and the respective heads are driven in accordance with the signals.

To the four heads, Y, M, C and Bk four color inks are respectively fed as the discharge liquids from respective ink containers 204*a* to 204*d*. Reference numeral 204*e* denotes a bubbling liquid container holding a bubbling liquid, and is so set up that the bubbling liquid is fed from this container to respective heads.

Beneath the respective heads, head caps 203*a* to 203*d* each internally provided with an ink absorbing member such as sponge are respectively provided so that they can cover the discharge openings of the respective heads at the time of non-recording to make maintenance of the heads.

Reference numeral 206 denotes a transport belt constituting a transport means for transporting recording mediums of various types as described in the above embodiments. The transport belt 206 is extended through a given course by means of various rollers, and is driven by driving rollers connected to a motor driver 305.

In the ink-jet recording system of this example, a pretreatment assembly 251 and a post-treatment assembly 252 which make various treatment on the recording medium before and after the recording are provided on the upstream side and downstream side, respectively, of the transport course of the recording medium.

What treatment is made in the pretreatment and post-treatment differs depending on the type of recording mediums and type of inks for the recording. For example, with regard to recording mediums such as metallic, plastic or ceramic materials, they are exposed to ultraviolet rays and ozone as the pretreatment to make their surfaces active so that the adhesion of ink can be improved. In the case of recording mediums tending to cause static electricity such as plastic materials, the static electricity tends to cause attraction of dust to their surfaces, and the dust may obstruct good recording. Accordingly, as the pretreatment the static electricity may be removed from such recording mediums using an ionizer so that the dust can be removed from the recording mediums. In the case when cloths are used as recording mediums, a treatment to impart a substance selected from alkali substances, water-soluble substances, synthetic polymers, water-soluble metal salts, urea and thiourea to the cloths from the viewpoint of preventing feathering and improving percentage exhaustion (rate of dyeing) may be made as the pretreatment. The pretreatment is by no means limited to these, and may include a treatment to control the temperature of recording mediums to a temperature suitable for the recording.

As for the post-treatment, it includes a fixing treatment to subject recording mediums to which ink has been imparted, to heating, ultraviolet ray exposure or the like to accelerate the fixing of the ink, and a treatment to wash away any treating agents imparted in the pretreatment and remaining unreacted.

In this example, a full-line head is used as the head to describe the invention. The head is by no means limited to it, and may be of such a type that the small-sized head as previously described is transported in the width direction of a recording medium to make a record.

What is claimed is:

1. An ink-jet recording head comprising.

a plurality of liquid flow paths each having a discharge opening for discharging an ink with a discharge velocity V and in a discharge quantity Vd, and a plurality of thermoelectric transducers, including a frontward said thermoelectric transducer relative to a discharge opening side and an additional said thermoelectric transducer, provided for each said liquid flow path in order to discharge the ink, wherein in each said liquid flow path the frontward thermoelectric transducer located by the discharge opening side is provided such that when the ink is discharged by the frontward thermoelectric transducer alone, a value of (the discharge velocity v/the discharge quantity Vd) with respect to a distance OH extending from an end of the frontward thermoelectric transducer at its discharge opening side to the discharge opening is at a distance OH and OH lies in either a first region of a regional classification in which the value of v/Vd increases with a decrease in the distance OH and a second region in which v/Vd is substantially constant as the distance OH decreases, and wherein the additional thermoelectric transducer is provided such that, when the ink is discharged by the additional thermoelectric transducer alone, the value of (the discharge velocity v/the discharge quantity Vd) with respect to the distance OH is at the distance OH in a second region in a regional classification for the distance OH into a first region in which the value of v/Vd increases with a decrease in the distance OH and a second region in which the value of v/Vd is substantially constant with an increase in the distance OH.

2. The ink-jet recording head according to claim 1, wherein said additional thermoelectric transducer is substantially the same thermoelectric transducer as the frontward thermoelectric transducer, and said at least one additional thermoelectric transducer has a distance OH that is within the second region.

3. The ink-jet recording head according to claim 2, wherein the thermoelectric transducers are provided such that the distance OH from the frontward end of the discharge opening side of each said thermoelectric transducer to the corresponding said discharge opening is different from that of the additional thermoelectric transducer, and are provided such that a discharge velocity vF and a discharge quantity VdF at a time when ink election is performed using only the frontward thermoelectric transducer and a discharge velocity vF+B and a discharge quantity VdF+B at a time when ink election is performed using the frontward thermoelectric transducer and the additional thermoelectric transducer satisfy a relationship:

$$(vF/VdF)>(vF+B/VdF+B).$$

4. The ink-jet recording head according to claim 2, wherein the thermoelectric transducers are provided in the liquid flow path in the direction of the arrangement of the liquid flow paths.

5. The ink-jet recording head according to claim 2, wherein the plurality of thermoelectric transducers are provided in the liquid flow path in a direction of ink flow.

6. The ink-jet recording head according to claim 1, wherein the thermoelectric transducers form bubbles by film boiling, the thermoelectric transducers each have a length of from 80 $\mu$m to 140 $\mu$m and a width smaller than a diameter of the discharge opening, and both the frontward thermoelectric transducer and the additional thermoelectric transducer have a portion where they are provided adjacently in parallel, and the distance OH of the frontward thermoelectric transducer is not more than 130 $\mu$m.

7. The ink-jet recording head according to claim 1, wherein a thermoelectric transducer located rearward of said frontward thermoelectric transducer is larger than the frontward thermoelectric transducer.

8. The ink-jet recording head according to claim 1, wherein the ink-jet recording head is used in a printer that performs discharge using a first head having a single thermoelectric transducer in a single liquid flow path;

the head being used in exchange for the first head; and a distance OP from a center of gravity of the both thermoelectric transducers to the discharge opening is substantially the same as a distance from a center of gravity of the thermoelectric transducer of the first head to the discharge opening of the first head.

9. The ink-jet recording head according to claim 1, wherein each said thermoelectric transducers has a rectangular shape which is long and slender in a direction of discharge.

10. An ink-jet recording head cartridge comprising:

an ink-jet recording head according to claim 1;

a liquid container holding a liquid that is fed to the ink-jet recording head; and conveying means for conveying the liquid from the liquid container to the ink-jet recording head.

11. An ink-jet recording apparatus comprising:

an ink-jet recording head according to claim 1; and a drive signal feeding means that feeds drive signals for causing the liquid to be discharged from the ink-jet recording head.

12. An ink-jet recording apparatus comprising:

an ink-jet recording head according to claim 1; and a recording medium transport means for transporting a recording medium that receives the liquid discharged from the ink-jet recording head.

13. An ink-jet recording head comprising:

a plurality of liquid flow paths each having a discharge opening for discharging an ink with a discharge velocity v and in a discharge quantity Vd, and a plurality of thermoelectric transducers including a frontward thermoelectric transducer relative to a discharge opening side and an additional thermoelectric transducer, provided for each said liquid flow path in order to discharge the ink, wherein;

in each said liquid flow path the thermoelectric transducers are provided such that a distance from an end of the discharge opening side of one said thermoelectric transducer to the discharge opening is different from that distance for an additional thermoelectric transducer, and said thermoelectric transducers are provided such that a discharge velocity vF and a discharge quantity VdF at a time when only said frontward thermoelectric transducer is used and a discharge velocity vF+B and a discharge quantity VdF+B at a time when both the frontward thermoelectric transducer and the additional thermoelectric transducer are used satisfy a relationship of:

$$(vF/VdF)\geqq(vF+B/VdF+B)\times C$$

wherein C is a constant proportional to a characteristic of the ink.

14. The ink-jet recording head according to claim 13, wherein the discharge velocity vF and the discharge quantity VdF at the time when only the frontward thermoelectric transducer is used and the discharge velocity vF+B and the discharge quantity VDF+B at the time when both the frontward thermoelectric transducer and the additional thermoelectric transducer are used satisfy a relationship of:

$vF\geqq 8$ (m/S)

$vF+B\leqq 16$ (m/S)

$VdF\leqq 25$ (pl)

$35\leqq VdF+B\leqq 45$ (pl).

15. The ink-jet recording head according to claim 14, wherein the ink is an ink having a surface tension of between about 26.0 dyne/cm to about 37.0 dyne/cm and a viscosity of between 1.85 cP to 2.60 cP.

16. The ink-jet recording head according to claim 13, wherein the discharge velocity vF and the discharge quantity VdF at the time when only the frontward thermoelectric transducer is used and the discharge velocity vF+B and the discharge quantity VdF+B at the time when both the frontward thermoelectric transducer and the additional thermoelectric transducer are used satisfy a relationship of:

$vF\geqq 7.5$ (m/S)

$vF+B\leqq 16$ (m/S)

$VdF\leqq 40$ (pl)

$65\leqq VdF+B<80$ (pl).

17. The ink-jet recording head according to claim 16, wherein the ink is an ink having a surface tension of between about 40.5 dyne/cm to about 46.5 dyne/cm and a viscosity of between 1.5 cP to 2.1 cP.

18. The ink-jet recording head according to claim 13, wherein more than one said ink-jet recording head is provided and further comprising:

a plurality of different liquid chambers respectively provided for a plurality of inks; and a first said head where the ink held therein has a surface tension of between about 26.0 dyne/cm to about 37.0 dyne/cm and a viscosity of between 1.85 cP to 2.60 cP and for which the constant C has a value of 1.5, and a second said head where the ink held therein has a surface tension of between about 40.5 dyne/cm to about 46.5 dyne/cm and a viscosity of between 1.5 cP to 2.1 cP and for which the constant C has a value of 1.0.

19. The ink-jet recording head according to claim 13, wherein rearward thermoelectric transducer located rearward of said frontward thermoelectric transducer is larger than the frontward thermoelectric transducer.

20. The ink-jet recording head according to claim 19, further comprising a protective layer covering each of the thermoelectric transducers, and the protective layer covering the rearward thermoelectric transducer has a layer thickness which is smaller than a layer thickness of the protective layer covering the frontward thermoelectric transducer.

21. The ink-jet recording head according to claim 19, further comprising:

a plurality of substrates, each said substrate having some of said thermoelectric transducers disposed thereon; and a heat accumulation layer provided between each of the thermoelectric transducers and each of substrates that support the thermoelectric transducers, and the heat accumulation layer for the rearward thermoelectric transducer has a layer thickness smaller than a layer thickness for the heat accumulation layer for the frontward thermoelectric transducer.

22. An ink-jet recording head comprising:

a plurality of liquid flow paths each having a discharge opening for discharging an ink with a discharge velocity, and a plurality of thermoelectric transducers including a frontward thermoelectric transducer relative to a discharge opening side and an additional thermoelectric transducer provided for each said liquid flow path in order to discharge the ink, wherein;

a discharge velocity vF and a discharge quantity dF at a time when only said frontward thermoelectric transducer is used and a discharge velocity vF+B and a discharge quantity VdF+B at a time when both the frontward thermoelectric transducer and the additional thermoelectric transducer are used satisfies a relationship of:

$vF \geqq 8$ (m/S)

$vF+B \leqq 16$ (m/S)

$VdF \leqq 25$ (pl)

$35 \leqq VdF+B \leqq 45$ (pl)

when an ink having a surface tension of between about 26.0 dyne/cm to about 37.0 dyne/cm and a viscosity of between 1.85 cP to 2.60 cP is used; and further satisfies a relationship of:

$vF \geqq 7.5$ (m/S)

$vF+B \leqq 16$ (m/S)

$VdF \leqq 40$ (pl)

$65 \leqq VdF+B \leqq 80$ (pl)

when an ink having a surface tension of between about 40.5 dyne/cm to about 46.5 dyne/cm and a viscosity of between 1.5 cP to 2.1 cP is used;

the thermoelectric transducers being provided such that a distance OH from an end of the discharge opening side of one said thermoelectric transducer to the discharge opening is different from the distance OH from an end of an additional thermoelectric transducer to the discharge opening, and the frontward thermoelectric transducer is provided in a region where the distance OH is not more than 130 $\mu$m .

23. An ink-jet recording head for use in a printer that performs discharge using a first head, comprising.

i) a plurality of liquid flow paths each having a discharge opening for discharging an ink; and ii) a plurality of thermoelectric transducers provided for a given said liquid flow path;

the head being used in exchange for the first head, and having two said thermoelectric transducers provided in parallel for one said liquid flow path and being used as a second head; and a distance OP from a center of gravity of each said thermoelectric transducer of the second head to the discharge opening being substantially the same as a distance OC from a center of gravity of the thermoelectric transducer of the first head to the discharge opening of the first head.

24. The ink-jet recording head according to claim 23, wherein the distance OP from the center of gravity of each said thermoelectric transducer to the discharge opening is smaller than the distance OC from the center of gravity of the thermoelectric transducer of the first head to the discharge opening of the first head.

25. An ink-jet recording head comprising:

an ink flow path having a discharge opening for discharging an ink; and a plurality of thermoelectric transducers provide d for said ink flow path, each said thermoelectric transducer having an area, a length and a width, wherein;

the ink-jet recording head satisfies a relationship such that $Vd1/Vd2 \leqq Sh1/Sh2$, wherein the areas of two said thermoelectric transducers of the plurality of thermoelectric transducers are represented by Sh1 and Sh2 ($Sh1>Sh2$) and each of those two thermoelectric transducers has an ink discharge quantity, said ink discharge quantities being represented by Vd1 and Vd2, respectively; and a relationship such that $OC1>OC2$ is satisfied wherein the distances between the respective area centers and discharge openings of the two thermoelectric transducers are represented by OC1 and OC2, respectively.

26. The ink-jet recording head according to claim 25, wherein a relationship such that $L1>L2$ is satisfied, wherein the lengths of the two thermoelectric transducers in a direction of ink discharge are represented by L1 and L2, respectively.

27. The ink-jet recording head according to claim 25, wherein a relationship such that $L1/W1<L2/W2$ is satisfied, wherein the lengths of the two thermoelectric transducers in a direction of ink discharge are represented by L1 and L2, respectively, and the widths of the two thermoelectric transducers in a direction falling at right angles to the length in the direction of ink discharge are represented by W1 and W2, respectively, and a relationship such that $Sh1=W1\times L1$ and $Sh2=W2\times L2$ is satisfied.

28. The ink-jet recording head according to claim 25, wherein a relationship such that $L1/W1>L2/W2$ is satisfied, wherein the lengths of the two thermoelectric transducers in a direction of ink discharge are represented by L1 and L2, respectively, and the widths of the two thermoelectric transducers in a direction falling at right angles to the length in the direction of ink discharge are represented by W1 and W2, respectively, and a relationship such that $Sh1=W1\times L1$ and $Sh2=W2\times L2$ is satisfied.

29. The ink-jet recording head according to claim 25, wherein the thermoelectric transducers provided for one ink flow path are two thermoelectric transducers.

30. The ink-jet recording head according to claim 25, wherein the two thermoelectric transducers have a portion side by side adjacent to each other in a direction falling at right angles to the direction of a flow of ink in the ink flow path.

31. An ink-jet recording apparatus comprising:

an ink-jet recording head comprising an ink flow path having a discharge opening for discharging an ink and a plurality of thermoelectric transducers provided for said ink flow path, each of said thermoelectric transducers having an area, an associated ink discharge quantity, a length and a width, the ink being discharged onto a recording medium to make a record, wherein;

a relationship such that $Vd1/Vd2 \leqq Sh1/Sh2$ is satisfied, wherein the areas of two said thermoelectric transducers from among the plurality of thermoelectric transducers are represented by Sh1 and Sh2 (Sh1>Sh2) and the ink discharge quantities corresponding to the two thermoelectric transducers are represented by Vd1 and Vd2, respectively; and wherein a relationship such that OC1>OC2 is satisfied when distances between the respective area centers and discharge openings of the two thermoelectric transducers are represented by OC1 and OC2.

32. The ink-jet recording apparatus according to claim 31, wherein the ink-jet recording head satisfies a relationship such that L1>L2, wherein the lengths of the two thermoelectric transducers in a direction of ink discharge are represented by L1 and L2, respectively.

33. The ink-jet recording apparatus according to claim 31, wherein the ink-jet recording head satisfies a relationship such that L1/W1<L2/W2, wherein the lengths of the two thermoelectric transducers in a direction of ink discharge are represented by L1 and L2, respectively, and the widths of the two thermoelectric transducers in a direction falling at right angles to the length in the direction of ink discharge are represented by W1 and W2, respectively, and wherein a relationship such that Sh1=W1×L1 and Sh2=W2×L2 is satisfied.

34. The ink-jet recording apparatus according to claim 31, wherein the ink-jet recording head satisfies a relationship such that L1/W1>L2/W2, wherein the lengths of the two thermoelectric transducers in a direction of ink discharge are represented by L1 and L2, respectively, and the widths of the two thermoelectric transducers in a direction falling at right angles to the length in the direction of ink discharge are represented by W1 and W2, respectively, and wherein a relationship such that Sh1=W1×L1 and Sh2=W2×L2 is satisfied.

35. The ink-jet recording apparatus according to claim 31, wherein the thermoelectric transducers provided for the ink flow path are two thermoelectric transducers.

36. The ink-jet recording apparatus according to claim 31, wherein the two thermoelectric transducers have a portion side by side adjacent to each other in a direction falling at right angles with a direction of a flow of the ink in the ink flow path.

* * * * *

UNITED STATES PATENT AND TRADEMARK OFFICE

CERTIFICATE OF CORRECTION

PATENT NO. : 6,062,678
DATED : May 16, 2000
INVENTOR(S) : Hiroyuki Ishinaga et al.

It is certified that error appears in the above-identified patent and that said Letters Patent is hereby corrected as shown below:

Title page,
Item [73], Assignee, "Canon Kabushiki Kaisha, Japan" should read -- Canon Kabushiki Kaisha, Tokyo, Japan --.

Column 2,
Line 15, "can not" should read -- cannot --; and
Line 29, "quantity, thus" should read -- quantity; thus --.

Column 3,
Line 20, "wherein;" should read --wherein: --.

Column 4,
Line 5, "wherein;" should read -- wherein: --;
Line 17, "used satisfy" should read -- used may satisfy --;
Line 43, "vF≤7.5 (m/S)" should read -- vF≥7.5 (m/S) --; and
Line 64, "wherein;" should read -- wherein: --.

Column 5,
Line 6, "v≤8 (m/S)" should read -- v≥8 (m/S) --;
Line 9, "35≤VdF+B≤45 (pl)" should read -- 35≤VdF+B≤45 (pl) --;
Line 12, "and satisfy" should read -- and may satisfy --; and
Lines 40-44, indented lines.

Column 9,
Line 61, "the all" should read -- all the --.

Column 10,
Line 45, "side, thus" should read -- side; thus --.

Column 11,
Line 41, "debbubling" should read -- debubbling --; and
Line 49, "(F+R/R).Vd." should read -- (F+R/R)·Vd. --.

Column 12,
Line 18, "comes" should read -- come --;
Line 24, "ink, thus" should read -- ink; thus --;
Line 45, "that" should read -- such that --; and
Line 62, "$2(SO'/\Pi)^{1}/_{2}$" should read -- $2(SO'/\Pi)^{1/2}$ --.

UNITED STATES PATENT AND TRADEMARK OFFICE

CERTIFICATE OF CORRECTION

PATENT NO. : 6,062,678
DATED : May 16, 2000
INVENTOR(S) : Hiroyuki Ishinaga et al.

It is certified that error appears in the above-identified patent and that said Letters Patent is hereby corrected as shown below:

Column 13,
Line 31, "can not" should read -- cannot --; and
Line 62, "instance be" should read -- instance may be --.

Column 14,
Line 30, "communicate" should read -- communicates --;
Line 46, "bubbles," should read -- bubbles; --; and
Line 57, "mist" should read -- mist, --.

Column 15,
Table 3(a), "small ink drops, ink mist" should read -- small ink drops, ink mist much --.

Column 16,
Table 3(b), "drops" (both occurrences) should read -- drops, --;
Line 30, "shows" should read -- show --;
Line 39, "measurement," should read -- measurements, --; and
Line 41, "measurement" should read -- measurements --.

Column 17,
Table 4, "$0.7(1/V_f - V_{f+b})$" should read -- $0.7\ (1/V_f - 1/V_{f+b})$ --.

Column 18,
Line 13, "heaters" should read -- heaters, --;
Line 14, "1003" should read -- 1003, --;
Line 42, "show" should read -- shows --; and
Line 67, "satisfy" should read -- satisfies --.

Column 19,
Line 44, "of of" should read -- of --.

Column 20,
Line 8, "superposed," should read -- superposed; --;
Line 15, "element," should read -- element; --;
Line 42, "of of" should read -- of --;
Line 59, "removed," should read -- removed; --; and
Line 67, "element," should read -- element; --.

UNITED STATES PATENT AND TRADEMARK OFFICE

CERTIFICATE OF CORRECTION

PATENT NO. : 6,062,678
DATED : May 16, 2000
INVENTOR(S) : Hiroyuki Ishinaga et al.

It is certified that error appears in the above-identified patent and that said Letters Patent is hereby corrected as shown below:

Column 22,
Line 5, "work load." should read -- workload. --;
Line 7, "quantities" should read -- quantities, --;
Line 14, "less cause" should read -- reduce --; and
Line 35, "ink, thus" should read -- ink; thus --.

Column 23,
Line 35, "wherein;" should read -- wherein: --.

Column 24,
Line 10, "one ends" should read -- two ends --;
Line 12, "other ends" should read -- other two ends --;
Line 56, "upper" should read -- higher --; and
Line 61, "have" should read -- has --.

Column 25,
Line 43, "escape" should read -- escapes --.

Column 26,
Line 47, "lose" should read -- loss --.

Column 27,
Line 38, "SHA+B" should read -- ShA+B --.

Column 29,
Line 15, "thereon a" should read -- thereon is a --; and
Line 46, "support," should read -- support; --.

Column 30,
Line 15, "it can" should read -- can it --; and
Line 50, "in-tank" should read -- ink tank --.

Column 31,
Line 33, "perse" should read -- perses --;
Line 52, "sealing," should read -- sealing; --;
Line 63, "carriadge" (both occurrences) should read -- carriage --; and
Line 67, "carriadge" should read -- carriage --.

UNITED STATES PATENT AND TRADEMARK OFFICE

CERTIFICATE OF CORRECTION

PATENT NO. : 6,062,678
DATED : May 16, 2000
INVENTOR(S) : Hiroyuki Ishinaga et al.

It is certified that error appears in the above-identified patent and that said Letters Patent is hereby corrected as shown below:

Column 32,
Lines 2, 7, 10, 24 and 30, "carriadge" should read -- carriage --;

Column 36,
Line 21, "used satisfy" should read -- used may satisfy --;
Line 34, "used satisfy" should read -- used may satisfy --; and
Line 54, "65≤VdF+B<80 (pl)." should read -- 65≤VdF+B≤80 (pl). --;

Column 37,
Line 54, "65≤VdF+B≤80 (pl)." should read -- 65≤VdF+B≤80 (pl). --.

Column 38,
Line 2, comprising." should read -- comprising: --; and
Line 26, "provide d" should read -- provided --.

Signed and Sealed this

Twenty-second Day of January, 2002

*Attest:*

*Attesting Officer*

JAMES E. ROGAN
*Director of the United States Patent and Trademark Office*